US012442178B2

(12) United States Patent
DiCristofaro

(10) Patent No.: US 12,442,178 B2
(45) Date of Patent: Oct. 14, 2025

(54) MOBILE MEDICAL UNITS

(71) Applicant: FERO INTERNATIONAL INC., Stoney Creek (CA)

(72) Inventor: Vincenzo DiCristofaro, Burlington (CA)

(73) Assignee: FERO INTERNATIONAL INC., Stoney Creek (CA)

( * ) Notice: Subject to any disclaimer, the term of this patent is extended or adjusted under 35 U.S.C. 154(b) by 305 days.

(21) Appl. No.: 18/017,574

(22) PCT Filed: Jul. 23, 2021

(86) PCT No.: PCT/CA2021/051031

§ 371 (c)(1),
(2) Date: Jan. 23, 2023

(87) PCT Pub. No.: WO2022/016291

PCT Pub. Date: Jan. 27, 2022

(65) Prior Publication Data

US 2023/0304278 A1 Sep. 28, 2023

Related U.S. Application Data

(60) Provisional application No. 63/071,361, filed on Aug. 28, 2020, provisional application No. 63/071,398,
(Continued)

(51) Int. Cl.
*E04B 1/34* (2006.01)
*E04B 1/348* (2006.01)
(Continued)

(52) U.S. Cl.
CPC ..... *E04B 1/34861* (2013.01); *E04B 1/3483* (2013.01); *E04B 1/34869* (2013.01);
(Continued)

(58) Field of Classification Search
CPC ..... F24F 2011/0005; F24F 3/167; F24F 2221/12; F24F 11/72; F24F 11/50;
(Continued)

(56) References Cited

U.S. PATENT DOCUMENTS 2,795,014 A 6/1957 Kelly
3,022,869 A 2/1962 Radek
(Continued)

FOREIGN PATENT DOCUMENTS

CA 2245624 A1 2/2000
CA 2486205 A1 12/2003
(Continued)

OTHER PUBLICATIONS

International Search Report and Written Opinion mailed Oct. 6, 2021 in International Patent Application No. PCT/CA2021/051031 (15 pages).

(Continued)

*Primary Examiner* — Patrick J Maestri
(74) *Attorney, Agent, or Firm* — SMART & BIGGAR LP; Torino Roserio Orsi; Christopher Kowal

(57) ABSTRACT

Various embodiments are described herein or structures that may be portable, semi-permanent or permanent and made from modular structures for serving a variety of purposes. The modular structures may be made from shipping containers and include air control systems for independently maintaining and transitioning the same rooms of the structure to and from different pressures relative to the outside environment. The rooms of the structures may have wall panels that are constructed to attach to the inner surface of the shipping containers while having a reduced footprint and also laterally engaging one another to increase structural integrity and forming a pressure seal. Various types of compound structures can be formed by connecting the
(Continued)

module structures in an airtight fashion by using various seals.

37 Claims, 20 Drawing Sheets

Related U.S. Application Data filed on Aug. 28, 2020, provisional application No. 63/071,395, filed on Aug. 28, 2020, provisional application No. 63/071,358, filed on Aug. 27, 2020, provisional application No. 63/071,359, filed on Aug. 27, 2020, provisional application No. 63/055,538, filed on Jul. 23, 2020.

(51) Int. Cl.
*F24F 3/167* (2021.01)
*F24F 8/108* (2021.01)
*F24F 11/72* (2018.01)

(52) U.S. Cl.
CPC ..... *F24F 3/167* (2021.01); *F24F 8/108* (2021.01); *F24F 11/72* (2018.01); *F24F 2221/12* (2013.01)

(58) Field of Classification Search
CPC ..... F24F 8/108; F24F 2011/0004; E04B 1/34861; E04B 1/34869; E04H 3/08; E04H 2001/1283
See application file for complete search history.

(56) References Cited

U.S. PATENT DOCUMENTS

| | | | | |
|---|---|---|---|---|
| 3,766,844 | A * | 10/1973 | Donnelly | F24F 3/167 454/238 |
| 4,833,841 | A | 5/1989 | Ellington, III | |
| 5,538,471 | A * | 7/1996 | Guiles, Jr. | F24F 11/77 454/238 |
| 6,591,558 | B1 | 7/2003 | De Zen | |
| 8,322,086 | B2 | 12/2012 | Weber | |
| 9,631,365 | B2 | 4/2017 | Bottin et al. | |
| 10,196,809 | B2 | 2/2019 | Hall et al. | |
| 10,293,591 | B2 | 5/2019 | Nielsen-Cole et al. | |
| 10,492,970 | B2 | 12/2019 | Merino et al. | |
| 10,557,262 | B2 | 2/2020 | Moran et al. | |
| 11,401,722 | B1 * | 8/2022 | Jalakian | E04H 1/125 |
| 2007/0253831 | A1 * | 11/2007 | Lee | F24F 1/0071 417/43 |
| 2007/0271857 | A1 | 11/2007 | Heather et al. | |
| 2011/0232543 | A1 | 9/2011 | Burroughs et al. | |
| 2012/0077429 | A1 * | 3/2012 | Wernimont | F24F 3/167 52/302.1 |
| 2012/0160854 | A1 | 6/2012 | Defoe et al. | |
| 2012/0279141 | A1 | 11/2012 | Wiederick et al. | |
| 2015/0101264 | A1 | 4/2015 | Jornitz | |
| 2016/0010884 | A1 * | 1/2016 | Holtz | F24F 8/00 454/187 |
| 2018/0195266 | A1 | 7/2018 | Arakane et al. | |
| 2021/0047828 | A1 | 2/2021 | Williams et al. | |
| 2022/0025663 | A1 | 1/2022 | Heitsman | |
| 2022/0064935 | A1 | 3/2022 | Williams et al. | |
| 2023/0145279 | A1 | 5/2023 | Snorrason | |
| 2023/0323653 | A1 | 10/2023 | Dicristofaro | |

FOREIGN PATENT DOCUMENTS

| | | | |
|---|---|---|---|
| CA | 2954904 | A1 | 1/2016 |
| CN | 110141441 | A | 8/2019 |
| DE | 4230357 | A1 | 3/1994 |
| KR | 101471039 | B1 | 12/2014 |
| KR | 101644921 | B1 | 8/2016 |
| KR | 101646524 | B1 | 8/2016 |
| WO | 2014056549 | A1 | 4/2014 |
| WO | 2022061458 | A1 | 3/2022 |

OTHER PUBLICATIONS

International Search Report and Written Opinion mailed May 1, 2023 in International Patent Application No. PCT/CA2023/050106 (10 pages).
International Search Report and Written Opinion mailed Nov. 30, 2021 in International Patent Application No. PCT/CA2021/051323 (13 pages).
Extended European Search Report dated Jul. 24, 2024 in European Patent Application No. 21847243.9 (9 pages).

* cited by examiner

MOUNTING SUPPORT TO CHANNELS AND RAILS
412
402a
402
402b
404a
404
404b
430a
430b
414
MOUNTING SUPPORT TO CHANNELS AND RAILS

TABS ANGLED TO FORM TAB-IN-LOC LATCHING BETWEEN PANELS
ON ASSEMBLY LOCKING TABS GUILD PANELS TOGETHER, ALLOWING PANEL TO PANEL FASTENING WITHOUT ADDITIONAL FASTENERS, DESIGN OF TAB-N-LOCK ALSO LEVELS THE FRONT FACES OF PANELS
404
408b
410b
402
410a
408a 402
404

402
404

410
408
400c
400
402
404
407
406
CAVITY FOR INSULATION

MOBILE MEDICAL UNITS

CROSS REFERENCE TO RELATED APPLICATIONS

This application claims priority from U.S. Provisional Patent Application No. 63/055,538, filed on Jul. 23, 2020, from United States Provisional Patent Application No. 63/071,358, filed on Aug. 27, 2020, from United States Provisional Patent Application No. 63/071,359, filed on Aug. 27, 2020, from U.S. Provisional Patent Application No. 63/071,361, filed on Aug. 28, 2020, from U.S. Provisional Patent Application No. 63/071,395, filed on Aug. 28, 2020, and from U.S. Provisional Patent Application No. 63/071,398, filed on Aug. 28, 2020, all of which is hereby incorporated by reference in their entirety.

FIELD

Various embodiments are described herein that relate generally to various aspects of portable, permanent and/or semi-permanent structures including, but not limited to, shipping containers, and various types of dwellings including medical units such as, but not limited to, portable intensive care units (ICUs), operating rooms (ORs), step down or isolation rooms, long-term care units, and other segregated isolation chambers, and systems thereof as well as non-medical uses.

BACKGROUND

The following paragraphs are provided by way of background to the present disclosure. They are not, however, an admission that anything discussed therein is prior art or part of the knowledge of persons skilled in the art.

Portable structural units can be helpful in providing temporary structures during times of need. For example, when the portable structural unit is a mobile medical unit such as, but not limited to, mobile intensive care units (ICUs) or operating rooms (ORs), such mobile structures can be useful for field medical operations, and for expanding the capacity of a permanent hospital location to enable health care workers to respond to unplanned increases in patient loads.

However, various practical matters are not addressed in the prior art for certain portable, semi-permanent and permanent structures. For example, while these conventional portable structures are promoted for being rapidly deployable, this appears to stem solely from the fact that they are portable, and they may not be versatile for use in different situations. However, some of these structures do not include airflow systems or if they do include airflow systems, they are rudimentary and are not versatile.

Furthermore, the prior art does not disclose any formats, techniques or materials that are for maximizing the amount of interior volume that is usable for personnel, beds, air handling, medical equipment and utilities when the space is somewhat limited in a portable or semi-permanent structure. Standard interior wall construction materials and techniques that are in common use for larger spaces reduce in greater proportion the usable interior volume in smaller spaces.

SUMMARY

Disclosed herein are generally various configurations of portable modular units including semi-permanent units, systems including multiple portable units, various aspects of physical, electrical and/or communications interconnections between different portable units in such a system. In another aspect, certain embodiments describe various techniques and materials usable for construction of the portable units. Some of the teachings herein are also applicable to permanent structures. Examples of portable, semi-permanent and permanent structures to which at least some of the teachings herein pertain include various structures such as, but not limited to, shipping containers and various types of dwellings including medical units such as, but not limited to, portable intensive care units (ICUs), operating rooms (ORs), step down or isolation rooms, long-term care units, and other segregated isolation chambers, as well as non-medical uses.

In one broad aspect, in accordance with the teachings herein, there is provided at least one embodiment of structure that is portable, permanent or semi-permanent, wherein the structure comprises a housing defining a room therein; and an air flow system that is coupled to the room for providing conditioned air thereto, the air flow system including components located in a maintenance room adjacent to the room and components located exterior to the maintenance room, the air flow system being configured to controllably transition the at least one room between an positive air pressure configuration, a neutral air pressure configuration and a negative air pressure configuration relative to an environment that is external to the housing.

In another aspect, in accordance with the teachings herein, in at least one embodiment there is provided a wall panel system for a structure, wherein the wall panel system comprises at least one wall panel having a panel comprising: a front surface and a rear surface opposite the front surface; a right side surface and a left side surface opposite the front surface; a lateral interlock system comprising a first lateral interlock interface that is disposed at the right side surface and a second lateral interlock interface that is disposed at the left side surface, each of the first and second lateral interlock interfaces comprising at least one lateral interface component; wherein the at least one lateral interface component of the first or second lateral interlock interface of the at least one wall panel is oriented to slidably engage at least one lateral interface component of a corresponding interlock interface of an adjacent wall panel to connect the at least one wall panel and the adjacent wall panel in a co-planar fashion to form a larger wall section.

In another aspect, in accordance with the teachings herein, in at least one embodiment there is provided a mobile medical unit comprising: a housing provided by a shipping container or portion thereof; a first room in the housing, the first room being a patient chamber; and an air flow system that is coupled to the room for providing conditioned air thereto and configuring the room to transition between any one of a positive air pressure configuration, a neutral air pressure configuration or a negative air pressure configuration relative to an environment that is external to the housing.

In another aspect, in accordance with the teachings herein, in at least one embodiment there is provided a compound structure comprising: a first shipping container; and a second shipping container, at least one opening that is common to both containers; and a seal that is disposed about the at least one opening; wherein the first and second shipping containers are coupled to one another such that the at least one openings are aligned and the first and second shipping containers are urged together during coupling to provide a pressure seal around the at least one opening.

In another aspect, in accordance with the teachings herein, any of the structures or compound structures described herein may be used as a medical structure including a patient chamber, an OR, an ICU, or a nurses station, a pharmacy, an educational structure including a classroom and/or a portable, a military structure, a correctional facility, a penitentiary structure, a testing and vaccination centre, a quarantine facility, a modular laboratory structure, a cleanroom, a long-term care facility, a natural disaster safe shelter, an indigenous community housing structure, a vertical farming structure, a grow room, a clean room, a mobile restaurant, a mobile bar, a cottage, a retail structure, a mining structure, a modular housing structure, a social housing structure or a remote community structure.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description. For example, aspects described and depicted herein may be more generally applicable to fixed (i.e., immobile) constructions.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
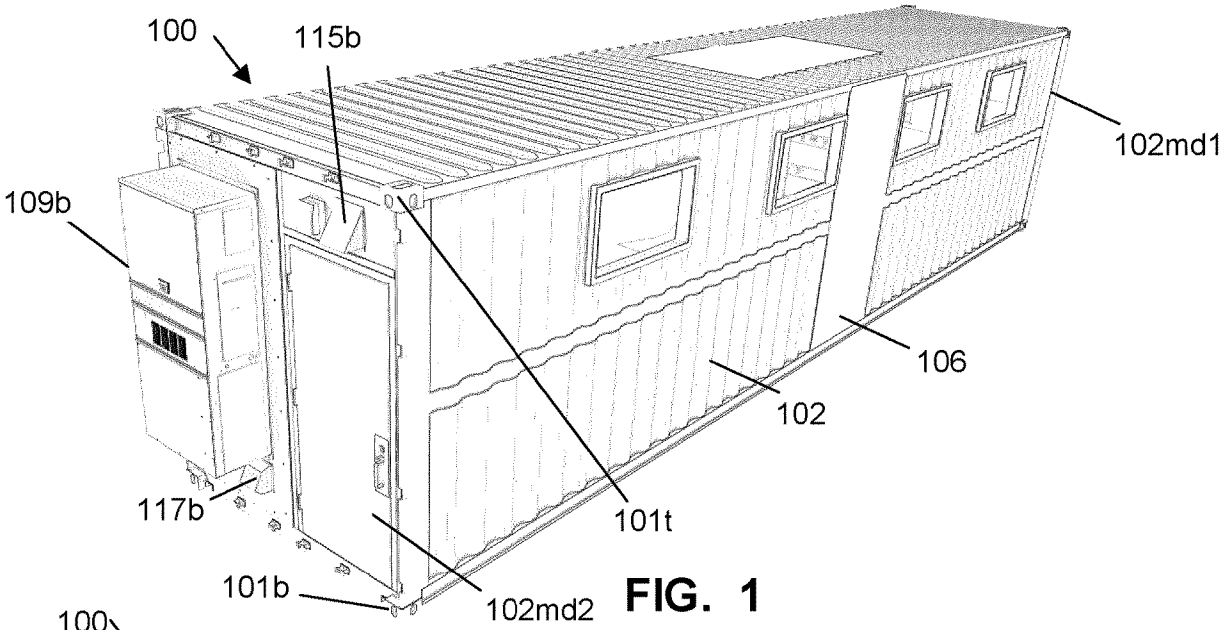
FIG. 1 is a front perspective view of a mobile/portable medical unit, according to an example embodiment in accordance with the teachings herein.

Further aspects and features of the example embodiments described herein will appear from the following description taken together with the accompanying drawings.

DETAILED DESCRIPTION OF THE EMBODIMENTS

The headings and Abstract of the Disclosure provided herein are for convenience only and do not interpret the scope or meaning of the embodiments.

Various embodiments in accordance with the teachings herein will be described below to provide an example of at least one embodiment of the claimed subject matter. No embodiment described herein limits any claimed subject matter. The claimed subject matter is not limited to devices, systems, or methods having all of the features of any one of the devices, systems, or methods described below or to features common to multiple or all of the devices, systems, or methods described herein. It is possible that there may be a device, system, or method described herein that is not an embodiment of any claimed subject matter. Any subject matter that is described herein that is not claimed in this document may be the subject matter of another protective instrument, for example, a continuing patent application, and the applicants, inventors, or owners do not intend to abandon, disclaim, or dedicate to the public any such subject matter by its disclosure in this document.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures, and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which these terms are used. For example, the terms coupled or coupling can have an electrical, mechanical or structural connotation. For example, as used herein, the terms coupled or coupling can indicate that two elements or devices can be directly connected to one another or connected to one another through one or more intermediate elements or devices via an electrical signal, an electrical connection, a mechanical element, a structural element or an airflow depending on the particular context.

Unless the context requires otherwise, throughout the specification and claims which follow, the word "comprise" and variations thereof, such as, "comprises" and "comprising" are to be construed in an open, inclusive sense, that is, as "including, but not limited to".

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term, such as by 1%, 2%, 5%, or 10%, for example, if this deviation does not negate the meaning of the term it modifies.

Furthermore, the recitation of numerical ranges by endpoints herein includes all numbers and fractions subsumed within that range (e.g., 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

Reference throughout this specification to "one embodiment", "an embodiment", "at least one embodiment" or "some embodiments" means that one or more particular features, structures, or characteristics may be combined in any suitable manner in one or more embodiments, unless otherwise specified to be not combinable or to be alternative options.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

The example embodiments of some of the devices, systems, or methods described in accordance with the teachings herein are generally implemented as a combination of hardware and software. For example, the embodiments described herein may be implemented, at least in part, by using one or more computer programs, executing on one or more programmable devices comprising at least one processing element and at least one storage element (i.e., at least one volatile memory element and at least one non-volatile memory element). The hardware may comprise input devices including at least one of a touch screen, a keyboard, a mouse, buttons, keys, sliders, and the like, as well as one or more of a display, a printer, one or more sensors, and the like depending on the implementation of the hardware.

It should also be noted that some elements that are used to implement at least part of the embodiments described herein may be implemented via software that is written in a high-level procedural language such as object-oriented programming. The program code may be written in C++, C #, JavaScript, Python, or any other suitable programming language and may comprise modules or classes, as is known to those skilled in object-oriented programming. Alternatively, or in addition thereto, some of these elements implemented via software may be written in assembly language, machine language, or firmware as needed. In either case, the language may be a compiled or interpreted language.

At least some of these software programs may be stored on a computer readable medium such as, but not limited to, a ROM, a magnetic disk, an optical disc, a USB key, and the like that is readable by a device having a processor, an operating system, and the associated hardware and software that is necessary to implement the functionality of at least one of the embodiments described herein. The software program code, when read by the device, configures the device to operate in a new, specific, and predefined manner (e.g., as a specific-purpose computer) in order to perform at least one of the methods described herein.

At least some of the programs associated with the devices, systems, and methods of the embodiments described herein may be capable of being distributed in a computer program product comprising a computer readable medium that bears computer usable instructions, such as program code, for one or more processing units. The medium may be provided in various forms, including non-transitory forms such as, but not limited to, one or more diskettes, compact disks, tapes, chips, and magnetic and electronic storage. In alternative embodiments, the medium may be transitory in nature such as, but not limited to, wire-line transmissions, satellite transmissions, internet transmissions (e.g., downloads), media, digital and analog signals, and the like. The computer useable instructions may also be in various formats, including compiled and non-compiled code.

In accordance with the teachings herein, there are provided various configurations of portable, semi-permanent or permanent units as well as various techniques and materials usable for construction of these units. The following description and drawings set forth embodiments in which the portable units are portable medical units constructed based on intermodal/shipping containers. However, many aspects described and depicted herein are generally applicable to portable units being constructed using other materials and/or for other applications. Furthermore, aspects described and depicted herein may be more generally applicable to portable, semi-permanent or fixed (i.e., immobile or permanent) constructions.

For example, various embodiments of an air control system and associated control methods are described herein that generally apply to a structure having a room, with it not necessarily being a medical room. Furthermore, while the description provides examples in which the teachings herein are applied to a portable structure, which in this case is a mobile medical unit having a room that is a patient chamber, examples of other applications in which the teachings herein can be applied include other types of structures such as, but are not limited to, educational structures including classroom portables, military structures, correctional facilities, penitentiary structures, testing and vaccination centres, quarantine facilities, modular laboratory structures, cleanrooms, long-term care facilities, natural disaster safe shelters, indigenous community housing, vertical farming, grow rooms, clean rooms, mobile restaurants, mobile bars, cottages, retail structures, mining structures, modular housing, social housing and remote communities, for instance.

Furthermore, at least some of the teachings herein may be adapted for and generally applicable to fixed (i.e., immobile) constructions such as, but not limited to, fixed infrastructure for hospitals and medical clinics, educational structures including classroom portables, military structures, correctional facilities, penitentiary structures, testing and vaccination centres, quarantine facilities, laboratory structures, cleanrooms, long-term care facilities, natural disaster safe shelters, indigenous community housing, vertical farming, grow rooms, clean rooms, mobile restaurants, mobile bars, cottages, retail structures, mining structures, modular housing, social housing and remote communities, for instance.

It should also be understood herein that the words portable and mobile may be used synonymously and interchangeably in that they both represent a structure or unit that may be moved from one location to another location or may be a temporary structure that can be assembled at a first location, and then be disassembled and the parts moved to a second location where it is reassembled.

In another aspect, in accordance with the teachings herein, there is described at least one embodiment of a controllable airflow system for a structure, which may be mobile/portable, semi-permanent or permanent, that can be controlled to render an enclosed chamber that is in the structure and with which the controllable airflow system is associated and may be controlled to transition air pressure in the chamber so that the chamber is a positive pressure chamber, a negative pressure chamber, or a neutral pressure chamber.

In another aspect, in accordance with the teachings herein, there is described at least one embodiment of a method of controlling a controllable airflow system to maintain a chamber at negative pressure but to modify the amount of negative pressure with respect to ambient pressure, and/or to maintain a chamber at positive pressure but to modify the amount of positive pressure with respect to ambient pressure.

Ambient pressure is generally defined as being the pressure that surrounds an object. For example, ambient pressure may be the pressure of the environment that surrounds the room whose pressure is being controlled to be a positive pressure, negative pressure or neutral pressure with respect to its surrounding environment. In some cases, the ambient pressure may be the outside open-air environment. In at least some cases, the ambient pressure may be at about 1 atmosphere or about 101.3 kPa. The surrounding environment depends on the nature of the chamber. For example, a room or chamber may be part of a mobile, semi-permanent or permanent structure where the chamber is directly vented to receive air flow from and provide air flow to the outside environment (e.g., atmosphere). Alternatively, the room or chamber may be part of a mobile/portable, semi-permanent or permanent structure where the chamber is vented to receive air flow from and provide air flow to another structure, such as another room, a hallway or the HVAC system of a larger structural environment.

Furthermore, in another aspect, in accordance with the teachings herein, there is provided at least one embodiment of an air flow control system for use with portable, semi-permanent or permanent structures that controls the air pressure of an individual chamber of a multi-chamber mobile unit/structure, either automatically or under user control, to provide various positive pressures thereby to maintain a positive pressure within such chambers while also enabling control over whether the positive pressure is increased or decreased or to control the air pressure in such chambers to provide various negative pressures to maintain a negative pressure within a chamber while also enabling control over whether the negative pressure is increased or decreased.

It should also be understood herein that the words portable and mobile may be used synonymously and interchangeable in that they both represent a structure or unit that may be moved from one location to another location or may be a temporary structure that can be assembled at a first location, and then be disassembled and the parts moved to a second location where it is reassembled.

In another aspect, in accordance with the teachings herein, portable, semi-permanent or permanent structures may be provided with an example embodiment of a flexible airflow control system that enables a given unit, or an individual chamber in a multi-chamber mobile unit, to operate selectively and independently, from other rooms or chambers, such that it can be independently transitionable to any one of a negative pressure chamber, a positive pressure chamber, and a neutral pressure chamber. For example, with such a control system, the airflow in a given mobile unit, or an individual chamber of a multi-chamber unit, is controllable and changeable between any two of positive, negative and neutral pressure environments. The present application describes example embodiments of systems and methods for conditioning the air and also controlling the pressure in the chamber for some use or patient requiring pressure conditions that are different than that which existed during a previous use of the same chamber.

Figure 2:
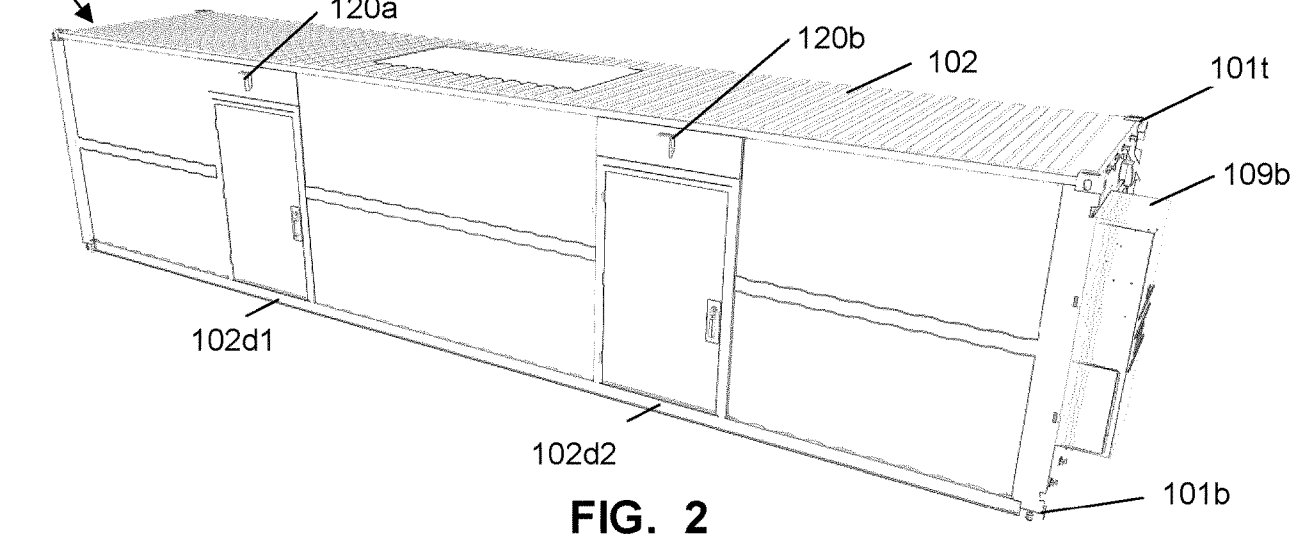
FIG. 2 is a rear perspective view of the mobile/portable medical unit of FIG. 1.
Figure 3:
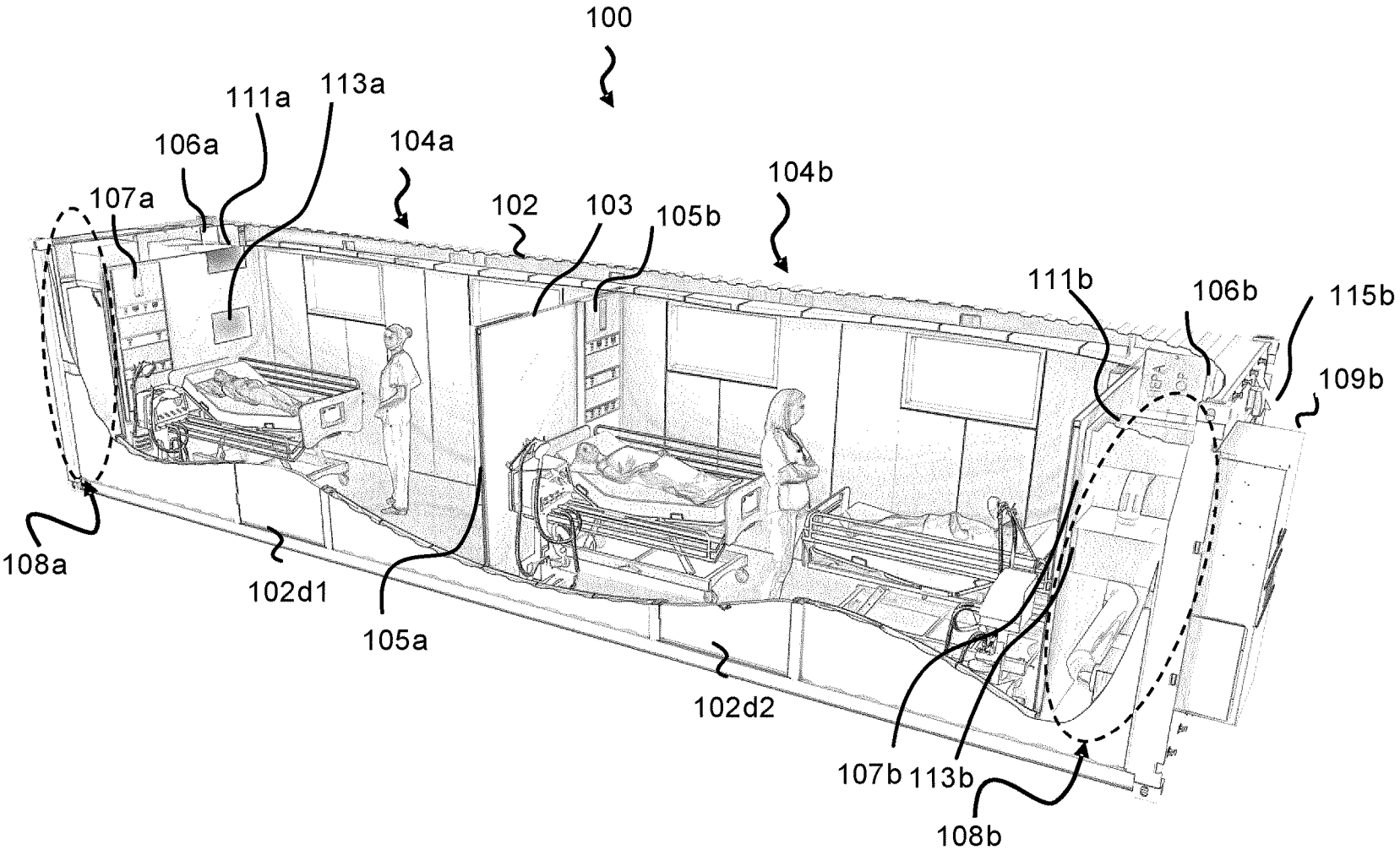
FIG. 3 is a rear perspective view of the mobile/portable medical unit of FIG. 1, showing one example embodiment, with parts of the roof/ceiling and rear wall shown cut away to reveal the interior divided into two halves, each for containing an ICU or OR chamber and a maintenance room that are independent of one another.

Referring now to FIGS. 1 to 3, FIG. 1 is a front perspective view of a mobile medical unit 100, according to an example embodiment, FIG. 2 is a rear perspective view of the mobile medical unit 100 of FIG. 1 and FIG. 3 is a perspective view of the unit 100 in one example use with a portion of the wall and ceiling of the unit 100 cutout. In this example embodiment, the unit 100 is based on a high cube shipping/intermodal container 102 having a length of about 40 feet, a width of about 8 feet, and a height of about 9 feet (other dimensions may be used in other embodiments). The unit 100 has doors 102*d*1, 102*d*2 to access chambers enclosed therein. The doors 102*d*1, 102*d*2 may be implemented such that they are self-closing and provide a pressure seal. The unit 100 also has maintenance doors 102*md*1 and 102*md*2 (only one of which is shown) at opposite ends of the container 102 for accessing maintenance rooms. The unit 100 also includes top connectors 101*t* and bottom connectors 101*b* which may be on each upper and lower corner. Only two of the connectors 101*t* and 101*b* have been labelled for each of illustration. The connectors 101*t* and 101*b* may also be referred to as corner castings in certain embodiments. As previously described, while the teachings herein are described with reference to the mobile medical unit 100, the teachings are also applicable to other types of portable, semi-permanent or permanent structures.

Furthermore, in another aspect of the teachings herein, at least one embodiment of an air control system is provided herein in which the air pressure of an individual chamber of a multi-chamber unit/structure is independently controlled so that it can be changed between negative, positive and neutral pressure while the air pressure of another individual chamber of the multi-chamber unit/structure is being controlled to be held steady at, or changed between, positive, negative, or neutral pressure.

Furthermore, in another aspect, in accordance with the teachings herein, there is provided at least one embodiment of an air flow control system for use with portable, semi-permanent or permanent structures that controls the air pressure of an individual chamber of a multi-chamber mobile unit/structure is controllable, either automatically or under user control, to provide various positive pressures thereby to maintain a positive pressure within such chambers while also enabling control over whether the positive pressure is increased or decreased or to control the air pressure in such chambers to provide various negative pressures to maintain a negative pressure within a chamber while also enabling control over whether the negative pressure is increased or decreased.

The HVAC equipment is housed in a respective box 109*a*, 109*b* that is positioned beside the maintenance room doors 102*md*1, 102*md*2 at the exterior of the unit 100, so that it may be maintained or repaired without personnel necessarily having to enter into the maintenance rooms 106*a*, 106*b*. In this example embodiment, the HVAC equipment provides a high latent capacity humidity and sound reduction for removing high amounts of humidity, a 24,000 BTUH rated cooling capacity, and a 34,130 BTUH rated heating capacity. The HVAC equipment may include a BARD 11EER Single Stage Dehumidification W24HBD_W36HBD HVAC unit. Furthermore, to reduce costs in maintenance, a hydrophilic evaporator coil may be incorporated. Such a coil is useful for reducing or preventing mold growth, aiding with drainage, and for protecting components against corrosive particulates that may be in the incoming airstream. However, in other embodiments other types of HVAC equipment may be used.

In another aspect, the teachings herein can be applied to the assembly of various individual units, which may be mobile medical units, anteroom modules, hallway modules, connection modules, pharmacy modules and/or nurse station modules, for example, so that these units can be combined into various configurations of compound structures useful for forming particular custom and scalable configurations such as, but not limited to, multiple-bed hospital and ICU and OR medical units.

Referring now to FIGS. 1 to 3, FIG. 1 is a front perspective view of a mobile medical unit 100, according to an example embodiment, FIG. 2 is a rear perspective view of the mobile medical unit 100 of FIG. 1 and FIG. 3 is a perspective view of the unit 100 in one example use with a portion of the wall and ceiling of the unit 100 cutout. In this example embodiment, the unit 100 is based on a high cube shipping/intermodal container 102 having a length of about 40 feet, a width of about 8 feet, and a height of about 9 feet (other dimensions may be used in other embodiments). The unit 100 has doors 102*d*1, 102*d*2 to access chambers enclosed therein. The doors 102*d*1, 102*d*2 may be implemented such that they are self-closing and provide a pressure seal. The unit 100 also has maintenance doors 102*md*1 (only one of which is shown) at opposite ends of the container 102 for accessing maintenance rooms. The unit 100 also includes top connectors 101*t* and bottom connectors 101*b* which may be on each upper and lower corner. Only two of the connectors 101*t* and 101*b* have been labelled for each of illustration. The connectors 101*t* and 101*b* may also be referred to as corner castings in certain embodiments. As previously described, while the teachings herein are described with reference to the mobile medical unit 100, the teachings are also applicable to other types of portable, semi-permanent or permanent structures.

The shipping container 102 has been fitted with a fluid-tight wall splitting the container 102 into two halves. Each half of the unit 100 has respective patient chambers 104*a*, 104*b*, and respective maintenance rooms 106*a*, 106*b*. In this example embodiment, each patient chamber 104*a*, 104*b* is provided with two windows for, in turn, providing the patients in each chamber with a sense of the environment outside of the respective patient chambers 104*a*, 104*b*. Alternatives in window configuration (more or fewer windows, or differently sized windows) are possible. In at least one embodiment, the windows may be openable only by the use of a tool/keys. In at least one alternative embodiment, the windows may be permanently sealed. Maintenance rooms 106*a*, 106*b* house equipment comprising airflow systems 108*a*, 108*b*, respectively, which include, but are not limited to conduits and filtration. Each maintenance room 106*a*, 106*b* also houses electrical, gas and other operational and medical components for handling conditions and capabilities within the respective patient chamber 104*a*, 104*b*, as will be described. Each maintenance room 106*a*, 106*b* is also physically and fluidically coupled with HVAC equipment.

In this example embodiment, each maintenance room 106*a*, 106*b* is only accessible via a respective door 102*md*1, 102*md*2 from outside of the unit 100, and not via the respective patient chamber 104*a*, 104*b* itself. The HVAC equipment associated with each maintenance room 106*a*, 106*b* includes, in this example embodiment, components for heating, ventilation, air conditioning and humidity control. In other embodiments, other components may be included in the maintenance rooms.

The HVAC equipment is housed in a respective box 109*a*, 109*b* that is positioned beside the maintenance room door 102*md*2 at the exterior of the unit 100, so that it may be maintained or repaired without personnel necessarily having to enter into the maintenance rooms 106*a*, 106*b*. In this example embodiment, the HVAC equipment provides a high latent capacity humidity and sound reduction for removing high amounts of humidity, a 24,000 BTUH rated cooling capacity, and a 34,130 BTUH rated heating capacity. The HVAC equipment may include a BARD 11EER Single Stage Dehumidification W24HBD_W36HBD HVAC unit. Furthermore, to reduce costs in maintenance, a hydrophilic evaporator coil may be incorporated. Such a coil is useful for reducing or preventing mold growth, aiding with drainage, and for protecting components against corrosive particulates that may be in the incoming airstream. However, in other embodiments other types of HVAC equipment may be used.

Figure 4A:
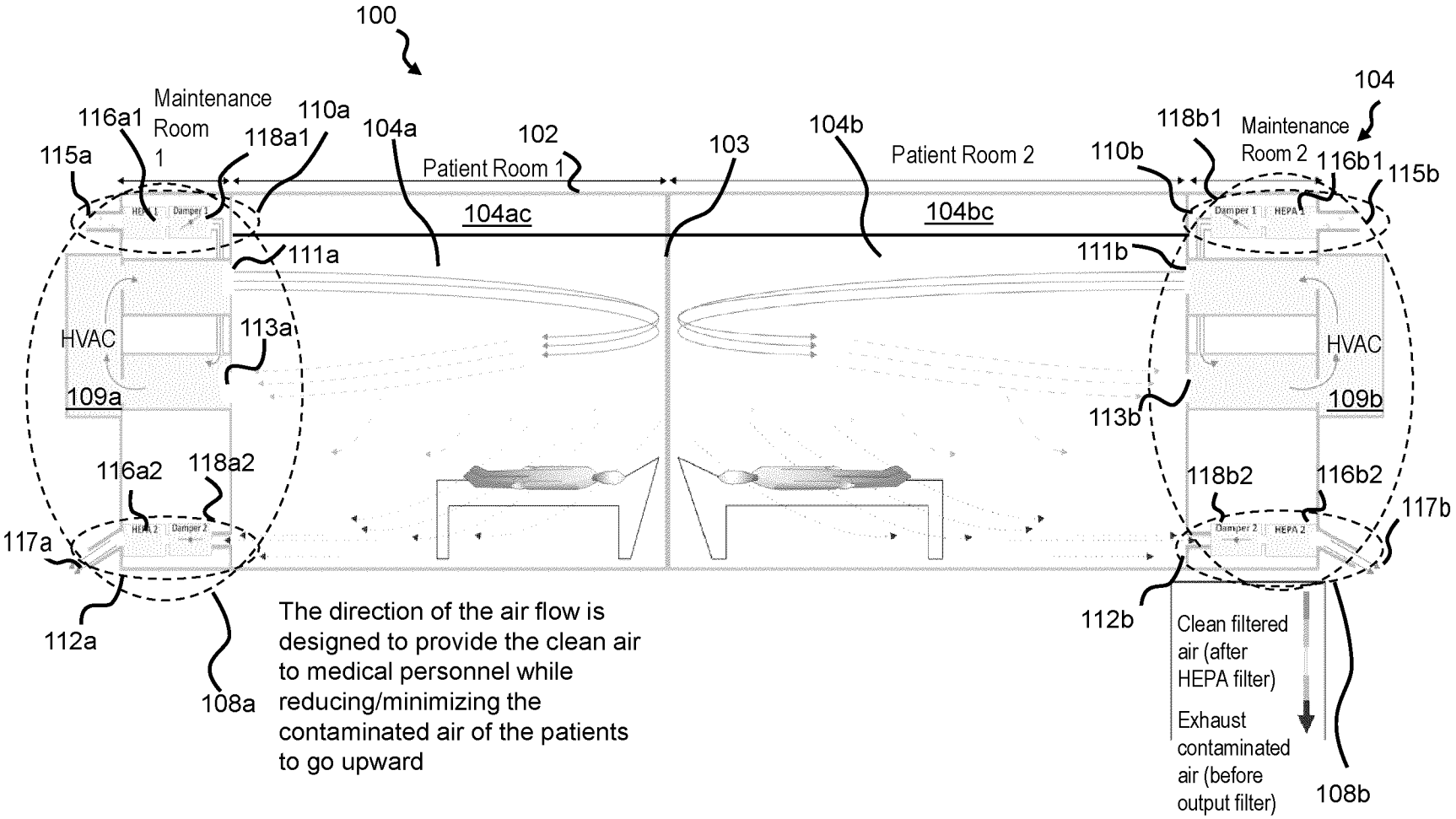
FIG. 4A is a sectional diagram of the mobile/portable medical unit of FIG. 1, showing the ingress, flow, and egress of air for each of the two independent ICU and OR chambers.

Referring now to FIG. 4A, airflow systems 108*a*, 108*b* comprise air inlet subsystems 110*a*, 110*b*. Air inlet subsystems 110*a*, 110*b* are positioned above the maintenance room door (not shown) for enabling an airflow systems 108*a*, 108*b* to convey ambient air from the exterior of the unit 100 into the respective interior chambers 104*a*, 104*b*. The outlet of the air inlet subsystems may be located so that they supply air at a height that may be close to the ceiling (and above the bed in the room for this example).

In alternative embodiments, it should be noted that the doors 102*d*1, 102*d*2 may instead lead to an ante-chamber or a hallway when the mobile medical unit 100 is part of a larger portable, semi-permanent or permanent structure, examples of which are later discussed.

In at least one embodiment, the outlets of the air outlet subsystems 112*a*, 112*b* may be positioned so that they are a certain distance from ventilation intakes or occupied areas such as at least about 10 ft, for example.

In general, it is preferable, if possible, to have the airflow of clean air move towards the patient and then move from the patient to the exhaust in as short a route as possible. Thus, in at least one embodiment, the air outlet subsystems 112*a*, 112*b* may be located near the floor close to the bed, with the inlet of the air outlet subsystems 112*a*, 112*b* being located possibly about 6 inches to 1 foot above the floor.

In at least one embodiment, the exhaust ducts (e.g., air outlets) of the air outlet subsystems 112*a*, 112*b* may be oversized to allow for loss of efficiency, e.g., expected airflow plus 50%.

In this example embodiment, each patient chamber 104*a*, 104*b* is only accessible via a respective door 102*d*1, 102*d*2 from outside of the unit 100. In this embodiment, these doors 102*d*1, 102*d*2 do not include windows. As such, the patients may be monitored using one or more closed circuit cameras that are positioned throughout each patient chamber 104*a*, 104*b* and in communication with video monitors that are located outside of the patient chambers 104*a*, 104*b*. However, in alternative embodiments windows may also be included in these doors 102*d*1, 102*d*2 to enable those just outside the doors 102*d*1, 102*d*2 to observe a patient within the patient chamber 104 without necessarily having to consult video monitors.

The control interface 128 may be any hardware element that allows the processor unit 124 to communicate with elements within the air pressure control system 114, the air inlet subsystem 112 or the air outlet subsystem 114. For example, the interface unit 128 may include at least one of a serial bus or a parallel bus, and a corresponding port such as a parallel port, a serial port, and/or a USB port. The control interface 128 may also include one or more Analog to Digital converters (ADCs) or a multichannel ADC when digital signals from the processor unit 124 are provided to analog components within the air inlet subsystem 112 or the air outlet subsystem 114. The control interface 128 may also include one or more Digital to Analog converters (DACs) or a multi-channel DAC when analog signals from the air inlet subsystem 112 or the air outlet subsystem 114 are sent to the processor unit 124.

In various embodiments, there may be a ½ inch gap under the doors 102*d*1, 102*d*2.

In embodiments where the input interface 122 allows the processor unit 124 to communicate with remote computing devices, a network port may be used so that the processor unit 124 can communicate via the Internet, a Local Area Network (LAN), a Wide Area Network (WAN), a Metropolitan Area Network (MAN), a Wireless Local Area Network (WLAN), a Virtual Private Network (VPN), or a peer-to-peer network, either directly or through a modem, router, switch, hub or other routing or translation device.

Figure 6:
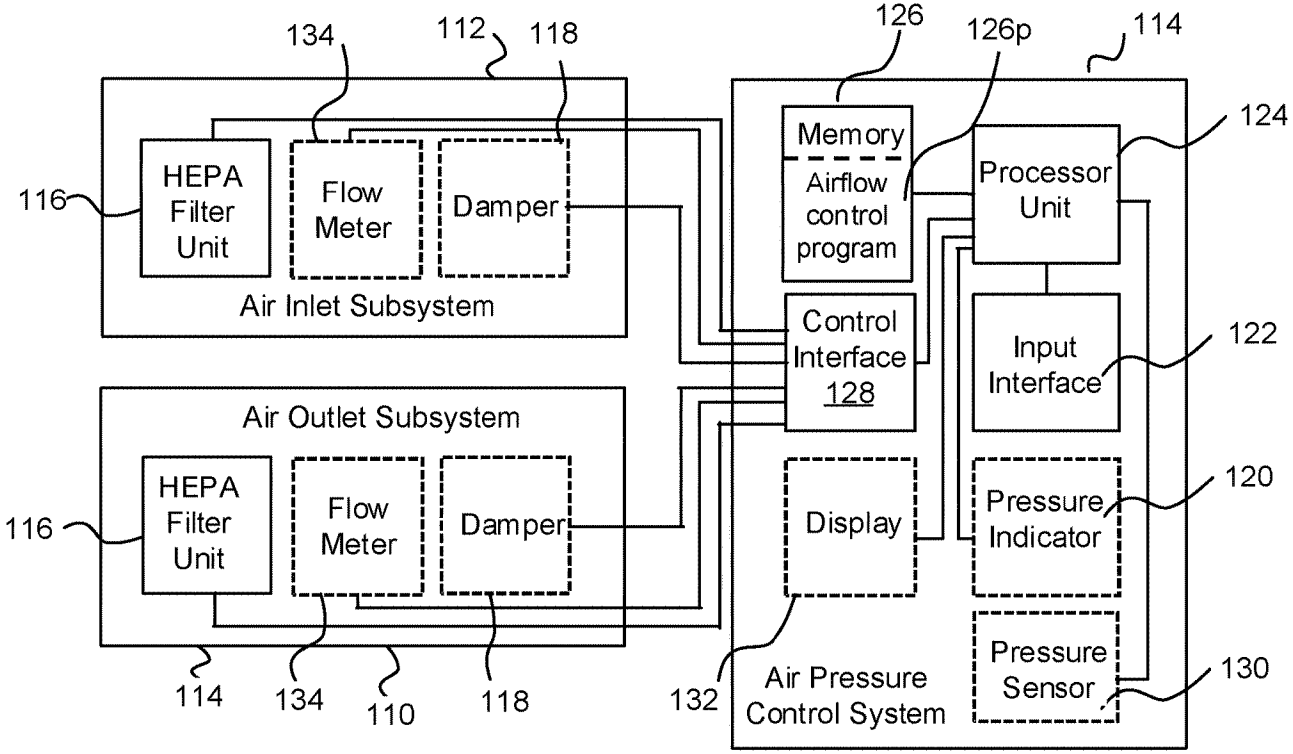
FIG. 6 is a block diagram showing an example embodiment of the air inlet subsystem, air outlet subsystem, and air pressure control system of the airflow system of FIG. 5.

Referring to FIG. 6, air pressure control system 114 comprises processor unit 124, memory 126 with airflow control program 126*p*, input interface 122, and control interface 128. Air pressure control system 114 may also comprise display 132 (which is optional), a pressure indicator 120 (which is optional), and a pressure sensor 130 in at least one example embodiment. Input interface 122 may comprise a switch, knob, slider, lever, touchscreen or other control mechanism, or may also be a radio that is communicatively coupled to a smartphone, desktop or laptop that is running an application, such as a mobile application or a web application, that is used to communicate with the processor unit 124 for controlling the airflow system 108.

The memory 126 stores program instructions for an operating system and an airflow control program 126*p*. When the program instructions for the airflow control program 126*p* are executed by a processor of the processor unit 124, the processor is configured for performing certain functions in accordance with the teachings herein. For example, the airflow control program 126*p* may include software instructions for generating a graphical user interface (GUI) on the display 132 and receiving input from a user who interacts with the GUI to set an air pressure configuration for room 104*a*, 104*b*. Alternatively, the airflow control program 126*p* may include software instructions for allowing the processor unit 124 to communicate with remote devices that a user may use to set an air pressure configuration for rooms 104*a*, 104*b*. The airflow control program 126*p* also includes software instructions for causing the processor unit 124 to send control signals to the dampers 118 to control the valve position thereof, as described in further detail below. This may be referred to as electronic damper control. Alternatively, in embodiments in which the HEPA filter unit 116 has a variable drive system, the dampers 118 are not included and the airflow control program 126*p* includes software instructions for causing the processor unit 124 to send control signals to the HEPA filter unit 116 to control the speed of the variable drive system, as described in further detail below. Therefore, in either of these embodiments, the air pressure control system 114 may be considered to function as a master controller that is configured to change the air pressure using multiple HEPA systems to cause differential pressure between the inlet air and exhaust air of the inlet air and outlet air subsystems respectively. This can be done in some embodiments mechanically by using dampers within the ducting or in other embodiments electrically by changing the speed (e.g., RPM of the motor) of each HEPA system that has a variable drive system. In addition, the air pressure control system 114 may also be used to concurrently condition the air by, for example, controlling the HVAC to cool or warm the air that is provided to the room 104*a*, 104*b*.

As can be seen in FIG. 2, a pressure indicator 120—in this embodiment a colour-switchable lamp 120*a*, 120*b*—is affixed above each of the patient chamber doors 102*d*1, 102*d*2. The pressure indicator 120 is incorporated into the air control system 114 to provide an indication to observers who are outside of a patient chamber 104*a*, 104*b* what the current pressure configuration is (i.e., whether the patient chamber 104*a*, 104*b* is currently maintaining a positive air pressure, a negative air pressure, or a neutral air pressure). For example, the colour-switchable lamp 120*a*, 120*b* may be controlled to light a bulb contained therein having a first colour while the corresponding patient chamber 104*a*, 104*b* is maintaining a positive air pressure, to light a bulb contained therein having a second, different, colour while the patient chamber 104*a*, 104*b* is maintaining a negative air pressure, and to light a bulb contained therein having a third, different, colour while the patient chamber 104*a*, 104*b* is maintaining a neutral air pressure. This may be based on convention, or a nurse or other observer would have been instructed as to the meaning of the different indications. In addition, in the event that the air pressure control system 114 is transitioning the patient chamber 104*a*, 104*b* from one pressure configuration to another, the lamp 120*a*, 120*b* may be controlled to flash to inform the observer of its intermediate transition condition. Various options are possible, including using separate lamps to indicate different conditions, separate lamps combined with text indications, or a sign or sign with illuminable text, an LCD panel, or some other useful indicator or combination of indicators that is integrated into the air control system itself. Alternatives are possible wherein the lamp 120*a*, 120*b* is associated with an independent system for monitoring the ongoing conditions of the patient chamber 104*a*, 104*b* which can then be used as input to the air pressure control system 114 so that it can determine whether to modify any control signals to the HEPA systems for maintaining a desired air pressure configuration or transitioning to a new air pressure configuration in any of the corresponding rooms. In at least one embodiment, a tri-color LED may be used rather than separate lamps. An example color code that may be used is the color yellow for identifying negative pressure, the color red used for identifying positive pressure and the color green for the off position. Another example color code that may be used involves using the color yellow for identifying negative pressure, using the color red for identifying positive pressure and using no light/color for identifying neutral pressure.

In at least one embodiment, one or more elements of the control interface 128 may be located so that they are not within reach of the patient, visitors, or any other members of the public, as the case may be, so that un-authorized people are not allowed to vary the operation of the air pressure control system 114. For example, one or more elements of the control interface may be key operated, and the keys may usually be locked, in a secure environment, such as a cupboard or a desk drawer, or the control means for controlling the operation of the air pressure control system 114 may be only accessible remotely by authorized personnel.

In embodiments where the input interface 120 allows the processor unit 124 to communicate with remote computing devices, a network port may be used so that the processor unit 144 can communicate via the Internet, a Local Area Network (LAN), a Wide Area Network (WAN), a Metropolitan Area Network (MAN), a Wireless Local Area Network (WLAN), a Virtual Private Network (VPN), or a peer-to-peer network, either directly or through a modem, router, switch, hub or other routing or translation device.

In some cases, the input interface may alternatively or additionally include various communication hardware for allowing the processor unit 124 to communicate with remote devices. For example, the communication hardware may include, a Bluetooth radio or other short range communication device, or a wireless transceiver for wireless communication, for example, according to CDMA, GSM, or GPRS protocol using standards such as IEEE 802.11a, 802.11b, 802.11g, or 802.11n.

In general, the chambers 104*a*, 104*b* are "well-sealed", which includes applying sealing to the ceiling panels and the regions where the ceiling panels meet the wall panels. For example, acoustic ceiling tiles may be replaced with non-porous vinyl ceiling tiles and gaskets can be applied at the tile connections in the ceiling grid. A sealant, such as a medical grade sealant that is able to withstand changes in room pressure, may be applied in between each ceiling panel. In at least one embodiment, each ceiling tile may be fastened to one another (e.g., riveted to one another) for extra strength to withstand changes in room pressure during use. Gaskets may be also provided around items which are used to enter into the room as well as for other objects that are installed in the walls such as, e.g., electric sockets, gas supplies, phone lines, etc. In addition, recessed light fixtures may be replaced with surface-mounted fixtures.

As can be seen in FIG. 2, a pressure indicator 120—in this embodiment a colour-switchable lamp 120*a*, 120*b*— is affixed above each of the patient chamber doors 102*d*1, 102*d*2. The pressure indicator 120 is incorporated into the air control system 114 to provide an indication to observers who are outside of a patient chamber 104*a*, 104*b* what the current pressure configuration is (i.e., whether the patient chamber 104*a*, 104*b* is currently maintaining a positive air pressure, a negative air pressure, or a neutral air pressure). For example, the colour-switchable lamp 120*a*, 120*b* may be controlled to light a bulb container therein having a first colour while the corresponding patient chamber 104*a*, 104*b* is maintaining a positive air pressure, to light a bulb contained therein having a second, different, colour while the patient chamber 104 is maintaining a negative air pressure, and to light a bulb container therein having a third, different, colour while the patient chamber 104*a*, 1204*b* is maintaining a neutral air pressure. This may be based on convention, or a nurse or other observer would have been instructed as to the meaning of the different indications. In addition, in the event that the air pressure control system 114 is transitioning the patient chamber 104*a*, 104*b* from one pressure configuration to another, the lamp 120*a*, 120*b* may be controlled to flash to inform the observer of its intermediate transition condition. Various options are possible, including using separate lamps to indicate different conditions, separate lamps combined with text indications, or a sign or sign with illuminable text, an LCD panel, or some other useful indicator or combination of indicators that is integrated into the air control system itself. Alternatives are possible wherein the lamp 120*a*, 120*b* is associated with an independent system for monitoring the ongoing conditions of the patient chamber 104*a*, 104*b* which can then be used as input to the air pressure control system 114 so that it can determine whether to modify any control signals to the HEPA systems for maintaining a desired air pressure configuration or transitioning to a new air pressure configuration in any of the corresponding rooms. In at least one embodiment, a tri-color LED may be used rather than separate lamps. An example color code that may be used is the color yellow for identifying negative pressure, the color red used for identifying positive pressure and the color green for the off position. Another example color code that may be used involves using the color yellow for identifying negative pressure, using the color red for identifying positive pressure and using no light/color for identifying neutral pressure.

For example, in at least one embodiment, the cavities 104*ac*, 104*bc* may include further ducting from outlets of the HVAC systems 109*a*, 109*b* (where the outlets are at different locations compared to what is shown in FIG. 4A) so that the airflow into the patient rooms 104*a*, 104*b* may be provided from ceiling outlets that are located in the ceilings and directed downwards so that the air flow into the rooms 104*a*, 104*b* starts along a downward vertical trajectory. Alternatively, the ceiling outlets may be below the lower surface of the ceiling and have a horizontal orientation so that the airflow starts off having a horizontal orientation.

In this example embodiment, headwall units 105*a*, 105*b* extend from both sides of the middle wall 103. The middle wall 103 may be structurally designed, such that it is foam sealed and fastened to each side wall of the container 102 using angle formed strips around the entire perimeter, on both side walls and at the ceiling and floor of the container 102, thereby to provide strength for a headwall unit 105*a*, 105*b* at this position for each of the patient chambers 104*a*, 104*b* as shown in FIG. 3. Furthermore, headwall units 107*a*, 107*b* extend from opposite headwalls of both patient chambers 104*a*, 104*b*, thereby to provide another headwall unit at this position for each of the patient chambers 104*a*, 104*b*. In this example embodiment, each headwall unit 105*a*, 105*b*, 107*a*, 107*b* is a rectangular box fixedly attached to its respective wall. Each headwall unit 105*a*, 105*b*, 107*a*, 107*b* may have a depth of about four (4) inches, runs from the ceiling to the floor, and have connection points, rails and/or other accommodations for connecting monitors and other components. However, other configurations are possible in alternative embodiments.

FIG. 3 is a rear perspective view of the mobile medical unit 100 of FIG. 1, with parts of the roof/ceiling and rear wall shown cut away to reveal its interior divided into two halves 104*a*, 104*b* by a middle wall 103, each for containing a respective patient chamber 104*a*, 104*b* and a maintenance room 106*a*, 106*b*. The middle wall 103 fluidly seals patient chamber 104*a* from patient chamber 104*b*, such that no air may flow between patient chambers 104*a*, 104*b*. This therefore allows for the chambers 104*a*, 104*b* to each have a different or similar pressure configuration relative to one another. For example, the middle wall 103 may be sealed with foam or sealant materials and/or may be optionally permanently welded in place. In this example embodiment, each patient chamber 104*a*, 104*b* is sized to accommodate up to two beds, and thus two patients, with the head of one bed facing the middle wall 103 and the head of the other bed facing an end wall that divides the patient chamber 104*a*, 104*b* and the maintenance room 106*a*, 106*b*.

Though not shown in FIG. 3, each patient chamber 104*a*, 104*b* may also include a surgical lamp (e.g., see FIG. 4B) respectively mounted via an articulated arm to the middle wall 103. The region at which the surgical lamp is mounted to the middle wall 103 is provided with reinforcement to enable the middle wall 103 to support the weight of the surgical lamp as it is extended away from the wall 103 during use. In an example embodiment, the surgical lamp may be a Polaris 50 surgical light provided by Dräger AG & Co. KgaA of Lübeck, Germany, and the surgical light may provide a light intensity of up to 60,000 lux. Alternative formats or suppliers of surgical lighting that comply with the required quality and safety standards may be used in other embodiments. In addition, in other example embodiments, other lights may be installed in the unit 100, including but not limited, to examination lamps and/or traditional ambient lighting.

In at least one embodiment, there may also be ceiling cavities 104*ac*, 104*bc* (see FIG. 4A) that are in each patient room 104*a*, 104*b* that are sealed so that they can be pressurized at a desired pressure. For example, the ceiling cavities 104*ac*, 104*bc* may be pressurized so that they are at the same ambient pressure as the outside environment to the rooms 104*a*, 104*b*. The ceiling cavities 104*ac*, 104*bc*, may also be pressurized to provide a barrier for sound attenuation for noises from the outside environment. The ceiling cavities 104*ac*, 104*bc* may also be used to house certain equipment such as, but not limited to, piping for medical gases, one or more electrical conduits and possible further air ducting if required.

For example, in at least one embodiment, the cavities 104*ac*, 104*bc* may include further ducting from outlets of the HVAC systems 109*a*, 109*b* (that is at a different location compared to what is shown in FIG. 4A) so that the airflow into the patient rooms 104*a*, 104*b* may be provided from ceiling outlets that are located in the ceilings and directed downwards so that the air flow into the rooms 104*a*, 104*b* starts along a downward vertical trajectory. Alternatively, the ceiling outlets may be below the lower surface of the ceiling and have a horizontal orientation so that the airflow starts off having a horizontal orientation.

In this example embodiment, headwall units 105*a*, 105*b* extend from both sides of the middle wall 103. The middle wall 103 may be structurally designed, such that it is foam sealed and fastened to each side wall of the container 102 using angle formed strips around the entire perimeter, on both side walls and at the ceiling and floor of the container 102, thereby to provide strength for a headwall unit 105*a*, 105*b* at this position for each of the patient chambers 104*a*,

104*b* as shown in FIG. 3. Furthermore, headwall units 107*a*, 107*b* extend from opposite headwalls of both patient chambers 104*a*, 104*b*, thereby to provide another headwall unit at this position for each of the patient chambers 104*a*, 104*b*. In this example embodiment, each headwall unit 105*a*, 105*b*, 107*a*, 107*b* is a rectangular box fixedly attached to its respective wall. Each headwall unit 105*a*, 105*b*, 107*a*, 107*b* may have a depth of about four (4) inches, runs from the ceiling to the floor, and having connection points, rails and/or other accommodations for connecting monitors and other components. However, other configurations are possible in alternative embodiments.

Figure 5:
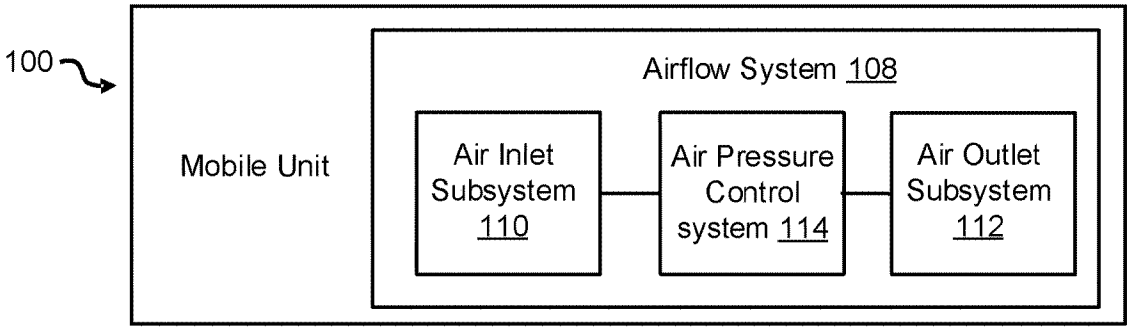
FIG. 5 is a block diagram showing an example embodiment of the airflow system of the mobile medical unit of FIGS. 1 to 4B.

Referring now to FIGS. 4A and 5, opposite from the headwall units along each end wall are both inlet air vents 111*a*, 111*b* and return air vents 113*a*, 113*b* for the HVAC units 109*a*, 109*b*, respectively. In this example embodiment, the inlet vents 111*a*, 111*b* for the rooms 104*a*, 104*b* are the upper vents that are situated at the upper portion of the unit 100 for conveying air towards the interior of the room 104*a*, 104*b*, and the return vents 113*a*, 113*b* for the rooms 104*a*, 104*b* are the lower vents receiving air from the interior of the room 104*a*, 104*b* where this air is to be re-conditioned. An outlet vent (not shown) conveys air from the interior of the room 104*a*, 104*b*, via filtration as will be described, towards the outlet vent positioned beneath the HVAC box 109*a*, 109*b* on the exterior of the mobile medical unit 100 to the outside environment.

FIG. 4A is a sectional diagram of the mobile medical unit 100, showing the ingress, flow, and egress of air for each of the two independent patient chambers 104*a*, 104*b*. With respect to the patient chamber 104*a*, 104*b* in FIG. 4A, ambient air is drawn inward from the exterior via an inlet 115*a*, 115*b* of the air inlet subsystem 110*a*, 110*b* by a combined filter-motor unit 116*a*1, 116*b*1 at a predefined inlet rate. In this example embodiment, the combined filter-motor unit 116*a*1, 116*b*1 for this fresh air intake is a HEPA (High Efficiency Particulate Air) filter unit 116*a*1, 116*b*1, which may be rated at about 245 Cubic Feet per Minute (CFM). It will be appreciated that the HEPA filter unit 116*a*1, 116*b*1 is at least 99.97% efficient at removing particles that are 0.3 microns in size or larger. Furthermore, as the HEPA filter unit 116*a*1, 116*b*1 becomes dirtier, it becomes more capable of capturing particles as small as 0.001 microns. The physical size of the HEPA filter unit 116*a*1, 116*b*1 is selected to fit within the space provided and also be approximately directly proportional to the volume of airflow that is used for the chambers 104*a*, 104*b*.

Because the HEPA filter unit 116*a*1, 116*b*1 delivers a steady volume of air through the ducting system, reductions in air flow exiting the HEPA filter unit 116*a*1, 116*b*1 below a predefined threshold can signify the HEPA filter unit 116*a*1, 116*b*1 needs service, such as a filter change or more involved service such as electrical or mechanical work. Since airflow and filtration of airflow affect the quality of air and the pressure within the chambers 104*a*, 104*b*, in this example embodiment, an air-flow meter 134 (see FIG. 5) is installed in each duct just downstream of the respective HEPA filter unit 116*a*1, 116*b*1 to measure and detect the inlet rate and any pressure decreases below a predefined threshold. In this example embodiment, since the HEPA filter units 116*a*1, 116*b*1 each deliver an inflow rate of about 245 CFM, and the air-flow meter 134 is used to trigger an alarm signal when the air-flow meter 134 detects the pressure has dropped a certain threshold amount below about 240 CFM to 245 CFM. The alarm signal may be an audible alarm, a visual alarm, both, or the alarm may be raised in the form of a message to a wireless device or the display of a signal on a control panel. In at least one embodiment, the alarm signal may be an electronic signal that is conveyed to the processor unit 124 which then sends a control signal to the appropriate mechanical elements so that the pressure is changed to be closer to the desired pressure setting.

The floor of each patient chamber 104*a*, 104*b*, in this example embodiment, may be clad with medical-grade polyurethane flooring such as the medical-grade Polyclad Pro PU available from Polyflor Limited in the United Kingdom. Alternative formats or suppliers of flooring that comply with required quality and safety standards may be employed. In this at least one example embodiment, the flooring may feature a raised perimeter running six (6) inches up the walls, providing a floor-to-wall barrier to dirt, fluids and other contaminants. The flooring may be, in at least one embodiment, suitable for use in ISO1466-11999 Class 4 clean rooms, and may be classified as a Class A product, including non-shedding to ASTM F51, complying with CAN/ULC-S102.2. Alternative formats for the flooring and/or suppliers of flooring that comply with quality and safety standards that apply to the structure that the chambers 104*a*, 104*b* are used with may be employed in alternative embodiments. In at least one embodiment, the mobile unit 100 may have a floor made of structural steel.

This filter-motor units 116*a*1, 116*b*1 are controlled by the air control system 114 to run at a steady rate. However, fresh air drawn in by the filter-motor units 116*a*1, 116*b*1 reaches a first damper unit 118*a*1, 118*b*1 (damper 1) which itself is controlled to provide greater or lesser damping thereby to enable incoming air to continue downstream from the damper unit 118*a*1, 118*b*1 with some amount of air volume damping or without. Air exits the damper unit 118*a*1, 118*b*1 at a location adjacent to the return vent 113*a*, 113*b*, but inside the maintenance room 108*a*, 108*b* of the patient chambers 104*a*, 104*b* so that it is conveyed towards the HVAC equipment 109*a*, 109*b* for conditioning by heating, cooling and/or humidity treatment.

Referring now to FIGS. 4A and 5, opposite from the headwall units 107*a*, 107*b* along each end wall are both inlet air vents 111*a*, 111*b* and return air vents 113*a*, 113*b* for the HVAC units 109*a*, 109*b*, respectively. In this example embodiment, the inlet vents 111*a*, 111*b* for the rooms 104*a*, 104*b* are the upper vents that are situated at the upper portion of the unit 100 for conveying air towards the interior of the room 104*a*, 104*b*, and the return vents 113*a*, 113*b* for the rooms 104*a*, 104*b* are the lower vents receiving air from the interior of the room 104*a*, 104*b* where this air is to be re-conditioned. An outlet vent (not shown) conveys air from the interior of the room 104*a*, 140*b*, via filtration as will be described, towards the outlet vent positioned beneath the HVAC box 109*a*, 109*b* on the exterior of the mobile medical unit 100 to the outside environment.

This design is advantageous as the portion of air that doubles back and re-enters the HVAC 109*a*, 109*b* can be mixed together with the air from the filtered air from the HEPA filter units 116*a*1, 116*b*1 which was initially from the inlets 115*a*, 115*b* which acts to condition the filtered air and the mixture can then be conditioned by the HVAC units 109*a*, 109*b* before it exits via the vents 111*a*, 111*b* towards the rooms 104*a*, 104*b*. Due to this mixing of air that is already "conditioned" or treated (e.g. either heated or cooled) with the newly filtered air, the HVAC units 109*a*, 109*b* do not have to work as hard to condition this newly filtered inlet air. Accordingly, this allows for smaller size HVAC units 109*a*, 109*b* to be used which is important given the portable nature and smaller size of the containers 102 which provide a housing for the rooms 104*a*1, 104*b* where the smaller size limits the components that are used.

Because the HEPA filter unit 116*a*1, 116*b*1 delivers a steady volume of air through the ducting system, reductions in air flow exiting the HEPA filter unit 116*a*1, 116*b*1 below a predefined threshold can signify the HEPA filter unit 116*a*1, 116*b*1 needs service, such as a filter change or more involved service such as electrical or mechanical work. Since airflow and filtration of airflow affect the quality of air and the pressure within the chambers 104*a*, 104*b*, in this example embodiment, an air-flow meter 134 (see FIG. 5) is installed in each duct just downstream of the respective HEPA filter unit 116*a*1, 116*b*1 to measure and detect the inlet rate and any pressure decreases below a predefined threshold. In this example embodiment, since the HEPA filter units 116*a*1, 116*b*1 each deliver an inflow rate of about 245 CFM, and the air-flow meter 134 is used to trigger an alarm signal when the air-flow meter 134 detects the pressure has dropped a certain threshold amount below about 240 CFM to 245 CFM. The alarm signal may be an audible alarm, a visual alarm, both, or the alarm may be raised in the form of a message to a wireless device or the display of a signal on a control panel. In at least one embodiment, the alarm signal may be an electronic signal that is conveyed to the processor unit 124 which then sends a control signal to the appropriate mechanical elements so that the pressure is changed to be closer to the desired pressure setting.

In addition, in at least one embodiment, the air-flow meter 134 may be placed in the ducts associated with the HVAC equipment 109*a*, 109*b* to raise an alarm whenever airflow in the HVAC equipment 109*a*, 109*b* drops below a threshold level. Such airflow meters 134 also serve to provide an alert to personnel if power to the mobile medical unit 100 is cut off, since a power cut will also result in the cut off of threshold amounts of airflow to and from the mobile medical unit 100.

As shown in FIG. 4A, the physical components of the airflow systems 108*a* and 108*b* are distributed in that there is not one physical unit that houses all of the various physical components used by the systems 108*a* and 108*b*. For instance, using air inlet subsystem 110*b* as an example, the HEPA filter unit 116*b*1, and the damper 118*b*1 may be located near an upper portion of the second maintenance room, the ducting for the HVAC unit 109*b* may be located below the HEPA filer unit 116*b*1 and the damper 118*b*1 and the actual HVAC unit 109*b* can be housed on the exterior of the second maintenance room but coupled to the ducting through holes in the exterior wall of the second maintenance room. In a similar fashion, the damper 118*b*2 and the HEPA filter unit 116*b*2 of the air outlet subsystem 112*b* are located at the lower portion of the second maintenance room. Accordingly, this example layout distribution of the distributed air system components allows for the second maintenance room to take up a smaller physical footprint which in turn allows the interior of the patient room 104*b* to be larger in size thereby allowing for more medial components to be placed in the room 104*b*, which might be used as an ICU or an OR in other applications and so more medical equipment is needed, and there is also more space for medical personnel to move around within the room 104*b*.

Once conditioned by the HVAC equipment 109*a*, 109*b*, the air is conveyed out of the inlet vent 111*a*, 111*b* and along the top of the patient chamber 104*a*, 104*b*. This air then mixes with air that is already in the patient chamber 104*a*, 104*b*. Upon reaching the middle wall 103, the air doubles back towards the middle of the patient chamber 104*a*, 104*b*. By conveying the air initially along the top of the patient chamber 104*a*, 104*b*, it is not directed at any medical personnel or patients. As depicted in FIG. 4A, some of this air enters the return vent 113*a*, 113*b* to be re-conveyed back towards the HVAC equipment 109*a*, 109*b* for re-conditioning.

Figure 4B:
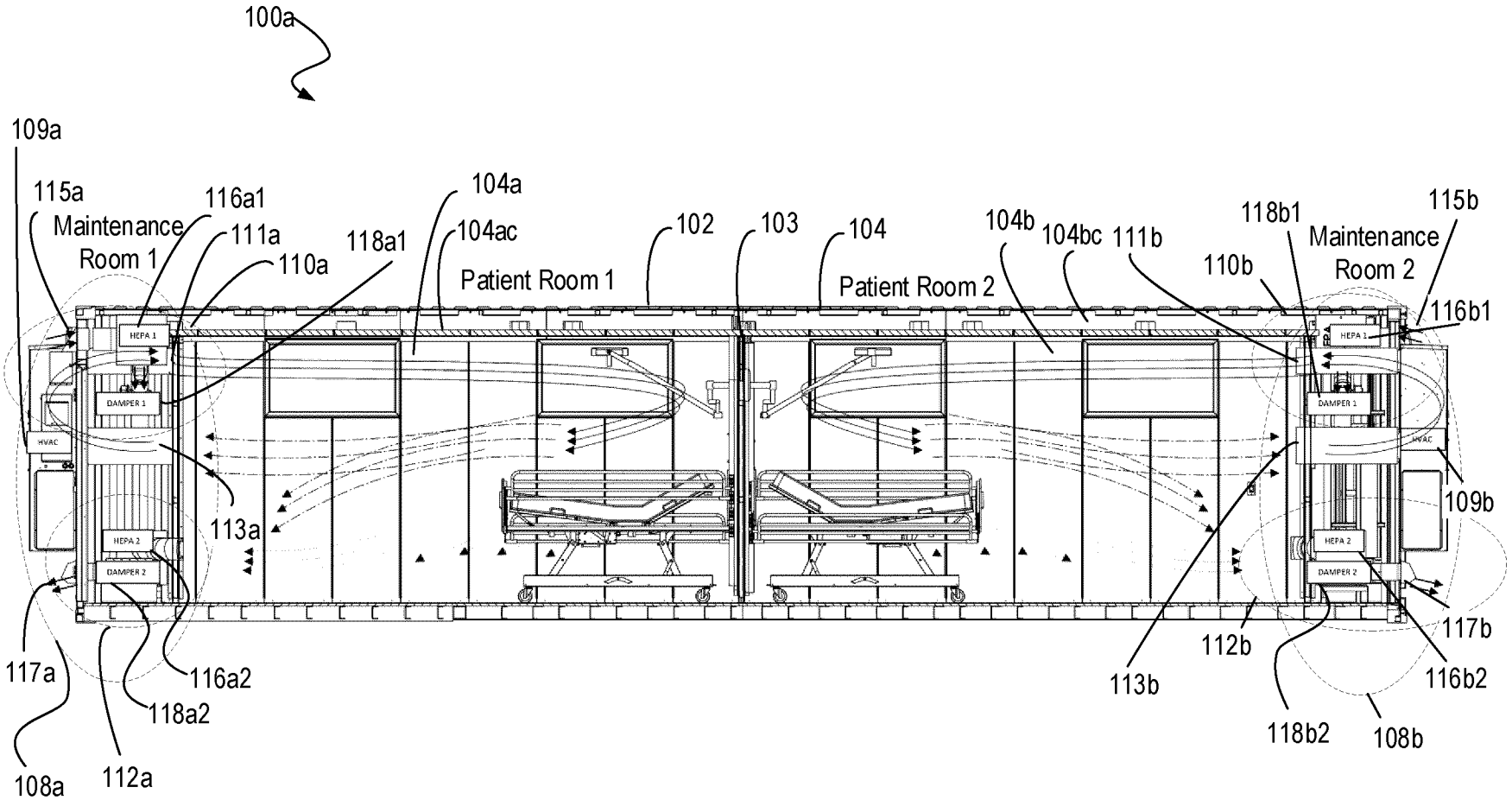
FIG. 4B is a sectional diagram of another example embodiment of a mobile/portable medical unit of FIG. 1 showing the ingress, flow, and egress of air for each of the two independent ICU and OR chambers.

Referring now to FIG. 4B, shown therein is a sectional diagram of another example embodiment of a mobile/portable medical unit 100*a* of FIG. 1 showing the ingress, flow, and egress of air for each of the two independent ICU and OR chambers. However, in this alternative embodiment, the physical components of the airflow systems 108*a* and 108*b* are distributed and located in a slightly different fashion but still in a manner that allows for the size of the maintenance rooms to be decreased and the size of the patient rooms to be increased which provides the advantages described earlier. For instance, using air inlet subsystem 110*b* as an example, the upper HEPA filter unit 116*b*1 is adjacent to the inlet 115*b* at the upper portion of second maintenance room, and the upper damper unit 118*b*1 is located below the upper HEPA filter unit 116*b*1 between the portions of the ducting that act as the return and exit ducts for the HVAC 113*b* and 111*b*, respectively. The lower HEPA filter unit 116*b*2 and damper unit 118*b*2 are still near the lower portion of the maintenance room, but they are disposed on top of one another.

However, some of the air doubling back falls towards the bottom of the patient chamber 104*a*,104*b* and is drawn out of the patient chamber 104*a*, 104*b* by air outlet subsystem 112*a*, 112*b* at a predefined outlet rate. The air outlet subsystem 112*a*, 112*b* comprises a second filter-motor unit 116*a*2, 116*b*2, and a second damper unit 118*a*2, 118*b*2 (damper 2). In this example embodiment, the second filter-motor unit 116*a*2, 116*b*2 may also be a HEPA unit rated at about 245 CFM, to filter air before it is expelled outside of the mobile medical unit 100. The HEPA filter unit 116*a*2, 116*b*2 is being controlled by the air control system 114 to run at a steady rate. However, the second damper unit 118*a*2, 118*b*2 is controlled to provide greater or lesser damping thereby to enable exiting air to continue downstream from the damper unit 118*a*2, 118*b*2 with some amount of damping or without, so as to control the outlet rate and therefore the pressure within the rooms 104*a*, 104*b*.

However, in at least one embodiment, the return air vent to the HVAC system can be closed so that no air will re-circulate back through the HVAC system. In such embodiments, the HEPA system that receives fresh air may be sized to feed sufficient airflow into the return duct, thus allowing for a 100% air exchange.

In such embodiments, the air control system 114 can provide a user with control over whether patient chamber 104*a*, 104*b* is operating as a negative pressure chamber, a positive pressure chamber, or as a neutral pressure chamber as well as transitions between any two of these pressure conditions, regardless of the ambient pressure outside of the chambers 104*a*, 104*b*, by controlling the airflow into and out of the chambers 104*a*, 104*b*.

In an alternative embodiment, the HEPA units, HVAC system or other airflow components can be placed in other locations, such as other parts of the shipping container housing, provided that the airflows shown in FIG. 4A are maintained. For example, the HEPA units may be placed outside the maintenance rooms as long as the same flow rate, operating conditions and connection points from the HEPA units to the HVAC systems or the interior of the room are maintained. For example, in embodiments where physical space is not a constraint, airflow system components can be located in a more spaced-out manner.

Referring now to FIG. 4B, shown therein is a sectional diagram of another example embodiment of a mobile/portable medical unit 100*a* of FIG. 1 showing the ingress, flow, and egress of air for each of the two independent ICU and OR chambers. However, in this alternative embodiment, the physical components of the airflow systems 108*a* and 108*b* are distributed and located in a slightly different fashion but still in a manner that allows for the size of the maintenance rooms to be decreased and the size of the patient rooms to be increased which provides the advantages described earlier. For instance, using air inlet system 110*b* as an example, the upper HEPA filter unit is adjacent to the inlet at the upper portion of second maintenance room, and the upper is located below the upper HEPA filter unit between the portions of the ducting that act as the return and exit ducts for the HVAC. The lower HEPA filter unit and damper are still near the lower portion of the maintenance room, but they are disposed on top of one another.

Referring to FIG. 5, the air control system 114 serves to control the damper units 118*a*1, 118*a*2, 118*b*1, 118*b*2 to provide more or less damping. In at least one example embodiment, the air control system 114 is a manual air control system with manual levers for controlling the valve positioning within each damper unit 118*a*1, 118*a*2, 118*b*1, 118*b*2 thereby to increase or decrease the amount of airflow damping. Position guide indicators may be affixed to the exterior of each damper unit 118*a*1, 118*a*2, 118*b*1, 118*b*2 to enable a person to successfully position the levers as desired, and thereby the pitch of the damper blades.

Alternatively, if the user/operator wishes for the patient chamber 104*b* to maintain a positive air pressure, the air control system 114 can control the electrically controllable valves of dampers 118*b*1 and 118*b*2 so that a higher CFM of air is being conveyed into the patient chamber 104*b* than out of it. In particular, damper 118*b*1 may be angled to permit an inlet rate at a third rate of about 245 CFM, while the damper 118*b*2 is angled to permit an outlet rate at a fourth rate that is less than the third airflow rate and may be set at only about 170 CFM, for example. Various levels of inlet and outlet flows may be achieved, while still maintaining the patient chamber 104*b* at a positive air pressure with respect to the ambient pressure. This may be done by controlling the airflow system 108*b* to change the relative inlet rate and outlet rate without causing the outlet rate to exceed the inlet rate.

In such embodiments, the air control system 114 can provide a user with control over whether patient chamber 104*a*, 104*b* is operating as a negative pressure chamber, a positive pressure chamber, or as a neutral pressure chamber as well as transitions between any of two of these pressure conditions, regardless of the ambient pressure outside of the chambers 104*a*, 104*b*, by controlling the airflow into and out of the chambers 104*a*, 104*b*.

Furthermore, if the user/operator wishes for the patient chamber 104*a* to maintain a neutral air pressure, the air control system 114 may be configured to control the electrically controllable valves of dampers 118*a*1 and 118*a*2 so that the same CFM of air is being conveyed into the patient chamber 104*a* as is being conveyed out of it (i.e., the inlet rate substantially matches the outlet rate). For example, the damper 118*a*1 may be angled to permit an inlet rate of about 245 CFM, while the damper 118*a*2 is angled to permit an outlet rate of about 245 CFM. Various volumes of inlet and outlet flow may be achieved, while still maintaining the patient chamber 104*a* at a neutral air pressure with respect to the ambient pressure. This may be done by enabling a user to control the airflow system 108*a* to increase or decrease the inlet rate and outlet rate in unison so that none of them persistently exceeds the other.

In at least one embodiment, the HEPA filter units 116*a*1, 116*a*2, 116*b*1, 116*b*2 may be rated to provide at least twelve (12) air exchanges per hour. Alternatively, in some embodiments, the HEPA filter units 116*a*1, 116*a*2, 116*b*1, 116*b*2 may be controlled to provide about thirty (30) air exchanges per hour. If fewer air exchanges are used, the air control system 114 may control the blades of the damper units 118*a*1, 118*a*2, 118*b*1, 118*b*2 so that a lower volume than 245 CFM is being conveyed into or out of the patient chamber 104*a*, 104*b*. In at least one alternative embodiment, depending at least on air pressure conditions and chamber sizing, the HEPA filter units 116*a*1, 116*a*2, 116*b*1, 116*b*2 can be sized to provide a minimum of 12 air exchanges per hour up to about 30 air exchanges per hour depending on the size of the HVAC systems 109*a*, 109*b*. The required air exchanges and the size of the room with which the air control system is used dictates the size of the HEPA CFM. For instance, the larger the room for a given air exchange, the more CFM that are needed. As an example, in an ICU chamber, in a negative pressure configuration, the inlet air may be set to be 30% less CFM than the outgoing exhaust, thus allowing for about 12-15 air exchanges depending on the size of the chambers 104*a*, 104*b* and the HEPA system. It should be noted that when air exchanges are made using the air control systems described herein, the air exchange may be done to exchange 100% of the air in a room with new incoming filtered air.

For example, in at least one embodiment, when the user input indicates that a negative air pressure configuration is selected, then the inlet rate may be set to be less than the outlet rate. In such cases, the range of negative pressure that may be achieved within the room may vary from 270 cfm to 250 cfm when the room is about 96" wide×144" long×84" tall in size, the HVAC is about 2-ton cooling with 5 kW heating in size and the HEPA units are about 280 cfm rated in size. For example, in at least one embodiment, the pressure in the negative pressure configuration may be about at least 0.01 Water Column (WC).

Alternatively, if the user/operator wishes for the patient chamber 104*b* to maintain a positive air pressure, the air control system 114 can control the electrically controllable valves of dampers 118*b*1 and 118*b*2 so that a higher CFM of air is being conveyed into the patient chamber 104*b* than out of it. In particular, damper 118*b*1 may be angled to permit an inlet rate at a third rate of about 245 CFM, while the damper 118*b*2 is angled to permit an outlet rate at a fourth rate that is less than the third airflow rate and may be set at only about 170 CFM, for example. Various levels of inlet and outlet flows may be achieved, while still maintaining the patient chamber 104 at a positive air pressure with respect to the ambient pressure. This may be done by controlling the airflow system 108*b* to change the relative inlet rate and outlet rate without causing the outlet rate to exceed the inlet rate.

For example, in at least one alternative embodiment, the air inlet subsystem 110 and air outlet subsystem 112 each comprise a HEPA filter unit that is equipped with a variable speed drive. The various air flow systems in these embodiments are similar to what is shown in FIG. 4A except there are no damper units since the HEPA filter units that are used have variable speed drives.

In this embodiment, the air pressure control system 114 can be configured such that each patient chamber 104*a*, 104*b* is operating independently of one another at positive pressure, negative pressure, or neutral pressure relative to the ambient environment. When a user configures the air pressure control system 114 to set the chamber 104*a* to positive pressure, the air pressure control system 114 directs the HEPA filter units 116 of air inlet subsystem 110*a* and air outlet subsystem 112*a* to adjust both the inlet rate and outlet rate by adjusting the speed at which the variable speed drive of each HEPA filter unit is operating. The variable speed drive of the HEPA filter unit 116*a*1 of the air inlet subsystem 110*a* may be adjusted such that the inlet rate is at a first flow rate such as about 245 CFM, for example, while the variable speed drive of HEPA filter unit 116*a*2 of air outlet subsystem 112*a* may be adjusted such that the outlet rate is at a second flow rate that is less than the first flow rate, so the second flow rate may be at about 170 CFM, for example. As the inlet rate is greater than the outlet rate, the patient chamber 104*a* is operating at a positive pressure configuration.

Similarly, when a user configures the air pressure control system 114 to set patient chamber 104*b* to negative pressure, the air pressure control system 114 directs the HEPA filter units 116 of air inlet subsystem 110*b* and air outlet subsystem 112*b* to adjust both the inlet rate and outlet rate, respectively, by adjusting the speed at which the variable speed drive of each of these HEPA filter units are operating. The variable speed drive of the HEPA filter unit 116*b*1 of air inlet subsystem 110*b* may be adjusted such that the inlet rate is at a third rate such as 170 CFM, for example, while the variable speed drive of HEPA filter unit 116*b*2 of the air outlet subsystem 112*b* may be adjusted such that the outlet rate is at a fourth airflow rate that is higher than the third airflow rate and may be at about 245 CFM, for example. As the inlet rate is less than the outlet rate, the patient chamber 104*b* is operating at a negative pressure configuration.

When a user configures the air pressure control system 114 to set patient chamber 104*a* to neutral pressure, the air pressure control system 114 directs the HEPA filter units 116 of air inlet subsystem 110*a* and air outlet subsystem 112*a* to adjust both the inlet rate and outlet rate by adjusting the speed at which the variable speed drive of each HEPA filter unit is operating. The variable speed drive of the HEPA filter unit 116*a*1 of air inlet subsystem 110*a* may be adjusted such that the inlet rate is at a fifth airflow rate such as about 245 CFM, for example, while the variable speed drive of the HEPA filter unit 116*a*2 of air outlet subsystem 112*a* may be adjusted such that the outlet rate is at a sixth airflow rate which is about the same as the fifth airflow rate at about 245 CFM. As the inlet rate substantially matches the outlet rate, the patient chamber 104*a* is operating at a neutral pressure configuration, wherein the pressure inside patient chamber 104*a* is substantially equal to the pressure of the environment outside of mobile medical unit 100.

In at least one alternative embodiment, alternative HEPA filter units may be deployed that have been equipped with variable speed drives, obviating the need to separately control dampers 118 since a user is able to directly control motor speed for these alternative HEPA filter units.

For example, in at least one alternative embodiment, the air inlet subsystem 110 and air outlet subsystem 112 each comprise a HEPA filter unit that is equipped with a variable speed drive. The various air flow systems in these embodiments are similar to what is shown in FIG. 4A except there are no damping units since the HEPA filter units that are used have variable speed drives.

In this embodiment, the air pressure control system 114 can be configured such that each patient chamber 104*a*, 104*b* is operating independently of one another at positive pressure, negative pressure, or neutral pressure relative to the ambient environment. When a user configures the air pressure control system 114 to set the chamber 104*a* to positive pressure, the air pressure control system 114 directs the HEPA filter units of air inlet subsystem 110*a* and air outlet subsystem 112*a* to adjust both the inlet rate and outlet rate by adjusting the speed at which the variable speed drive of each HEPA filter unit is operating. The variable speed drive of the HEPA filter unit of the air inlet subsystem 110*a* may be adjusted such that the inlet rate is at a first flow rate such as about 245 CFM, for example, while the variable speed drive of HEPA filter unit of air outlet subsystem 112*a* may be adjusted such that the outlet rate is at a second flow rate that is less than the first flow rate, so the second flow rate may be at about 170 CFM, for example. As the inlet rate is greater than the outlet rate, the patient chamber 104 is operating at a positive pressure configuration.

Similarly, when a user configures the air pressure control system 114 to set patient chamber 104*b* to negative pressure, the air pressure control system 114 directs the HEPA filter units of air inlet subsystem 110*b* and air outlet subsystem 112*b* to adjust both the inlet rate and outlet rate, respectively, by adjusting the speed at which the variable speed drive of each of these HEPA filter units are operating. The variable speed drive of the HEPA filter unit of air inlet subsystem 110*b* may be adjusted such that the inlet rate is at a third rate such as 170 CFM, for example, while the variable speed drive of HEPA filter unit of the air outlet subsystem 112*b* may be adjusted such that the outlet rate is at a fourth airflow rate that is higher than the third airflow rate and may be at about 245 CFM, for example. As the inlet rate is less than the outlet rate, the patient chamber 104*b* is operating at a negative pressure configuration.

When a user configures the air pressure control system 114 to set patient chamber 104*a* to neutral pressure, the air pressure control system 114 directs the HEPA filter units of air inlet subsystem 110*a* and air outlet subsystem 112*a* to adjust both the inlet rate and outlet rate by adjusting the speed at which the variable speed drive of each HEPA filter unit is operating. The variable speed drive of the HEPA filter unit of air inlet subsystem 110*a* may be adjusted such that the inlet rate is at a fifth airflow rate such as about 245 CFM, for example, while the variable speed drive of the HEPA filter unit of air outlet subsystem 112*a* may be adjusted such that the outlet rate is at a sixth airflow rate which is about the same as the fifth airflow rate at about 245 CFM. As the inlet rate substantially matches the outlet rate, the patient chamber 104*a* is operating at a neutral pressure configuration, wherein the pressure inside patient chamber 104 is substantially equal to the pressure of the environment outside of mobile medical unit 100.

In other examples and situations, the air inlet subsystem 110 and the air outlet subsystem 112 may be configured such that the inlet rate and outlet rate differ from the example values given above.

In the example embodiment of FIGS. 1 to 4B, the exterior of the unit 100 is the external environment. Accordingly, if the mobile medical unit 100 is placed outdoors, the exterior may be defined as the outdoor atmosphere. The air drawn into the inlet subsystems 110*a*, 110*b* will be sourced from the outdoor atmosphere. If the unit 100 is placed in a large indoor environment, such as a warehouse or aircraft hangar, the air drawn into the inlet subsystems 110*a*, 110*b* will be sourced from the air within the large indoor environment.

Method 200 begins with step 202 where the air pressure control system 114 is set to achieve a desired air pressure configuration in a room. The air pressure control system 114 may be adjusted, or interfaced with, using the input interface 122 described above, for example, by allowing a user to select an air pressure configuration. In at least one example embodiment, the air pressure configuration may be selected by allowing the user to control a discrete pressure setting such as positive pressure, negative pressure or neutral pressure. In such cases, the positive pressure and negative pressure may be at a predefined level relative to neutral pressure or the ambient pressure of an environment that is external to the room, such as a preset pressure difference that is positive or negative relative to the ambient pressure. Alternatively, or in addition thereto, the air pressure configuration may be selected by allowing a user to select from varying levels of positive pressure or negative pressure. For example, a user may select a positive or negative pressure of 0.01 to 0.06 inches of water relative to the external environment. The air pressure configuration may further comprise a predefined absolute positive or negative pressure.

At step 204, the air pressure control system 114 adjusts the inlet rate by varying the valve position of the damper unit 118 associated with the air inlet subsystem 110, until the desired inlet rate is reached. Step 204 may be conducted using open loop or closed loop control. In a closed loop control scheme, the valve position of the damper unit 118 is varied until the flow rate measured by flow meter 134 matches the desired inlet rate. In an open loop control scheme, the damper unit 118 is set to a desired position, that is predetermined to correspond to a certain inlet rate.

Accordingly, in at least one embodiment, in a room comprising an HVAC air inlet and air return outlet, the HVAC air inlet and return outlet may be blocked or otherwise disabled. The airflow system described herein may be integrated into the room, wherein the flow into the room is exclusively through air inlet subsystem 110, while the flow out of the room is exclusively through air outlet subsystem 112. In such example embodiments, the air inlet subsystem 110 may source airfrom another room within the permanent or semi-permanent structure. This air may already be pretreated by the building HVAC system, and therefore, may be at the desired temperature and humidity level. If the air was alternatively sourced from the external environment, the air may be at an uncomfortable temperature during certain times of year and may be further warmed or cooled. The air outlet subsystem 112 may deposit air either into another room of the semi-permanent or permanent structure, or to the environment external to the semi-permanent or permanent structure depending on, for example, whatever is more convenient.

In at least one other example embodiment, in a room of a semi-permanent or permanent structure comprising an HVAC air inlet and air return outlet, the HVAC return outlet may be blocked or otherwise disabled, while the HVAC air inlet into the room is left operational. The air inlet subsystem 110 may source intake air from either the environment external to the semi-permanent or permanent structure, or another room within the semi-permanent or permanent structure. The air outlet subsystem 112 may expel outlet air to the environment external to the semi-permanent or permanent structure or to another room within the semi-permanent or permanent structure. In such example embodiments, the structure's HVAC system may condition (e.g., pre-treat) the air within the room which the airflow system is installed into. The air inlet subsystem 110 may be placed near the HVAC air inlet, such that the air stream deposited into the room by the air inlet subsystem 110 substantially mixes with the air stream deposited into the room by the HVAC air inlet. The HVAC air inlet will provide temperature and humidity conditioned air, allowing the air inlet subsystem 110 to source air that may not be at an appropriate temperature and or have an appropriate humidity for an indoor environment, such as air sourced from the external environment during the winter season. Such a configuration may be used in cases where the structure's HVAC system is sized appropriately such that it may provide conditioned air at a rate matching or surpassing the rate of air provided by air inlet subsystem 110. Additionally, the use of the structure's HVAC system may be appropriate wherein the output from the HVAC system is sufficiently sterile. If the HVAC system recirculates outlet air from other areas of the structure, depending on the quality of the air, modifications may be made to the HVAC system, such as including additional filtration.

Figure 7B:
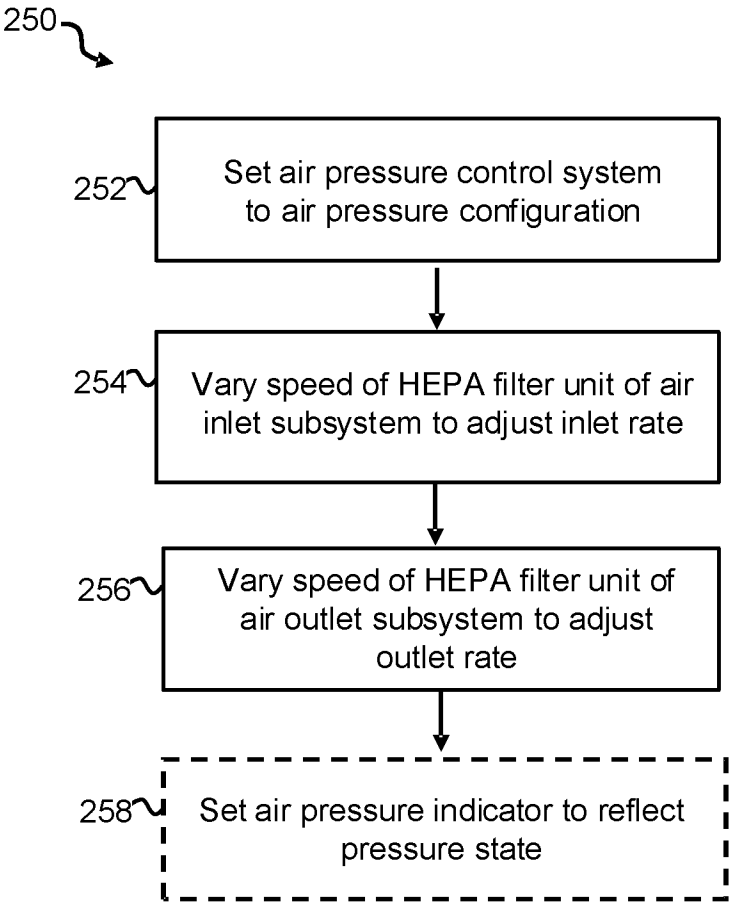
FIG. 7B is a flow chart showing an example embodiment of an alternative method of configuring the mobile medical unit of FIGS. 1 to 6.
Figure 7A:
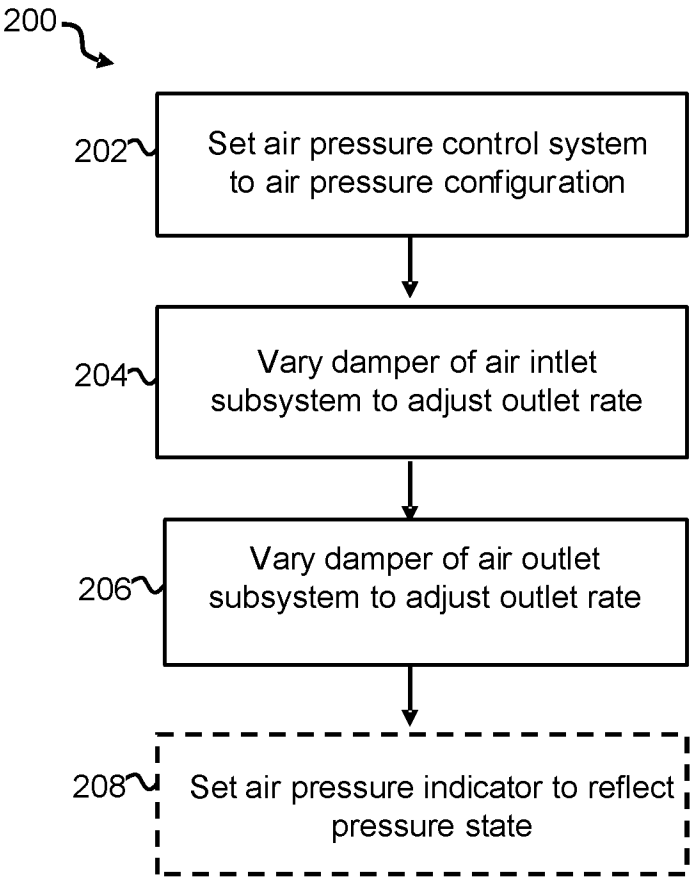
FIG. 7A is a flow chart showing an example embodiment of a method of configuring the mobile medical unit of FIGS. 1 to 6.

Referring now to FIG. 7A, shown therein is a flow chart illustrating an example embodiment of a method 200 of configuring a room or chamber of a portable, semi-permanent or permanent structure, such as a mobile medical unit, for example, to operate in a desired air pressure configuration, where the airflow system 108 comprises a HEPA filter unit and a damper unit. The description above in reference to FIGS. 1 to 6 describing various embodiments of the mobile medical unit 100 may also apply to method 200.

Method 200 begins with step 202 where the air pressure control system 114 is set to achieve a desired air pressure configuration in a room. The air pressure control system 14 may be adjusted, or interfaced with, using the input interface 122 described above, for example, by allowing a user to select an air pressure configuration. In at least one example embodiment, the air pressure configuration may be selected by allowing the user to control a discrete pressure setting such as positive pressure, negative pressure or neutral pressure. In such cases, the positive pressure and negative pressure may be at a predefined level relative to neutral pressure or the ambient pressure of an environment that is external to the room, such as a preset pressure difference that is positive or negative relative to the ambient pressure. Alternatively, or in addition thereto, the air pressure configuration may be selected by allowing a user to select from varying levels of positive pressure or negative pressure. For example, a user may select a positive or negative pressure of 0.01 to 0.06 inches of water relative to the external environment. The air pressure configuration may further comprise a predefined absolute positive or negative pressure.

Referring now to FIG. 7B, shown therein is a flow chart illustrating an example embodiment of a method 250 of configuring a room or chamber of a portable, semi-permanent or permanent structure, such as a mobile medical unit, for example, to operate in a desired air pressure configuration, wherein the airflow system comprises a HEPA filter unit with a variable speed drive. The description above in reference to FIGS. 1 to 6 describing various embodiments of the mobile medical unit 100 may also apply to method 250.

At step 206, air pressure control system 114 adjusts the outlet rate by varying the valve position of the damper unit 118 associated with the air outlet subsystem 112, until the desired outlet rate is reached. Step 206 may be conducted using open loop or closed loop control. In a closed loop control scheme, the valve position of the damper unit 118 is varied until the flow rate measured by flow meter 134 matches the desired outlet rate. In an open loop control scheme, the valve position of the damper unit 118 is set to a desired position, that is predetermined to correspond to a certain outlet rate.

At step 254, the air pressure control system 114 adjusts the inlet rate by varying the speed of the HEPA filter unit 116 associated with the air outlet subsystem 112, until the desired inlet rate is reached. Step 254 may be conducted using open loop or closed loop control. In a closed loop control scheme, the speed of the HEPA filter unit is varied until the flow rate measured by flow meter 134 matches the desired inlet rate. In an open loop control scheme, the speed of the HEPA filter unit is set to a desired speed, that is predetermined to correspond to a certain inlet rate.

After the completion of step 206, the airflow system 108 of the mobile medical unit is now set to the desired pressure configuration.

Some examples of method 200 may further comprise step 208, wherein the pressure indicator 120 is set to reflect the pressure configuration set at step 202. For example, in embodiments wherein pressure indicator 120 comprises an LED light, air pressure control system 114 instructs the pressure indicator 120 to output a given light color that is associated with the set pressure configuration. For example, when a positive pressure configuration is set at step 202, the pressure indicator 120 may be illuminated in a first color, such as blue and when a negative pressure configuration is set at step 202, the pressure indicator may be illuminated in a second color, such as red. In at least one embodiment, pressure indicator 120 may only reflect a pressure configuration when measurements obtained from pressure sensor 130 also reflect the pressure configuration. For example, when the pressure configuration set at step 202 is a positive pressure configuration, the pressure indicator 120 will only reflect a positive pressure condition when measurements obtained from pressure sensor 130 reflect a positive pressure condition.

Referring now to FIG. 7B, shown therein is a flow chart illustrating an example embodiment of a method 250 of configuring a room or chamber of a portable, semi-permanent or permanent structure, such as a mobile medical unit for example, to operate in a desired air pressure configuration, wherein the airflow system comprises a HEPA filter unit with a variable speed drive. The description above in reference to FIGS. 1 to 6 describing various embodiments of the mobile medical unit 100 may also apply to method 250.

Method 250 begins with step 252 where the air pressure control system 114 is set to control the air pressure of the room to be at a desired air pressure configuration. The air pressure control system 114 may be adjusted or interfaced with as described in step 202 of method 200 and the air pressure configuration can have various settings as described in step 202 of method 200.

At step 254, the air pressure control system 114 adjusts the inlet rate by varying the speed of the HEPA filter unit associated with the air inlet subsystem 110, until the desired inlet rate is reached. Step 254 may be conducted using open loop or closed loop control. In a closed loop control scheme, the speed of the HEPA filter unit is varied until the flow rate measured by flow meter 134 matches the desired inlet rate. In an open loop control scheme, the speed of the HEPA filter unit is set to a desired speed, that is predetermined to correspond to a certain inlet rate.

At step 256, the air pressure control system 114 adjusts the outlet rate by varying the speed of the HEPA filter unit 116 associated with the air inlet subsystem 110, until a desired outlet rate is reached. Step 256 may be conducted using open loop or closed loop control. In a closed loop control scheme, the speed of the HEPA filter unit is varied until the flow rate measured by flow meter 134 matches the desired outlet rate. In an open loop control scheme, the speed of the HEPA filter unit is set to a desired speed, that is predetermined to correspond to a certain outlet rate.

In at least one embodiment of method 250, steps 254 and 256 may be executed concurrently.

After the completion of step 256, the airflow system 108 of the mobile medical unit is now set to the desired pressure configuration.

Some examples of method 250 may further comprise step 258, wherein the pressure indicator 120 is set to reflect the pressure configuration set at step 252. For example, in embodiments wherein pressure indicator 120 comprises an LED light, air pressure control system 114 instructs the pressure indicator 120 to output a given light color associated with the set pressure configuration as was described in step 208 of method 200.

In accordance with another aspect of the teachings herein, in at least one embodiment, the rooms of the mobile unit 100 have wall panels that may be configured to be fixed in place adjacent to the walls of the shipping container 102. However, the traditional technique of forming walls by first affixing studs to the wall of the shipping container and then applying cladding to the studs provides for a thick wall that imposes on the already-limited volume within the shipping container 102. As such, in accordance with the teachings herein, at least one embodiment is described in which each wall panel may be configured to be positioned nearer to the wall of the shipping container 102, such that each wall panel can interface at its top side and its bottom side with a respective strip of angle iron to keep it in position closer to the inside of the walls of the shipping container 102.

In instances of the methods 200 and 250, where the air pressure control system 114 may be set to a positive pressure configuration, the inlet rate is greater than the outlet rate.

In instances of the methods 200 and 250, where the air pressure control system 114 may be set to a negative pressure configuration, the inlet rate is less than the outlet rate.

In instances of the methods 200 and 250, where the air pressure control system 114 may be set to a neutral pressure configuration, the inlet rate is substantially equal to the outlet rate.

Figures 8A, 8B, 8C, 8D, 8E:
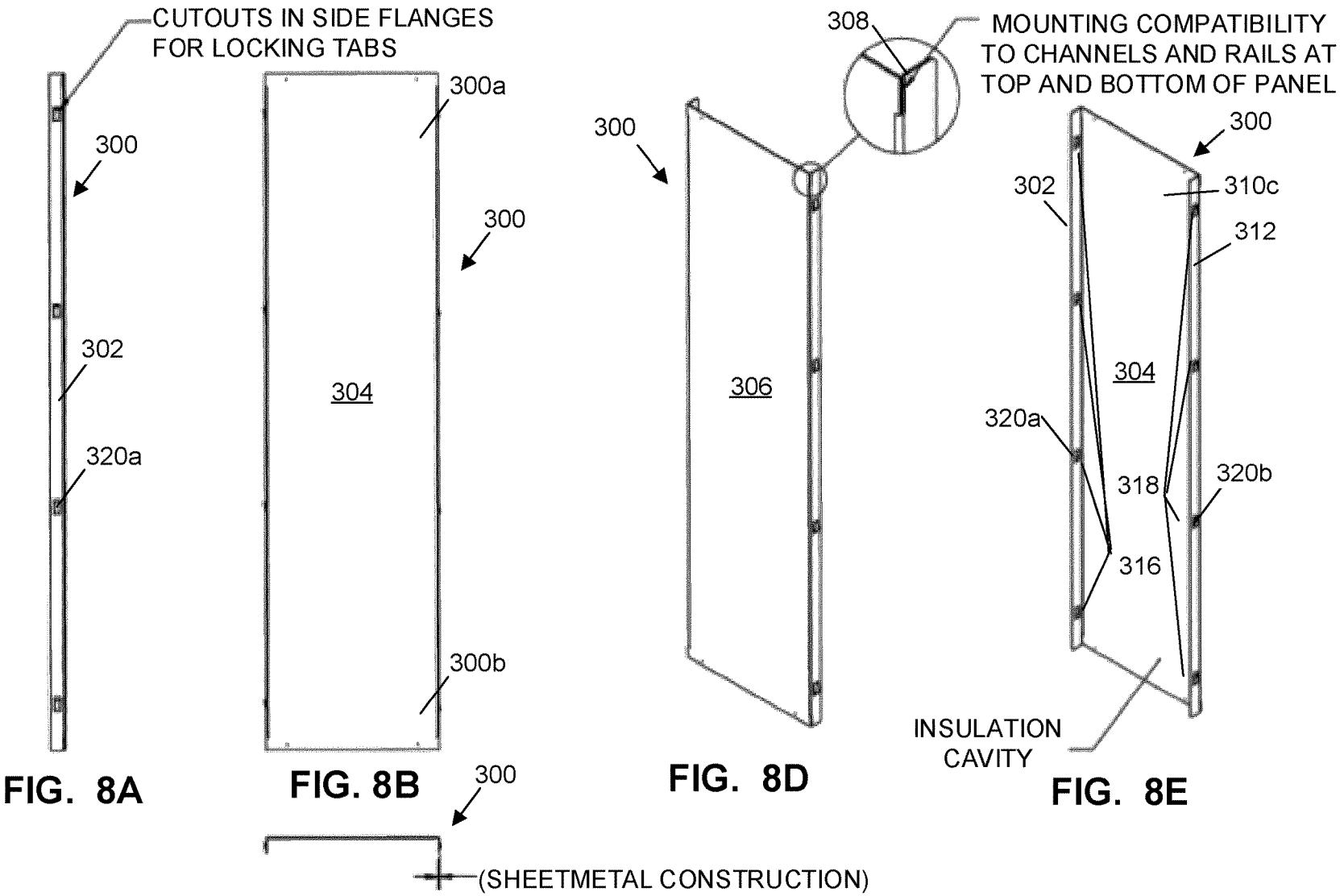
FIG. 8A shows a right side view of a wall panel, according to an example embodiment in accordance with the teachings herein.
FIG. 8B shows a rear side view of the wall panel of FIG. 8A.
FIG. 8C shows a top side view of the wall panel of FIG. 8A.
FIG. 8D shows a front perspective view of the wall panel of FIG. 8A, with an enlargement shown to more clearly illustrate the severing between the front facing and right-facing sides to accommodate a leg of angle iron as a rail.
FIG. 8E shows a rear perspective view of the wall panel of FIG. 8A, showing an insulation cavity for receiving a panel of insulating material.

Referring now to FIGS. 8A-8E, multiple views of a wall panel of an example embodiment are shown. Shown in FIG. 8A is a right side surface 302 of a wall panel 300, according to at least one embodiment, having a front-to-back thickness of about two (2) inches, for example (other thicknesses are possible in other embodiments). Referring now to FIG. 8B, a rear surface 304 of the wall panel 300 is shown. The side surface 302 and the rear surface 304 may be configured to provide an insulation cavity for receiving a rectangular panel of insulation (not shown) as best shown in FIG. 8E. Referring now to FIG. 8C, a top side view of the wall panel 300 is shown. A front perspective view of the front surface 306 of the wall panel 300 is shown in FIG. 8D which also shows an enlarged view of a severing or slit 308 between the front-facing surface 306 and the right-facing sides 302 to accommodate a leg of angle iron as a rail, as will be described.

In accordance with another aspect of the teachings herein, in at least one embodiment, the rooms of the mobile unit 100 have wall panels that may be configured to be fixed in place adjacent to the walls of the shipping container 102. However, the traditional technique of forming walls by first affixing studs to the wall of the shipping container and then applying cladding to the studs provides for a thick wall that imposes on the already-limited volume within the shipping container 102. As such, in accordance with the teachings herein, at least one embodiment is described in which each wall panel may be configured to be positioned nearer to the wall of the shipping container 102, such that each wall panel can interface at its top side and its bottom side with a respective strip of angle iron to keep it in position closer to the wall 102 of the shipping container.

In another aspect, in at least one embodiment described herein, each wall panel may also be configured to interface along its sides with other like wall panels, thereby to fixedly interlock with the adjacent wall panels to form a larger wall section having greater structural strength.

In another aspect, in at least one embodiment described herein, wall panels are provided that may laterally interconnect with one another in a self-sealing manner such that an airtight seal can be formed between adjacent wall panels which is beneficial when the walls panels are used in rooms that are to be maintained at a certain pressure configuration relative to the ambient environment as explained previously.

In this description, the interior walls, the exterior walls, the roofing structure, and the ceiling of the mobile unit 100 and other structures described herein may be formed with powder-coated, marine grade aluminum or metal panels. For example, H52 marine grade aluminum may be used. Marine grade material may also provide corrosion resistance and can tolerate even constant contact with seawater. Alternatively, in at least one embodiment, these structural elements may be formed of any metal such as, but not limited to, for example, A36, 44W, any other suitable ASTM grades or carbon-based thermoplastic materials.

Referring now to FIGS. 8A-8E, multiple views of a wall panel of an example embodiment are shown. Shown in FIG. 8A is a right side surface 302 of a wall panel 300, according to at least one embodiment, having a front-to-back thickness of about two (2) inches, for example (other thicknesses are possible in other embodiments). Referring now to FIG. 3B, a rear surface 304 of the wall panel 300 is shown. The side surface 302 and the rear surface 304 may be configured to provide an insulation cavity for receiving a rectangular panel of insulation (not shown) as best shown in FIG. 8E. Referring now to FIG. 8C, a top side view of the wall panel 300 is shown. A front perspective view of the front surface 306 of the wall panel 300 is shown in FIG. 8D which also shows an enlarged view of a severing or slit 308 between the front-facing surface 306 and the right-facing sides 302 to accommodate a leg of angle iron as a rail, as will be described.

The formation of left side surfaces 312 and right side surfaces 302 of the wall panel 300 as described in FIG. 8E may also enable these sides 312 and 302 to, along with the front panel 306, encompass an insulation panel at the rear-facing side 304. Such an insulation panel may be made of polystyrene or some other thermally insulating material that is about two (2) inches thick (or slightly less thick than the thickness of the cavity 310*c*). In this way, an insulating wall panel may be provided with an aluminum exterior in the form of the wall panel 300.

This severing 308 and separation may be repeated at the junction between the very bottom of the front facing-side 306 and the very bottom of the right-facing side 302, thereby to also receive therein the same leg of the bottom piece of angle iron.

Similarly, this severing 308 and separation may be repeated at the very top of the front facing- and left-facing sides 306 and 312, respectively, as well as at the very top of the front-facing and right-facing sides 306 and 302, thereby to receive with each the same leg of an upper piece of angle iron.

Figures 9A, 9B, 9C, 9D, 9E:
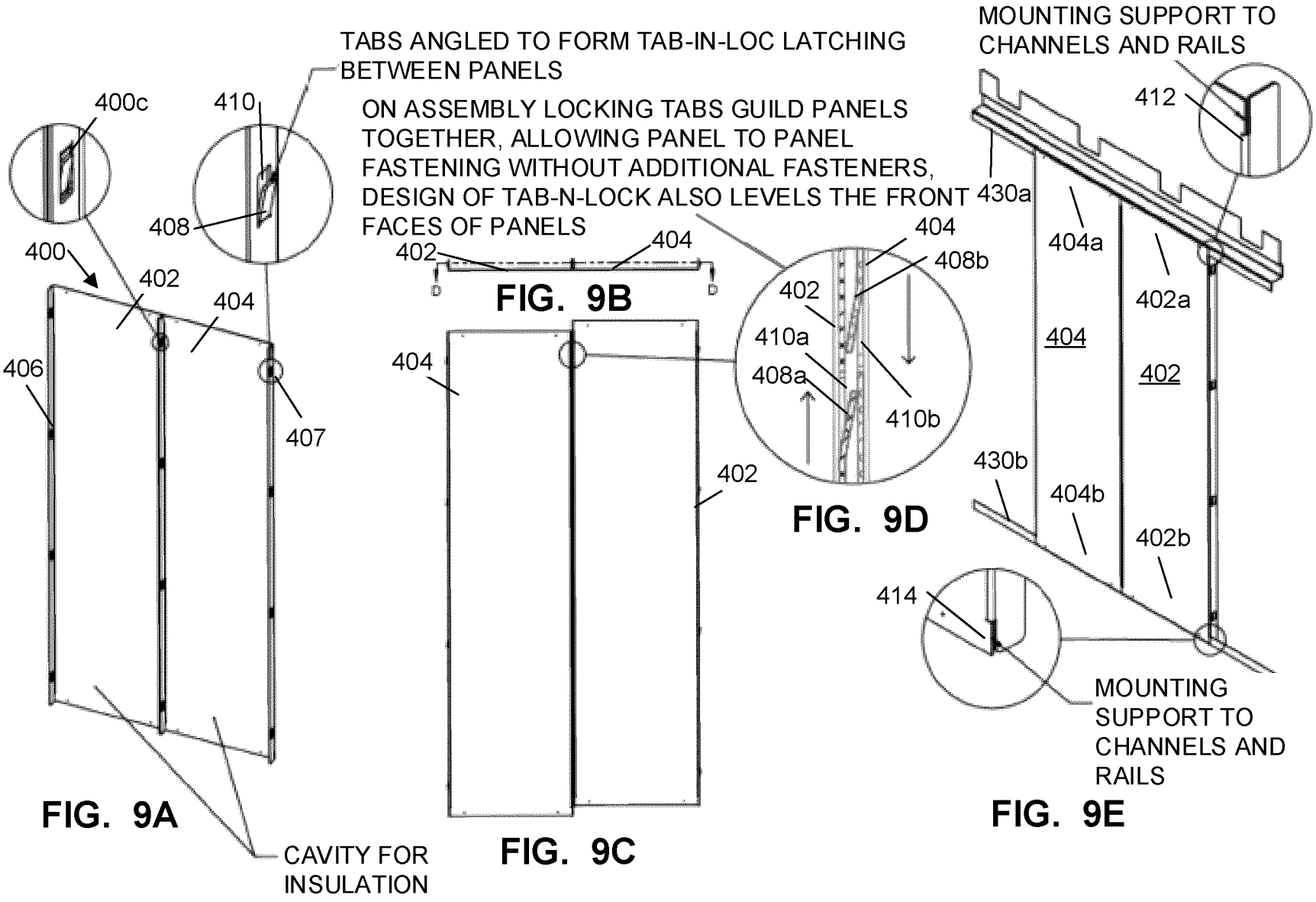
FIG. 9A shows a rear perspective view of two of the wall panels of FIG. 8A adjacent to and interlocking with each other, with the leftmost wall panel having multiple lateral interface components, in this embodiment each having a male tab and a female slot, that each engage with respective lateral interface components of the rightmost panel that are oriented at 180 degrees with respect to them.
FIG. 9B shows a top view of the two wall panels of FIG. 9A.
FIG. 9C shows a front view of the two wall panels of FIG. 9A offset lengthwise from each other prior to interlocking.
FIG. 9D shows an enlarged partial view of the male tabs and female slots of the two adjacent wall panels of FIG. 9A being brought into engagement.
FIG. 9E shows the two wall panels each engaging, at their top sides and bottom sides, a leg of a respective length of angle iron in the region formed in the wall panels by severing a bottommost portion of the connection between the left and right sides and the bottom side, and by severing a topmost portion of the connection between the left and right sides and the top side.

In at least one embodiment, each lateral interface component 406 has a male portion and a female portion, which in this case are a male tab 408 and a female slot 410, that each engage with respective lateral interface components 407 of the rightmost wall panel 404 that are oriented in a complementary fashion, which in this case is at 180 degrees, with respect to them. Referring now to FIG. 9B shown therein is a top view of the two interlocked wall panels 402 and 404. Referring now to FIG. 9C, there is shown a front view of the two wall panels 402 and 404, offset height wise from each other just prior to completing interlocking.

In this example embodiment, each male tab 408 is angled away from the edge surface to which it is coupled such that the distance between the underside of the male tab 408 and the edge surface of the side wall of the wall panel is tapered to the point where the male tab 408 joins the edge surface. This allows the male portions of adjacent lateral interface components to engage with one another as the wall panels 402 and 404 are laterally coupled to one another such that the surface of the male tabs slide against one another and make a friction fit with one another. This has the effect that the wall panels 402 and 404 more securely and tightly engage one another such that an airtight or near airtight seal is made between adjacent wall panels 402 and 404. This is beneficial since this airtight coupling makes the wall panels suitable for use in rooms that must be maintained at a certain pressure which is different compared to the pressure of the environment that is external to the room.

The formation of left side surfaces 312 and right side surfaces 302 of the wall panel 300 as described in FIG. 8E may also enable these sides 312 and 302 to, along with the front panel 306, encompass an insulation panel at the rear-facing side 304. Such an insulation panel may be made of polystyrene or some other thermally insulating material that is about two (2) inches thick (or slightly less thicker than the thickness of the cavity 310*c*). In this way, an insulating wall panel may be provided with an aluminum exterior in the form of the wall panel 300.

Referring now to FIG. 9D, there is shown an enlarged partial view of the male tabs 408*a*, 408*b* and female slots 410*a* and 410*b* of interface components in the two adjacent wall panels 402 and 404, respectively, being brought into engagement. It can be seen that the male tab 408*a* and female slot 410*a* are oriented in opposite fashion (e.g., 180 degrees) with respect to the female slot 410*b* and the male tab 408*b*, respectively, and that they engage one another when the panel 402 is moved downwards relative to the panel 404 such that the lower portion of the male tab 408*b* starts to contact with the upper portion of male tab 408*a* and slides over the upper surface of the male tab 408*a* thereby making a friction contact to more securely hold the wall panels 402 and 404 together.

As shown in FIGS. 9A-9D there are multiple lateral interface components that are arranged along the edge surfaces of the wall panels 402 and 404 thereby increasing the number of interface components that engage one another between the two wall panels 402 and 404 as the edge surfaces of the two wall panels are slid together so that the wall panels 402 and 404 engage one another to form a larger wall section. The increased number of interface components that engage one another provides for a stronger coupling and tighter seal between the wall panels 402 and 404.

Referring now to FIG. 9E, shown therein is a representation of at least one embodiment, in which the two wall panels 402 and 404 are each engaging, at their top sides 402*a* and 404*a* and bottom sides 402*b* and 404*b*, a leg of a respective length of upper and lower angle irons 430*a* and 430*b* in the region formed in the wall panels 402 and 404 by severing a topmost portion 412 of the connection between the left and right sides and the top side 402*a*, and by severing a bottommost portion 414 of the connection between the left and right sides and the bottom side 402*b* of the panel 402, for example, with similar action occurring at the other top and bottom corners of the wall panel 402 and all of the top and bottom corners of the wall panel 404. The two angle irons 430*a* and 430*b* are first attached to the inner surface of the walls of a shipping container and then the walls panels 402 and 404 can be positioned so that the upper and lower severed portions of the wall panels 402 and 404 slide along the edges of a lower and upper vertical rails of the angle irons 430*a* and 430*b*, respectively.

In at least one embodiment, once the wall panels 402 and 404 are in place relative to the rails of the angle irons 430*a* and 430*b*, a sealant, such as medical grade silicone sealant, can be applied along the interfaces between panels to provide mold-resistant sealing once the wall panels 402 and 404 are in place and interlocked with one another and the angle irons 430*a* and 430*b*.

There may be various alternative embodiments where, for example, the male portions of the lateral interface components may be angled differently but are still oriented such that male portions of lateral interface components of two edge surfaces of walls panels that engage one another are oriented opposite one another. For instance, in the example embodiment shown in FIGS. 9A-9E, the male tabs are vertically oriented. However, in an alternative embodiment, the male tabs can be horizontally oriented in which case adjacent wall panels are not slid vertically with respect to one another but horizontally. In another alternative embodiment, the male tabs can be angled with respect to the edge surface to which they are connected so while the tab portions are colinear with the edge surfaces in the example embodiment shown in FIGS. 9A-9E in an alternative embodiment the tab portions may extend at an angle so that they are directed towards the front of the wall panel along one edge surface of the wall panel and then extend to the rear of the wall panel along the other edge surface of the wall panel. In this case the wall panels will be offset both vertically and horizontally with one another and they are slid together in a diagonal fashion for the interlock components to engage one another. In any of these embodiments, the male portions of the lateral interlock components that engage with one another are located in an opposite fashion which might be vertical (as shown in FIGS. 9A-9E), horizontal or angled but in each of these cases the male tabs will still engage with one another to form a friction fit. In any of these embodiments, the male portions of the lateral interlock components may be integral with the side surface of the wall panels or these male portions may be separate elements that are made separately and then fastened to the side surface of the wall panels by using a fastener such as, but not limited to, a rivet, stud, nail, screw. In embodiments where the male portions of the lateral interlock components are separate elements, they may be made from another type of material with better strength characteristics than the material that is used to make the wall panels. In such cases, the wall panels may be made from less expensive materials and the male portions used for the lateral interlock components are made from much stronger materials to ensure structural integrity.

Referring now to FIG. 9D, shown therein is an enlarged partial view of the male tabs 408*a*, 408*b* and female slots 410*a* and 410*b* of interface components in the two adjacent wall panels 402 and 404, respectively, being brought into engagement. It can be seen that the male tab 408*a* and female slot 410*a* are oriented in opposite fashion (e.g., 180 degrees) with respect to the female slot 410*b* and the male tab 408*b*, respectively, and that they engage one another when the panel 404 is moved downwards relative to the panel 402 such that the lower portion of the male tab 408*b* starts to contact with the upper portion of male tab 408*a* and slides over the upper surface of the male tab 408*a* thereby making a friction contact to more securely hold the wall panels 402 and 404 together.

As shown in FIGS. 9A-9E where are multiple lateral interface components that are arranged along the edge surfaces of the wall panels 402 and 404 thereby increasing the number of interface components that engage one another between the two wall panels 402 and 404 as the edge surfaces of the two wall panels are slid together so that the wall panels 402 and 404 engage one another to form a larger wall section. The increased number of interface components that engage one another provides for a stronger coupling and tighter seal between the wall panels 402 and 404.

Referring now to FIG. 9E, shown therein is a representation of at least one embodiment, in which the two wall panels 402 and 404 are each engaging, at their top sides 402*a* and 404 *aa* and bottom sides 402*b* and 404*b*, a leg of a respective length of upper and lower angle irons 430*a* and 430*b* in the region formed in the wall panels 402 and 404 by severing a topmost portion 412 of the connection between the left and right sides and the top side 402*a*, and by severing a bottommost portion 414 of the connection between the left and right sides and the bottom side 402*b* of the panel 402, for example, with similar action occurring at the other top and bottom corners of the wall panel 402 and all of the top and bottom corners of the wall panel 404. The two angle irons 430*a* and 430*b* are first attached to the inner surface of the walls of a shipping container and then the walls panels 402 and 404 can be positioned so that the upper and lower severed portions of the wall panels 402 and 404 slide along the edges of a lower and upper vertical rails of the angle irons 430*a* and 430*b*, respectively.

Figure 10A:
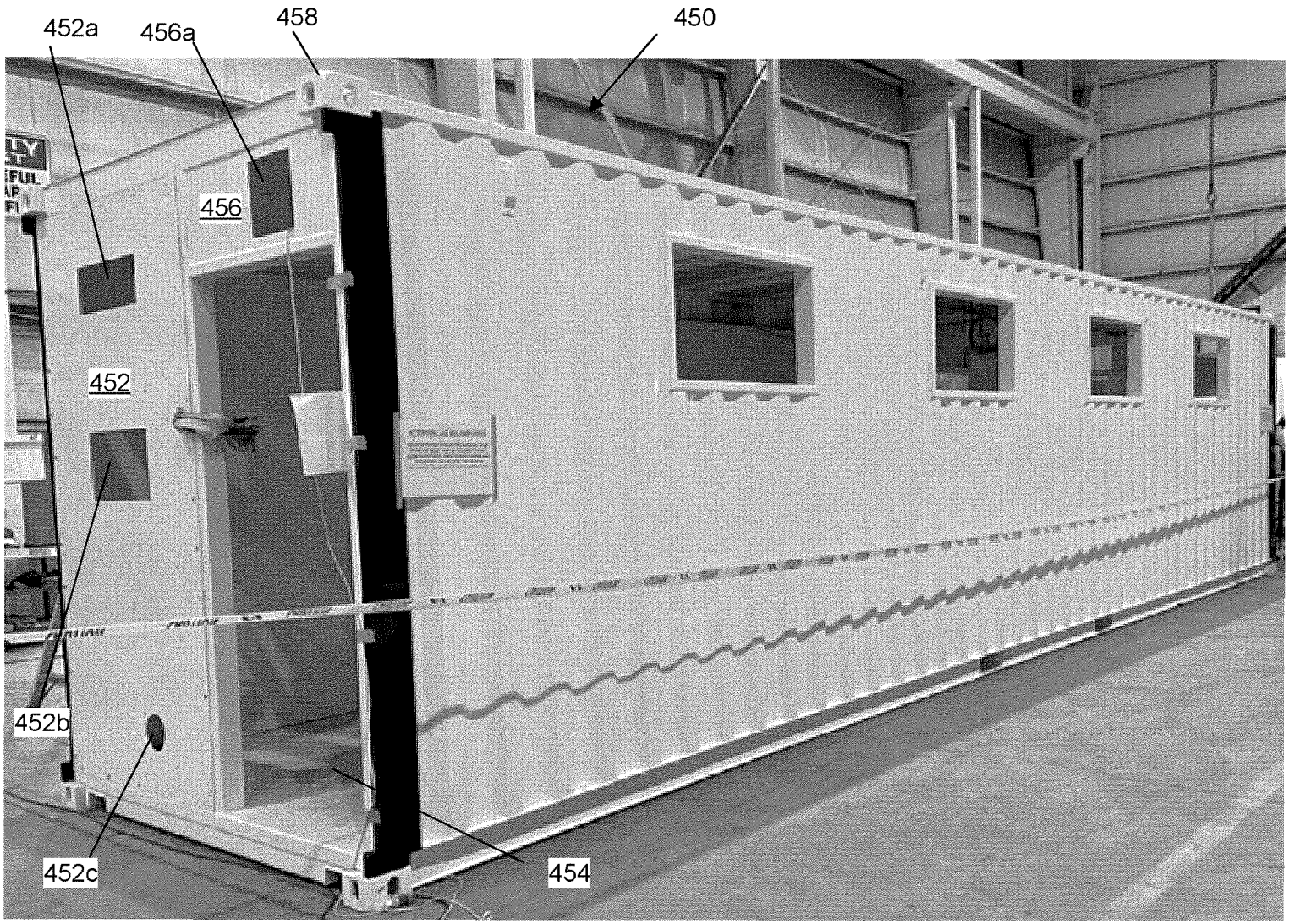
FIG. 10A is a perspective view showing the front and a first side of a shipping container modified to serve as the basis for a mobile medical unit, according to an example embodiment.

Referring now to FIG. 10A shown therein is a perspective view showing the front and a first side of a shipping container 450 modified to serve as the basis for a mobile medical unit, such as unit 100, according to an example embodiment. In this view, the panel 452 against which the HVAC equipment box is to be mounted is shown beside the doorway 454. The panel has openings 452*a* and 452*b* for the HVAC inlet and return, as well as a lower vent 452*c* opening for air exiting from the mobile medical unit. A panel 456 on which the inlet vent 456*a* can be mounted is shown above the doorway 454.

There may be various alternative embodiments where, for example, the male portions of the lateral interface components may be angled differently but are still oriented such that male portions of lateral interface components of two edge surfaces of walls panels that engage one another are oriented opposite one another. For instance, in the example embodiment shown in FIGS. 9A-9E, the male tabs are vertically oriented. However, in an alternative embodiment, the male tabs can be horizontally oriented in which case adjacent wall panels are not slid vertically with respect to one another but horizontally. In another alternative embodiment, the male tabs can be angled with respect to the edge surface to which they are connected so while the tab portions are colinear with the edge surfaces in the example embodiment shown in FIGS. 9A-9E in an alternative embodiment the tab portions may extend at an angle so that they are directed towards the front of the wall panel along one edge surface of the wall panel and then extend to the real of the wall panel along the other edge surface of the wall panel. In this case the wall panels will be offset both vertically and horizontally with one another and they are slide together in a diagonal fashion for the interlock components to engage one another In any of these embodiments, the male portions of the lateral interlock components that engage with one another are located in an opposite fashion which might be vertical (as shown in FIGS. 9A-9E), horizontal or angled but in each of these cases the male tabs will still engage with one another to form a friction fit. In any of these embodiments, the male portions of the lateral interlock components may be integral with the side surface of the wall panels or these male portions may be separate elements that are made separately and then fastened to the side surface of the wall panels by using a fastener such as, but not limited to, a rivet, stud, nail, screw. In embodiments where the male portions of the lateral interlock components are separate elements, they may be made from another type of material with better strength characteristics than the material that is used to make the wall panels. In such cases, the wall panels may be made from less expensive materials and the male portions used for the lateral interlock components are made from much stronger materials to ensure structural integrity.

Figure 10B:
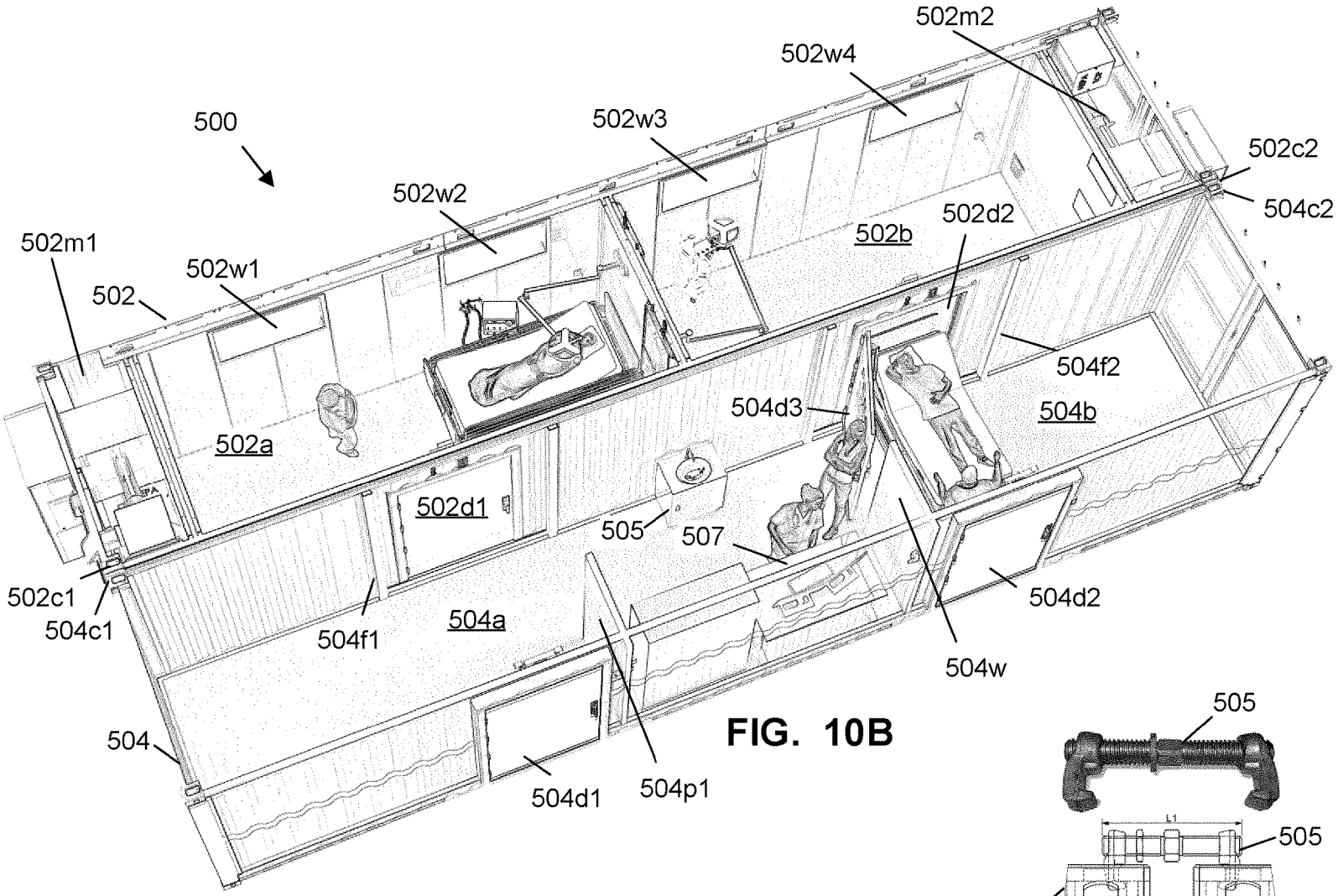
FIG. 10B is a top perspective view of an example embodiment of a compound structure including a mobile medical unit that is connected with another mobile unit that is itself equipped as a nurse station, thereby to form a compound structure, according to the construction techniques and air control system described herein.
Figure 10C:
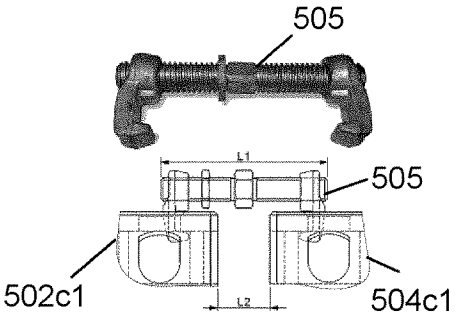
FIG. 10C is a perspective view of interlock components for coupling two portable units together.

Referring now to FIG. 10B, shown therein is a top perspective view of a compound structure 500 that includes a medical unit 502 that is connected with another mobile unit 504 that is itself equipped as a nurse station 507, according to an example embodiment. In this example embodiment, the mobile medical unit 502 is similar to the medical unit 100 of FIGS. 1-4B and is divided into two halves each with its own patient chamber 502*a* and 502*b* and respective maintenance rooms 502*m*1 and 502*m*2. The nurse station unit 504 is placed adjacent to the mobile medical unit 502 and is held together with the mobile medical unit 502 to form the compound structure 500 using clamps or other suitable fasteners linking the shipping containers' corner blocks 502*c*1 and 504*c*1 together as well as corner blocks 502*c*2 and 504*c*2 together. An example of the fastening of the corner blocks 502*c*1 and 504*c*1 using clamp 505 is shown in FIG. 10C.

In this example embodiment, the nurse station unit 504 itself is constructed based on a shipping container that is the same size as that of the mobile medical unit 502 but is configured to have different interior features than the mobile medical unit 502. In particular, in this example embodiment, the nurse station unit 504 itself has two exterior doorways with respective doors 504*d*1 and 504*d*2, half-wall divider or partition 504*p*1, half-wall 504*w* and internal door 504*d*3, which generally partitions the unit 504 into room 504*a* and room 504*b*, which may serve as another patient room. In room 504*b* there can be various patient setups, and in this example, there is a patient bed. A person can get into the patient room 504*b* via the internal door 504*d*3 or the external door 504*d*2. The unit 504 can have a variety of internal setups including, but not limited to, various pieces of furniture including a cabinet, and a desk for a nurse's station 507, and a portable handwashing station 505. The nurse unit 504 may be fitted with at least one independent HVAC unit (not shown) for air conditioning within the nurse unit 504.

The nurse unit 504 also features two additional doorways 504*f*1 and 504*f*2 that may optionally be opposite the exterior doors 504*d*1 and 504*d*2. The doorways 504*f*1 and 504*f*2 respectively face doors 502*d*1 and 502*d*2 of the mobile medical unit 502. In this way, the doors 502*d*1 and 502*d*2 of the unit 502 may be opened outwards and into the nurse unit 504 when required.

In this example embodiment, each doorway (i.e., door frame) 504*f*1 and 504*f*2 of the nurse unit 504 is larger in height and width than the corresponding door 502*d*1 and 502*d*2 of the mobile medical unit 502. Each doorway 504*f*1 and 504*f*2 of the nurse unit 504 includes a frame with an outward-facing planar surface that faces and runs parallel to a corresponding outward-facing planar surface that is a portion of the exterior wall of the unit 502 which is around the doors 502*d*1 or 502*d*2 of the mobile medical unit 502. The outward-facing planar surface portions of the mobile medical unit 502 faced by and adjacent to the outward-facing surface portions around the frames of the doorways 504*f*1 and 504*f*2 of the nurse unit 504 are planar or in other words have a flat pattern. Because these surface portions of the units 502 and 504 face are adjacent one another the foam seal is placed on these flat surfaces which are then urged towards each other due to the clamping of the corner blocks which will aid in forming a seal around the doors 502*d*1 and 502*d*2 as the rooms 502*a* and 502*b* may be at a positive pressure or a negative pressure relative to the nurse unit 504 as explained previously for unit 100. The widths and thicknesses of the planar or flat pattern surfaces that are adjacent to one another are dimensioned to be wide enough (e.g., at least about 6 inches) and thick enough to withstand the compression forces when they are pushed together as the shipping containers are clamped and urged together.

In this example embodiment, prior to bringing the two shipping containers for unit 502 and 504 physically together, seals are provided between each of the larger openings between the surfaces of the two units 502 and 504 that face one another. For example, since doorways 504*f*1 and 504*f*2 are larger than the opposing doors 502*d*1 and 502*d*2, respectively, seals can be positioned so that they will be at and/or around the portions of the doorways 504*f*1 and 504*f*2 of unit 504 that will make contact with an opposing surface of the unit 502. In some embodiments for compound structures, when two shipping containers are urged together and the entirety or a majority of the walls that would otherwise be adjacent to one another are removed then the seal may be sized and disposed to be between the entire frames of the shipping containers that are adjacent to one another.

Referring now to FIG. 10B, shown therein is a top perspective view of a compound structure 500 that includes a medical unit 502 that is connected with another mobile unit 504 that is itself equipped as a nurse station 506, according to an example embodiment. In this example embodiment, the mobile medical unit 502 is similar to the medical unit 100 of FIGS. 1-4B and is divided into two halves each with its own patient chamber 502*a* and 502*b* and respective maintenance rooms 502*m*1 and 502*m*2. The nurse station unit 504 is placed adjacent to the mobile medical unit 502 and is held together with the mobile medical unit 502 to form the compound structure 500 using clamps or other suitable fasteners linking the shipping containers' corner blocks 502*c*1 and 504*c*1 together as well as corner blocks 502*c*2 and 504*c*2 together. An example of the fastening of the corner blocks 502*c*1 and 504*c*1 using clamp 505 is shown in FIG. 100.

In at least one embodiment the seal may be adhered either to a surface portion of the mobile medical unit 502 or to a surface portion of the nurse station unit 504 at and/or around the frames of doorways 504*f*1 and 504*f*2. Alternatively, the seal may be held in place as the two shipping containers are being brough together. As the two shipping containers are brought together in alignment, the frames of the mobile medical unit and the nurse station module are brought into alignment. As the two shipping containers are urged closer together, by increasing the clamping force at the corner casting blocks 502*c*1 and 504*c*1 as well as 502*c*2 and 504*c*2, the seal is increasingly compressed between the adjacent surfaces of the units 502 and 504 that contact one another thereby serving as a gasket for providing a fluid-tight seal around the frames of the doorways 504/1 and 504/2. In this way, air exiting the mobile medical unit 502 via the opening of door 502*d*1 and 502*d*2 from a patient chamber 502*a* or 502*b* can exit only into the nurse station unit 504, and air exiting the nurse station unit 504 via these doors can exit only into a patient chamber. That is, such air cannot escape between the shipping containers themselves.

Accordingly, in at least one embodiment the seal does not go around the entire frame of the shipping container and may only be around the openings of the containers that face one another. Thus, any snow or water that falls on the shipping containers may flow between the shipping containers and around the portions of the shipping containers that are sealed together rather than just settling on top of the roofs of the shipping containers if the entire frames of the shipping containers were sealed to each other. Any rain or snow sitting on the roof of a shipping container may increase the likelihood of fluid leakage to the interior of the units which may cause damage.

In this example embodiment, each doorway (i.e., door frame) 504/1 and 504/2 of the nurse unit 504 is larger in height and width than the corresponding door 502*d*1 and 502*d*2 of the mobile medical unit 502. Each doorway 504/1 and 504/2 of the nurse unit 506 includes a frame with an outward-facing planar surface that faces and runs parallel to a corresponding outward-facing planar surface that is a portion of the exterior wall of the unit 502 which is around the doors 502*d*1 or 502*d*2 of the mobile medical unit 502. The outward-facing planar surface portions of the mobile medical unit 502 faced by and adjacent to the outward-facing surface portions around the frames of the doorways 504/1 and 504/2 of the nurse unit 506 are planar or in other words have a flat pattern. Because these surface portions of the units 502 and 504 face are adjacent one another the foam seal is placed on these flat surfaces which are then urged towards each other due to the clamping of the corner blocks which will aid in forming a seal around the doors 502*d*1 and 502*d*2 as the rooms 502*a* and 502*b* may be at a positive pressure or a negative pressure relative to the nurse unit 504 as explained previously for unit 100. The widths and thickness of the planar or flat pattern surfaces that are adjacent to one another are dimensioned to be wide enough (e.g., at least about 6 inches) and thick enough to withstand the compression forces when they are pushed together as the shipping containers are clamped and urged together.

In this example embodiment, prior to bringing the two shipping containers for unit 502 and 504 physically together, seals are provided between of each of the larger openings between the surfaces of the two units 502 and 504 that face one another. For example, since doorways 504/1 and 504/2 are larger than the opposing doors 502*d*1 and 502*d*2, respectively, seals can be positioned so that they will be at and/or around the portions of the doorways 504/1 and 504/2 of unit 504 that will make contact with an opposing surface of the unit 502. In some embodiments for compound structures, when two shipping containers are urged together and the entirety or a majority of the walls that would otherwise be adjacent to one another are removed then the seal may be sized and disposed to be between the entire frames of the shipping containers that are adjacent to one another.

Another aspect of the foam seals that can be used in accordance with the teachings herein is that they are more resilient to forces which may be encountered during use. For example, there may be shocks or vibrations or shearing forces that cause the adjacent shipping containers to move relative to one another. Using a compressed foam seal results in the seal being maintained between adjacent shipping containers. This is in contrast to conventional techniques of connecting adjacent shipping containers together which typically involves welding the containers together. These welds are more susceptible to cracking and damage when the above-noted forces are experienced by adjacent connected shipping containers, which will make it problematic to maintain a pressurized seal between the shipping containers.

In at least one embodiment the seal may be adhered to either to a surface portion of the mobile medical unit 502 or a surface portion of the nurse station unit 504 at and/or around the frames of doorways 504/1 and 504/2. Alternatively, the seal may be held in place as the two shipping containers are being brough together. As the two shipping containers are brought together in alignment, the frames of the mobile medical unit and the nurse station module are brought into alignment. As the two shipping containers are urged closer together, by increasing the clamping force at the corner casting blocks 502*c*1 and 504*c*1 as well as 502*c*2 and 504*c*2, the seal is increasingly compressed between the adjacent surfaces of the units 502 and 504 that contact one another thereby serving as a gasket for providing a fluid-tight seal around the frames of the doorways 504/1 and 504/2. In this way, air exiting the mobile medical unit 502 via the opening of door 502*d*1 and 502*d*2 from a patient chamber 502*a* or 502*b* can exit only into the nurse station unit 504, and air exiting the nurse station unit 504 via these doors can exit only into a patient chamber. That is, such air cannot escape between the shipping containers themselves.

Accordingly, in at least one embodiment the seal goes around the entire frame of the shipping container and may only be around the openings of the containers that face one another. Thus, any snow or water that falls on the shipping containers may flow between the shipping containers and around the portions of the shipping containers that are sealed together rather than just settling on top of the roofs of the shipping containers if the frames of the shipping containers were sealed to each other. Any rain or snow sitting on the roof of a shipping container may increase the likelihood of fluid leakage to the interior of the units which may cause damage.

It will be appreciated that, in embodiments described herein, all of the various doorway interconnections and/or any cut away areas that do not have a window or door in compound structures made with one or more mobile medical units and other modules such as a nurse station module, a hallway module, a connection module, an anteroom module, and some other modules, may be sealed together in the same way with respective frame-shaped gaskets that are compressed to form airtight seals between each of the various modules that may be used to construct a compound structure.

Figure 10D:
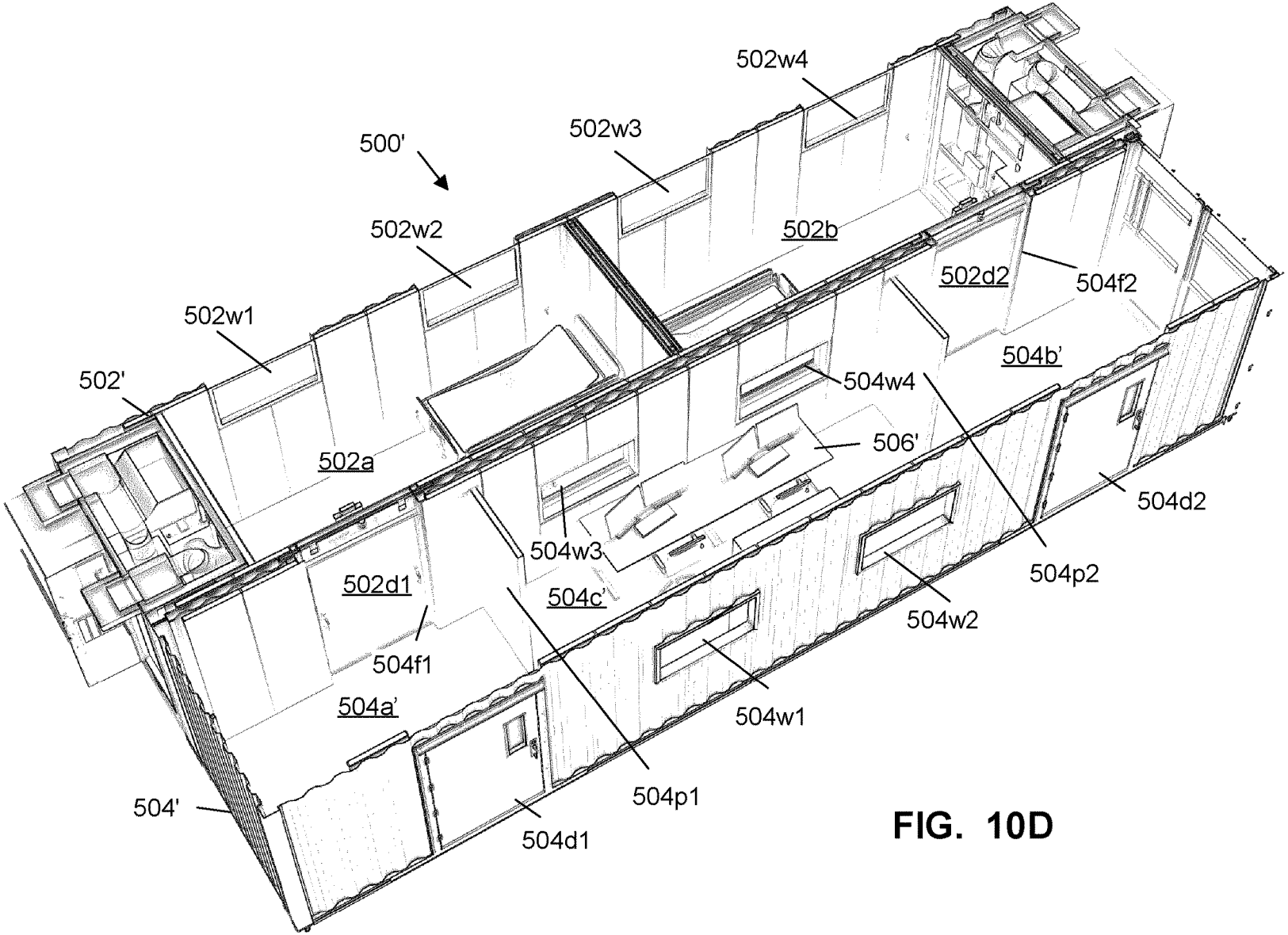
FIG. 10D is a top perspective view of an alternative example embodiment of a compound structure including a mobile medical unit that is connected with another mobile unit that is itself equipped as a nurse station.
Figure 11:
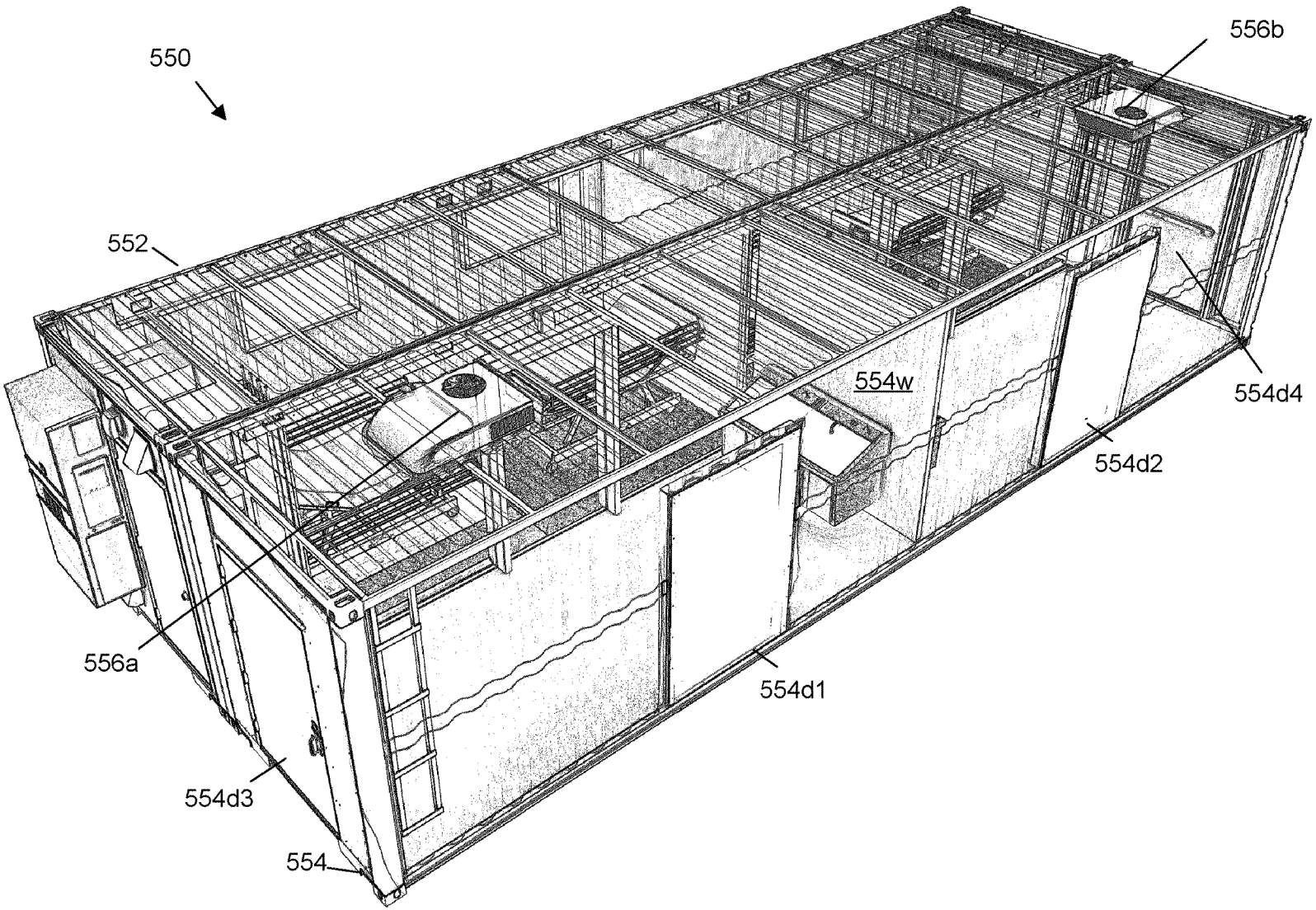
FIG. 11 is a top perspective view of an example embodiment of another compound structure that may utilize the construction techniques and incorporates aspects of the air control system of FIGS. 1 to 9E.

Referring now to FIG. 11, shown therein is a top perspective view of another example embodiment of a compound structure 550 that is somewhat similar to the compound structures 500 and 500' shown in FIGS. 10B and 10D, respectively, with some of portions of the walls and the roof shown translucently. In the example embodiment of FIG. 11, there is a mobile medical unit 552 that is similar to the unit 502 and there is a nurse station unit 554 that is similar to the nurse station unit 504. However, in this example, the nurse station unit 554 is itself divided into independent halves by a wall 554*w*, with each half corresponding to a respective one of the independent halves of the mobile medical unit 552 to which it is connected. Each of the halves of the nurse station unit 554 is provided with its own independent HVAC unit 556*a* and 556*b*, respectively. These HVAC units 556*a* and 556*b* can be mounted on the roof and so the nurse station unit 554 does not need to have maintenance rooms like the mobile medical units 100, 500, and 500'. Furthermore, the nurse station unit 554 can have extra doors 554*d*3 and 554*d*4 leading separately into the two halves of the nurse station unit 554.

It should be noted that the nurse station units 504, 504' and 554 shown in the compound structures 500, 500' and 550 can function as ante rooms which provide a space just outside the patient rooms of the mobile medical units 502, 502' and 552 to reduce any changes in pressure when the doors of the mobile medical units 502, 502' and 552 are open.

Figure 12:
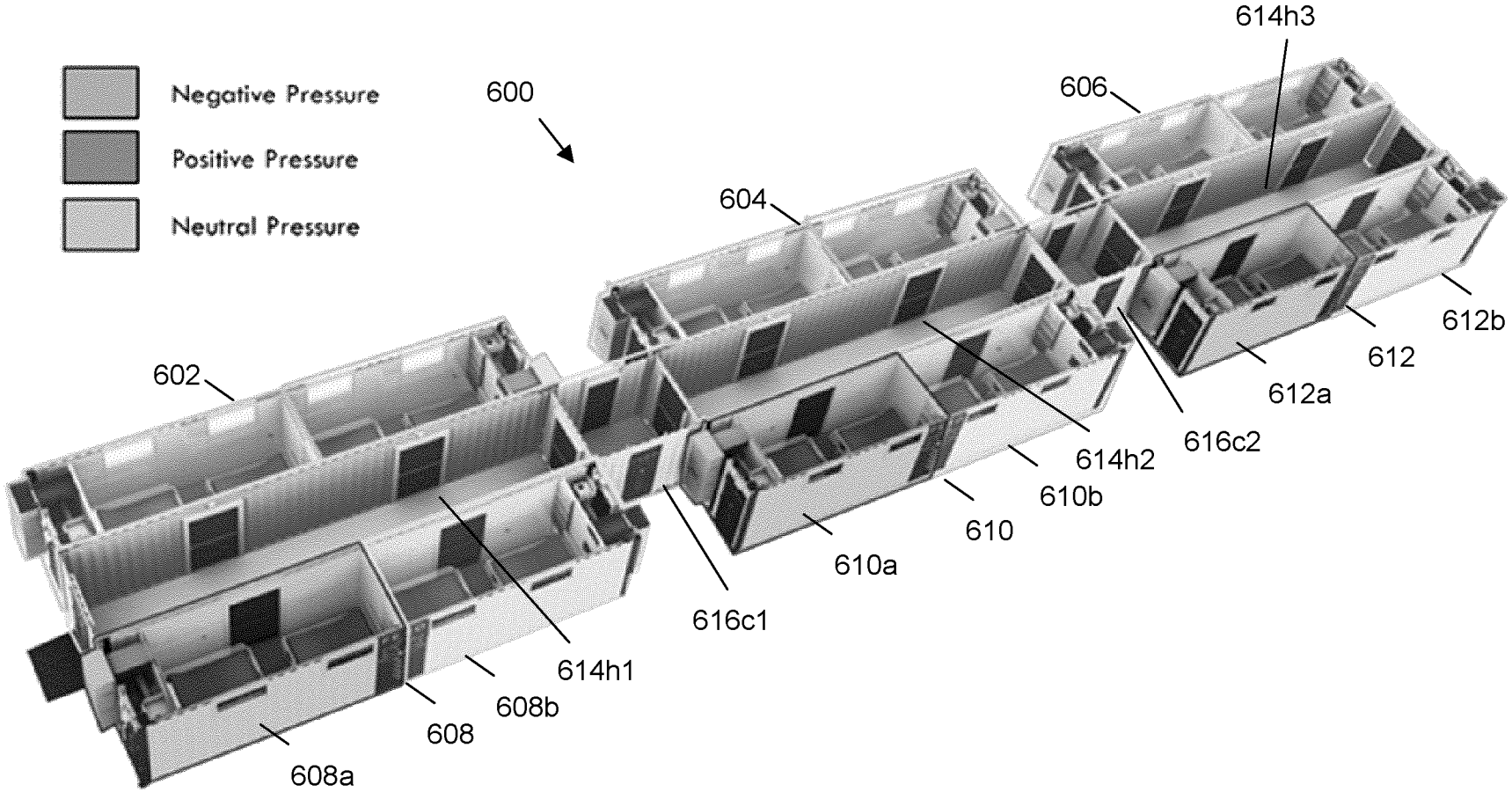
FIG. 12 is a top perspective view of another compound structure, according to another example embodiment, incorporating several mobile medical units each maintaining respective positive, negative or neutral pressures, with the mobile medical units being interconnected with mobile hallway units and mobile nurse stations.

Referring now to FIG. 12, shown therein is a top perspective view of another compound structure 600, according to an example embodiment. In this example embodiment, the compound structure 600 incorporates several mobile medical units 602, 604, 606, 608, 610 and 612 and other modules such as hallway units 614*h*1, 614*h*2 and 614*h*3 and connector units 616*c*1 and 616*c*2. The hallway units 614*h*1, 614*h*2 and 614*h*3 connect with the medical units 602 and 608, 604 and 610 as well as 606 and 612, respectively. Each of the medical units 602, 604, 606, 608, 610 and 612 as well as the hallway units 614*h*1, 614*h*2 and 614*h*3 can be made using shipping containers that are the same size and coupled together in a pressure sealed manner as was explained previously. The connector units 616*c*1 and 616*c*2 may be cut from a section of a shipping container. The connector unit 616*c*1 connects the hallway 614*h*1 to the hallway 614*h*2 and the connector unit 616*c*2 connects the hallway units 614*h*2 to 614*h*3 such that both of the connector units 616*c*1 and 616*c*2 are coupled to the adjacent hallway units in a pressure sealed manner as was explained previously. The medical units 602 to 612 have patient rooms that may each be independently maintained at respective positive, negative or neutral pressure configurations with respect to the external environment as explained previously for mobile medical unit 100. For example, the pressure configurations may be according to what is shown in the colour legend where patient chambers 608*a*, 610*a* and 612*a* are at a negative pressure configuration while patient chambers 608*b*, 610*b* and 612*b* may be at a neutral pressure configuration. Each of the hallway units 614*h*1, 614*h*2 and 614*h*3 act as anterooms that are adjacent to the patient rooms to reduce any pressure variation in the patient rooms when the doors of the patient rooms are opened. Each of the connection units 616*c*1 and 616*c*2 may also include doors that can be used to access the outside environment rather than forcing people to have to constantly walk through the hallway units 614*h*1 to 614*h*3. The other hallway units, patient units, and connection units are all considered to be portable/mobile. The connection units 616*c*1 and 616*c*2 also allow the ends of the mobile medical units that face one another to be spaced apart which allows for an air gap between HVAC units that face one another so that maintenance people have room to service the HVAC units and also so that the HVAC units that face one another do not otherwise interfere with one another.

In this example embodiment, power and data to the nurse station unit 504 may be provided along a twin-male cable extending between the mobile medical unit 502 and the nurse station unit 504. In this manner, the nurse station unit 504 may be powered by the mobile medical unit 502 rather than directly by an external source. Furthermore, the nurse station unit 504 can simultaneously be provided with a data link for conveying audio, video, and other data to and from the mobile medical unit 502. It will be appreciated that wireless communications configurations, such as Wi-Fi, may alternatively, or in addition, be facilitated for communications as between modules and between modules and other locations.

This information can be used to monitor the patient, the air quality and the pressure conditions within the patient chambers 502*a* and 502*b*, as well as to control and/or monitor the medical equipment operating within the patient chambers 502*a* and 502*b*. Patients, their families, and the caregivers are able to connect with each other using the communications infrastructure integrated with the mobile medical unit 502 and the nurse station unit 504. For example, doctors and other medical practitioners can communicate with the families of patients from inside. Alternatively, in at least one embodiment, the nurse station unit 504 can optionally receive its power directly from a power distribution source instead of the mobile medical unit 502.

Referring now to FIG. 10D, shown therein is a top perspective view of an alternative embodiment of a compound structure 500' that includes a medical unit 502' that is connected with another mobile unit 504'. The units 502' and 504' are similar to the units 502 and 504 but have a few differences. In this case, there are windows on the walls of the units 502' and 504' that are adjacent to one another. In addition, the nurse work station 506' is facing towards the unit 502'. This configuration allows nurses, medical personnel or other people look through windows 504*w*3 and 504*w*4 into patient rooms 502*a* and 502*b* respectively. The unit 504' also has partitions or half-walls 504*p*1 and 504*p*2 that can be used to partition the unit 504' into three sections 504*a*', 504*b*' and 504*c*'. In an alternative embodiment, instead of half-walls 504*p*1 and 504*p*2 there can be full walls with pocket doors.

Figure 13:
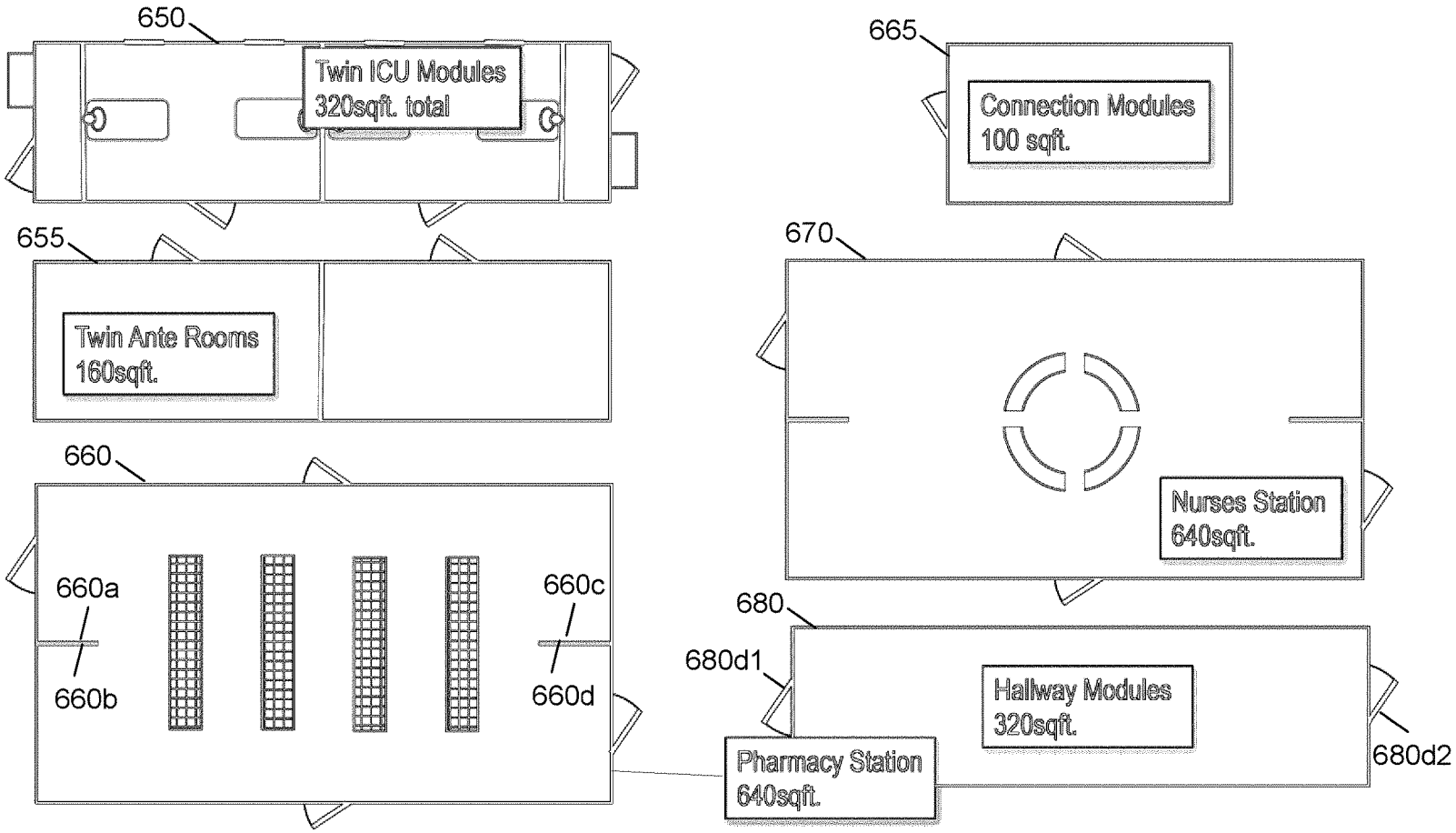
FIG. 13 is a plan view of example embodiments of various portable units including an ante-rooms module, a nurse station module, a hallway module, and a connection module, all suitable for assembling together in various configurations as part of one or more compound structures.
Figure 15:
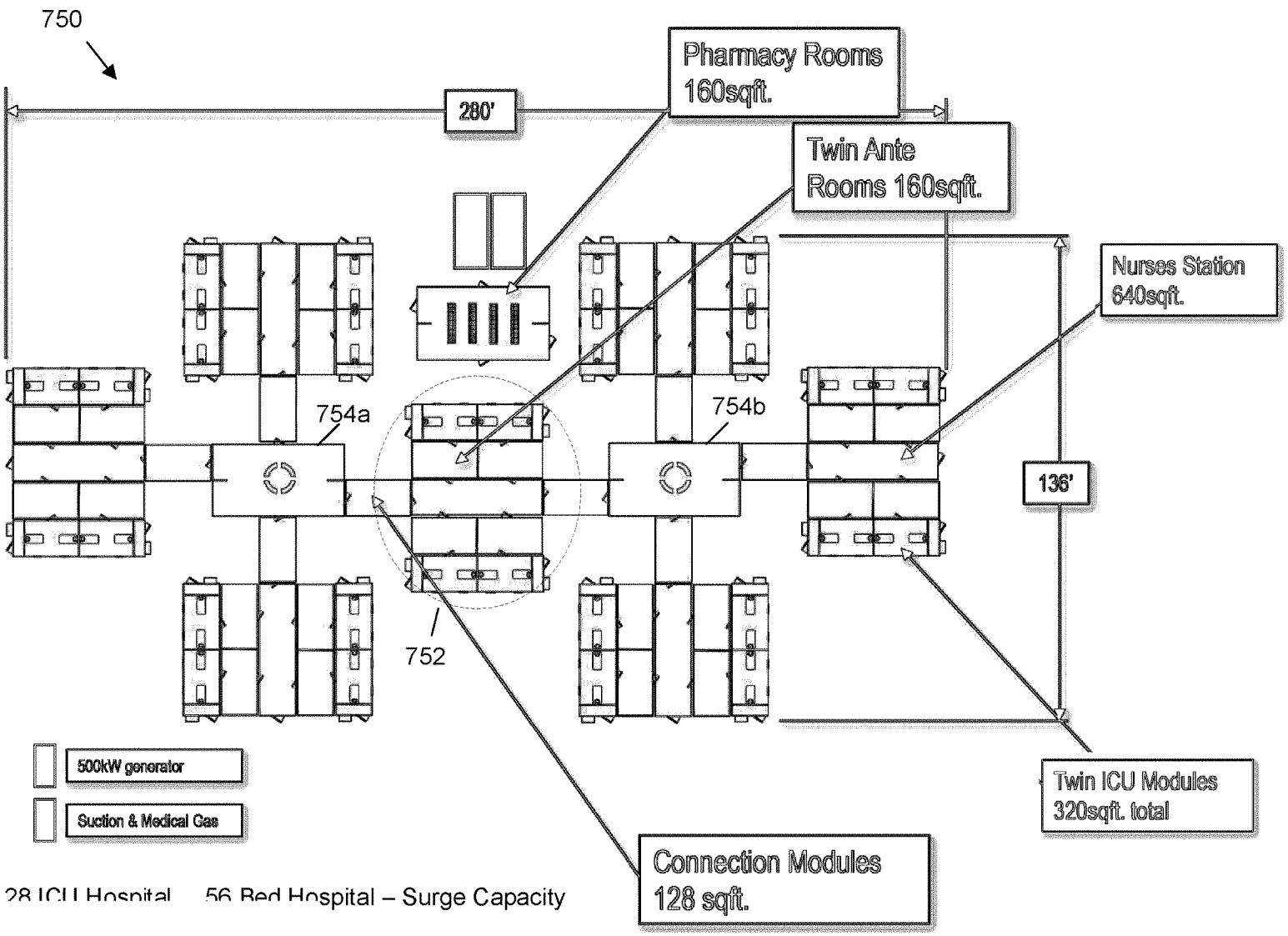
FIG. 15 is a plan view of another example embodiment of a compound structure assembled from multiple portable modules shown in FIG. 13 in an interconnected two hub/spoke format, the compound structure serving as a fifty-six (56) bed hospital incorporating twenty-eight (28) ICUs or ORs.

Referring now to FIG. 15, shown therein is a plan view of another example embodiment of a compound structure 750 that is assembled from multiple modules that are shown in FIG. 13 in an interconnected two hub/spoke format. The compound structure 750 may serve as a fifty-six (56) bed hospital incorporating twenty-eight (28) ICUs or ORs. In particular, the compound structure 750 is centered by a central structure 752 that includes a hallway module running between two anteroom modules each incorporating two anterooms. Each anteroom faces a respective patient chamber of a mobile medical unit, and the door of the patient chamber can open into its respective anteroom. The hallways of the central structure 752 opens at each end into connection modules that, in turn, are each connected to a respective nurse station module 754*a* and 754*b*. Each of nurse station module 754*a* and 754*b* has four doors each opening into a respective connection module which, in turn, extends into a respective hallway module running between two anteroom modules each incorporating two anterooms, with each anteroom facing a respective patient chamber whose door can open into its respective anteroom. In alternative embodiments, the various units shown in FIG. 15 may have different lengths, and/or widths and the sizes shown in FIG. 15 serve as examples only.

It should be noted that the nurse station units 504, 504' and 554 shown in the compound structures 500, 500' and 550 can function as ante rooms which provide a space just outside the patient rooms of the mobile medical units 502, 552 and 552' to reduce any changes in pressure when the doors of the mobile medical units 502, 552 and 552' are open.

Figure 17:
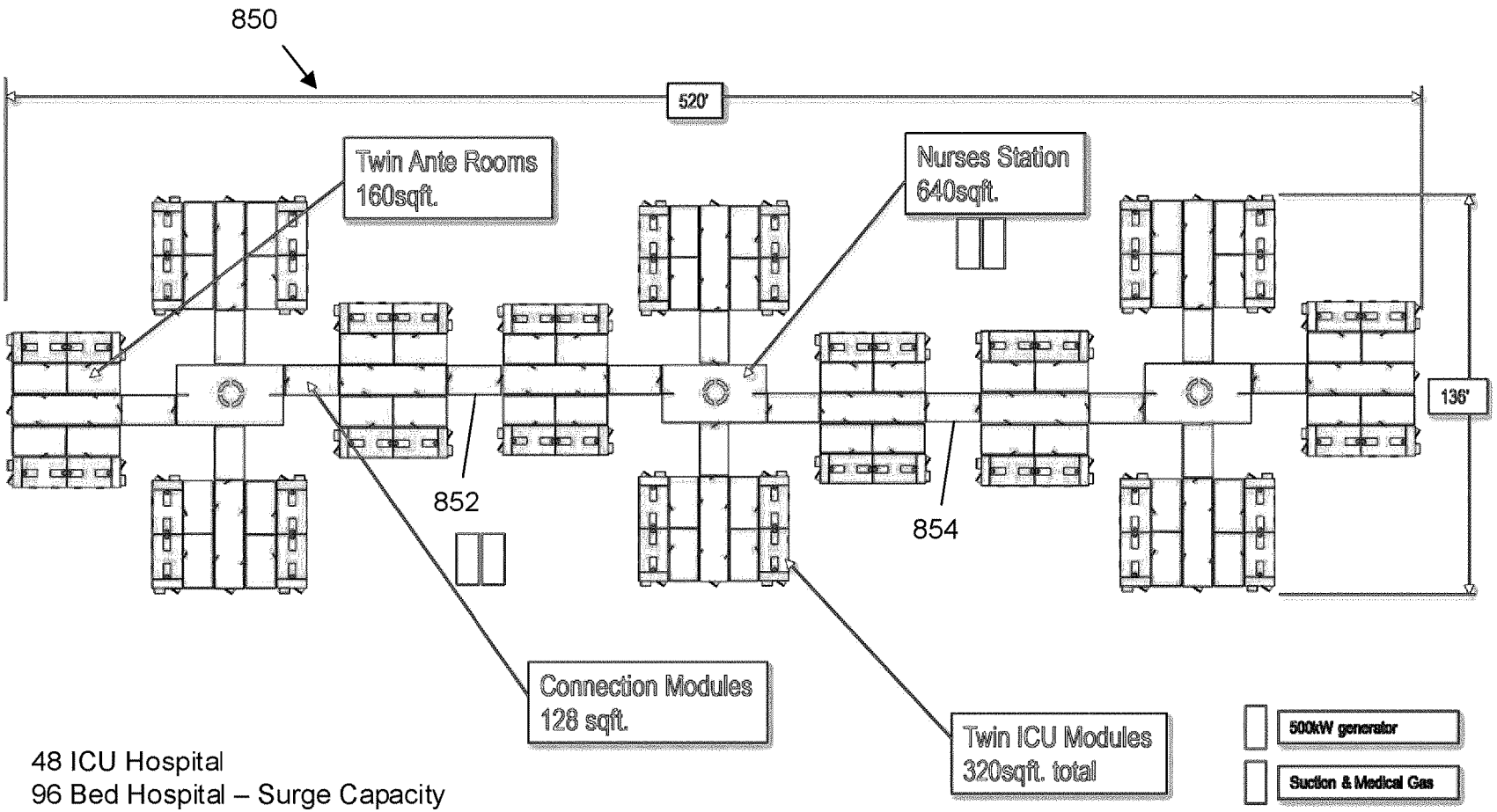
FIG. 17 is a plan view of another example embodiment of a compound structure assembled from multiple portable modules shown in FIG. 13 in an interconnected three hub/spoke format, the compound structure serving as a ninety-six (96) bed hospital incorporating forty-eight (48) ICUs or ORs.
Figure 18:
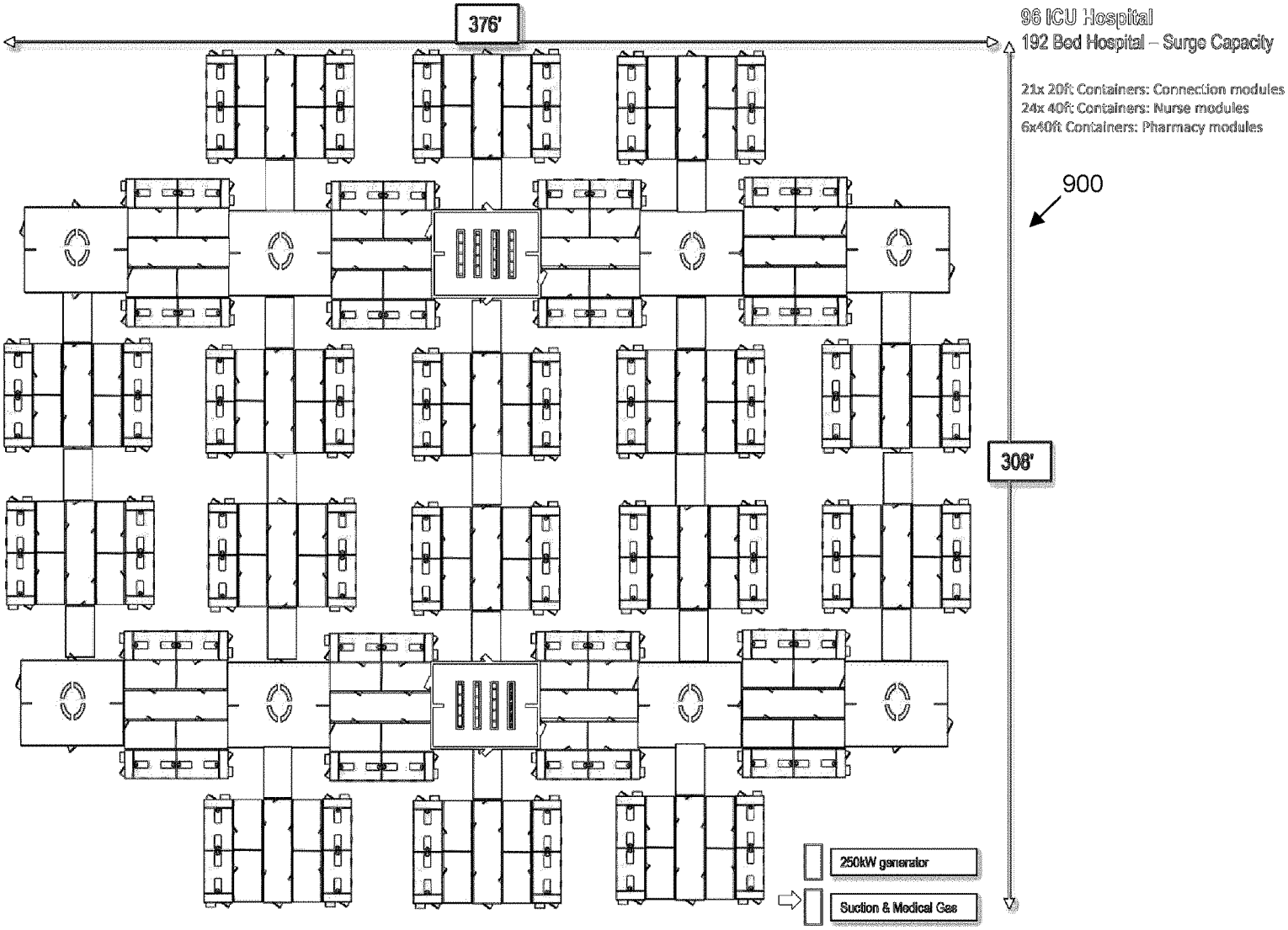
FIG. 18 is a plan view of another example embodiment of a compound structure assembled from multiple portable modules shown in FIG. 13 in an interconnected mesh format, the compound structure serving as a one hundred and ninety-two (192) bed hospital incorporating ninety-six (96) ICUs or ORs.

Referring now to FIG. 17, shown therein is a plan view of another example embodiment of a compound structure 850 assembled from multiple versions of the modules shown in FIG. 13 in an interconnected three hub/spoke format. The compound structure 850 is another example of how a larger compound structure can be made from connecting two or more smaller compound structures. For example, the compound structure 850 contains three of the compound structures 700 connected to one another by connector module/units 852 and 854. In this example embodiment, the compound structure 850 serves as a ninety-six (96) bed hospital incorporating forty-eight (48) ICUs or ORs. Interconnections are similar to, but more extensive than, those described above. Again, in other embodiments, the modules shown in FIG. 17 may have different widths and/or lengths.

Referring now to FIG. 13, shown therein is a plan view of an individual mobile medical unit 650, an anterooms module/unit 655, a nurse station module/unit 670, a hallway module/unit 680, a connection module/unit 665 and a pharmacy station unit 660, all suitable for assembling in various configurations as part of one or more compound structures. Other formats for these modules/units may be provided to form various different compound structures. Each of the units 650 to 680 may be formed from a single shipping container such as the medical unit 650, the anteroom unit 655 and the hallway unit 680, or from a portion of a shipping container such as the connection unit 665 or may be formed by connecting two shipping containers that are coupled together where a majority of walls that would otherwise be adjacent to one another are removed to form a larger space. A portion of these walls may be retained and coupled to one another such as portions 660*a* and 660*b* as well as portions 660*c* and 660*d* for the pharmacy station unit 660 to increase the structural integrity of the unit 660. Any number of doors may be added to each of the units such as doors 680*d*1 and 680*d*2 for the hallway unit 680.

Figure 14:
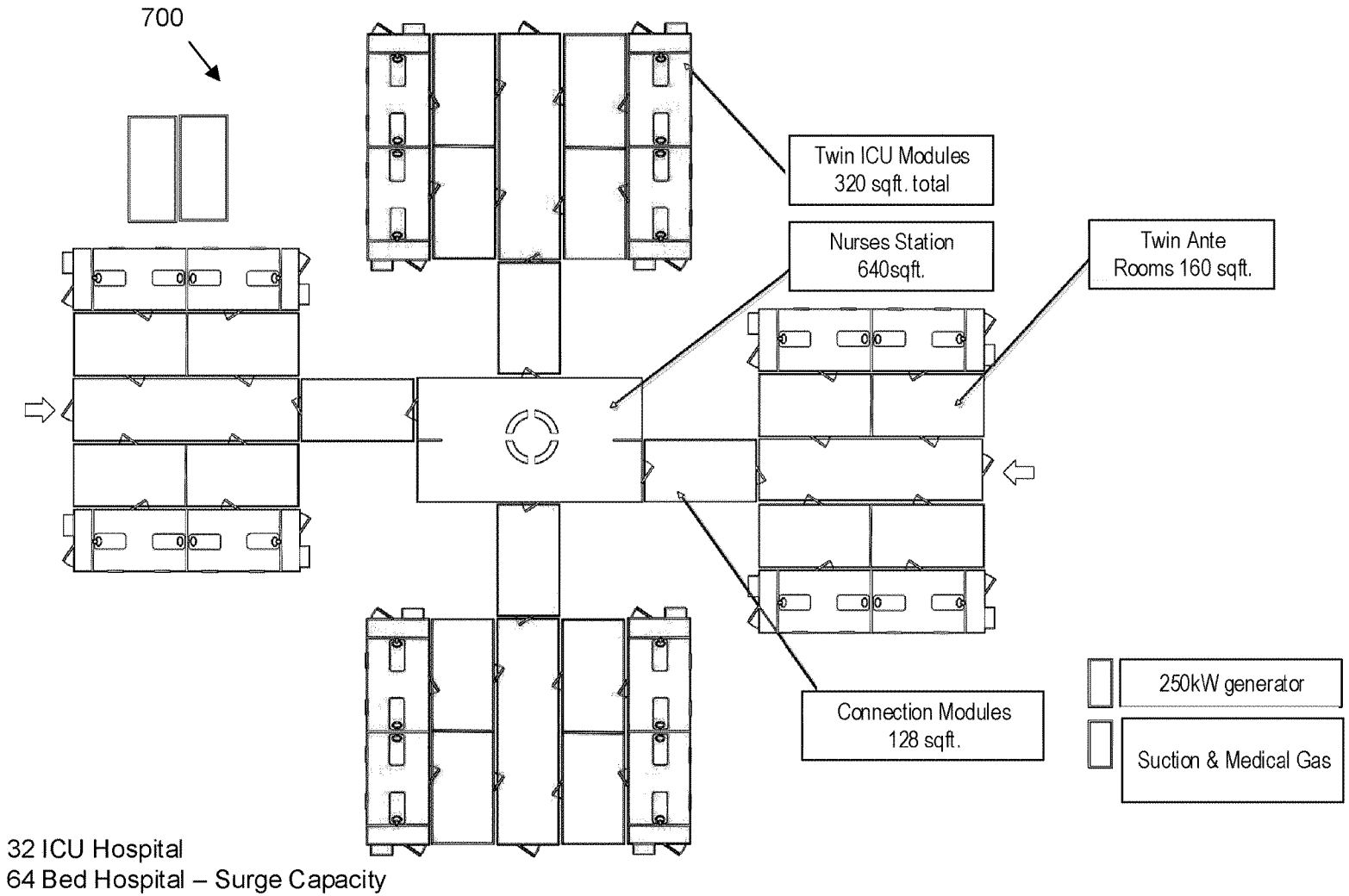
FIG. 14 is a plan view of another example embodiment of a compound structure assembled from multiple portable modules shown in FIG. 13 in a hub/spoke format, the compound structure serving as a thirty-two (32) bed hospital incorporating sixteen (16) ICUs or ORs.

Referring now to FIG. 14, shown therein is a plan view of an example embodiment of a compound structure 700 that is assembled from multiple of the modules/units shown in FIG. 13 in a hub/spoke format. In this example embodiment, the compound structure 700 may be used as a thirty-two (32) bed hospital incorporating sixteen (16) ICUs or ORs. In particular, the compound structure 700 includes a nurse station unit at a central portion, with the nurse station unit itself having four doors that each opening into a respective connection module. Each connection module is also connected to a respective hallway module. Each hallway module runs between two anteroom modules that each, in turn, incorporate two anterooms. Each anteroom faces a respective patient chamber of a mobile medical unit, and the door of the patient chamber can open into its respective anteroom. Example sizes are provided for the various modules. However, it should be understood that these modules/units can have different lengths and/or widths in different embodiments.

Referring now to FIG. 15, shown therein is a plan view of another example embodiment of a compound structure 750 that is assembled from multiple modules that are shown in FIG. 13 in an interconnected two hub/spoke format. The compound structure 750 may serve as a fifty-six (56) bed hospital incorporating twenty-eight (28) ICUs or ORs. In particular, the compound structure 750 is centered by a central structure 752 that includes a hallway module running between two anteroom modules each incorporating two anterooms. Each anteroom faces a respective patient chamber of a mobile medical unit, and the door of the patient chamber can open into its respective anteroom. The hallways of the central structure 752 opens at each end into connection modules that, in turn, are each connected to a respective nurse station module 754*a* and 754*b*. Each of the nurse station module 754*a* and 754*b* has four doors each opening into a respective connection module which, in turn, extends into a respective hallway module running between two anteroom modules each incorporating two anterooms, with each anteroom facing a respective patient chamber whose door can open into its respective anteroom. In alternative embodiments, the various units shown in FIG. 15 may have different lengths, and/or widths and the sizes shown in FIG. 15 serve as examples only.

Figure 16:
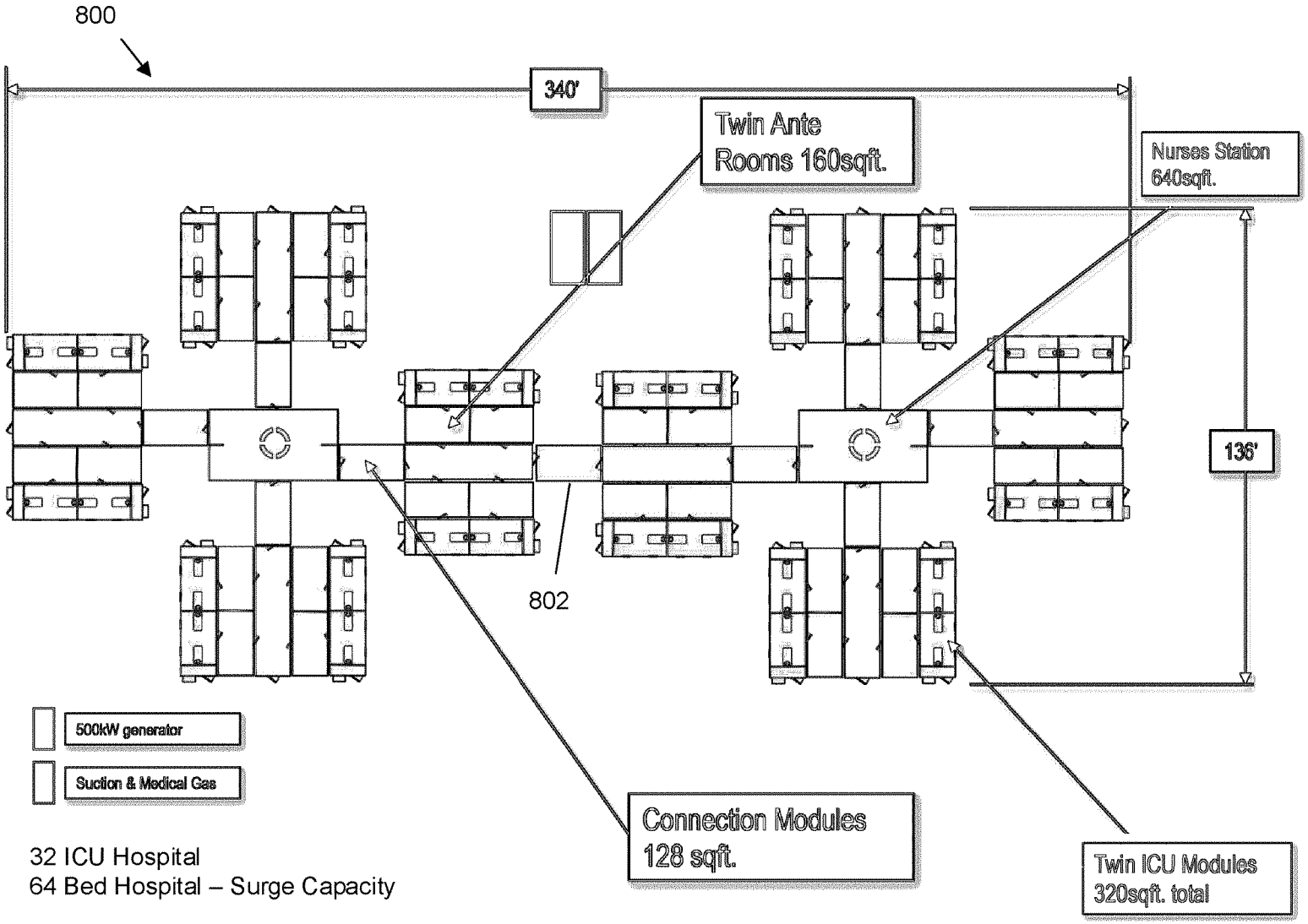
FIG. 16 is a plan view of another example embodiment of a compound structure assembled from multiple portable modules shown in FIG. 13 in a modified interconnected two hub/spoke format, the compound structure serving as a sixty-four (64) bed hospital incorporating thirty-two (32) ICUs or ORs.

Referring now to FIG. 16, shown therein is a plan view of another example embodiment of a compound structure 800 that is assembled from multiple versions of the modules shown in FIG. 13 in a modified interconnected two hub/spoke format. The compound structure 800 is an example of how a larger compound structure can be made from connecting two or more smaller compound structures. For example, the compound structure 800 contains two of the compound structures 700 connected to one another by a connector module/unit 802. In this example embodiment, the compound structure 800 may serve as a sixty-four (64) bed hospital incorporating thirty-two (32) ICUs or ORs. Again, in other embodiments, the modules shown in FIG. 16 may have different widths and/or lengths.

Referring now to FIG. 17, shown therein is a plan view of another example embodiment of a compound structure 850 assembled from multiple versions of the modules shown in FIG. 13 in an interconnected three hub/spoke format. The compound structure 850 is another example of how a larger compound structure can be made from connecting two or more smaller compound structures. For example, the compound structure 850 contains three of the compound structures 700 connected to one another by connector module/units 852 and 854. In this example embodiment, the compound structure 850 serves as a sixty-four (64) bed hospital incorporating thirty-two (32) ICUs or ORs. Interconnections are similar to, but more extensive than, those described above. Again, in other embodiments, the modules shown in FIG. 16 may have different widths and/or lengths.

As another example the metal housing of the shipping container including the roof and/or the outer walls as well as optionally the rigid wall panels described herein may be used for suspending certain medical or airflow system components, such as the HVAC system, which allows these components to be distributed around the shipping container freeing up more space in the shipping container for the rooms contained therein. For example, marine grade materials may be used for certain wall panels, ceiling components and housing of the shipping container which provides additional structural integrity for the various modules/units described herein.

Figure 19:
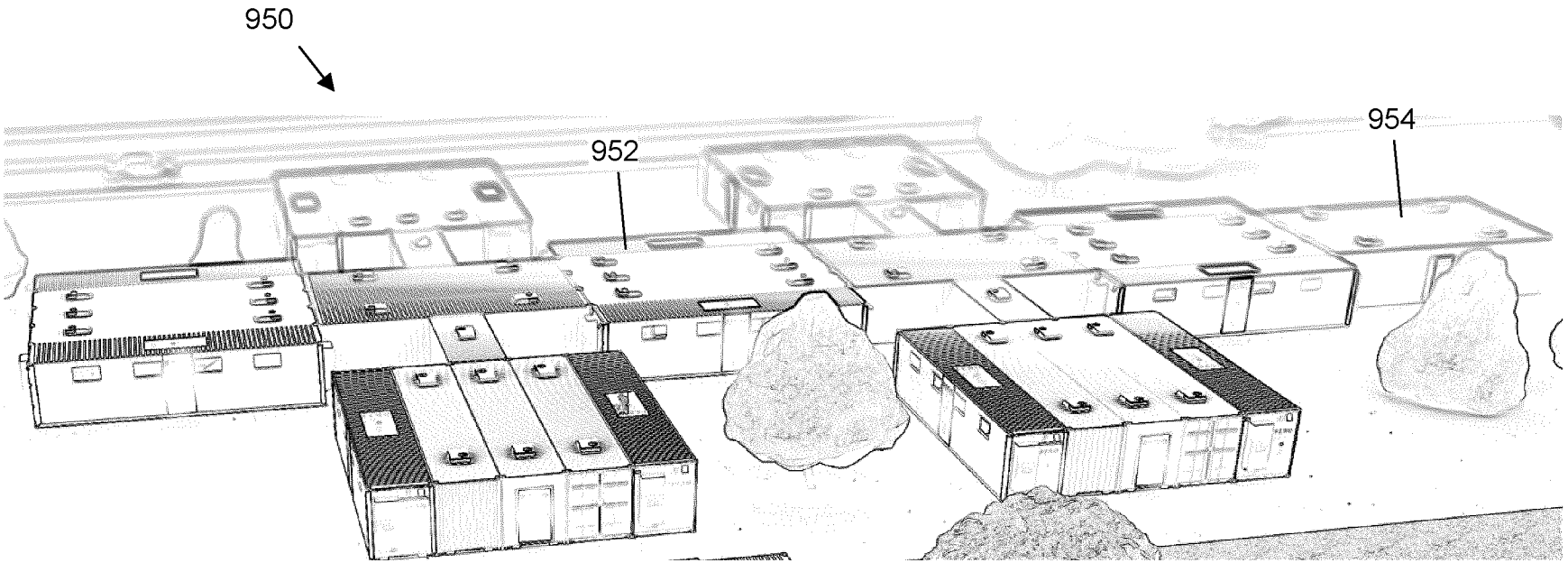
FIG. 19 is an aerial perspective view of another example embodiment of a compound structure assembled from multiple portable modules in a modified hub/spoke format, with a single standalone module onsite.

Referring now to FIG. 19, shown therein is an aerial perspective view of another example embodiment of a compound structure 950 that is assembled from multiple versions of the modules shown in FIG. 13 in a modified hub/spoke format, with a single standalone module 952 at the centre of the compound structure. In this example embodiment, there is also an additional hallway/entrance module 954 at the far right end.

In the various example embodiments disclosed herein, the mobile medical unit and the other modules usable for forming compound structures of various configurations, are fully insulated to provide reliable operation within temperatures ranging from −50° C. (−58° F.) to about 50° C. (122° F.), and a constructed with fire-resistant construction techniques and materials.

It should be noted that in the various embodiments described herein where shipping containers are being used as mobile medical units or portions of a compound structure that is used for medical purposes, the various modules and units are built to meet medical/hospital room standards such as those used in hospitals while occupying a more constrained physical space (i.e., a shipping container). Since the shipping containers include metal walls and metal roofs and these units need to be mobile, which may involve transport using a flatbed truck or a tractor trailer that travels on rough surfaces (e.g., bumpy country or city roads), different construction techniques are used compared to those which would be used in a conventional medical setting in a building.

For example, certain components are constructed to have increased rigidity which may include the various ducts that are used by the airflow systems. These ducts have seams that are sealed using a more durable sealant, such as concrete sealing, that is able to withstand shocks that are experienced during transportation of the medical unit. The duct work that is used is therefore rigid. This is in contrast to the duct work used in medical buildings where the duct seams may be sealed with duct tape.

As another example the metal housing of the shipping container including the roof and/or the outer walls as well as optionally the rigid wall panels described herein may be used for suspending certain medical or airflow system components, such as the HVAC system, which allows these components to be distributed around the shipping container freeing up more space in the shipping container for the rooms contained therein. For example, marine grad materials may be used for certain wall panels, ceiling components and housing of the shipping container which provides additional structural integrity for the various modules/units described herein.

In the various embodiments described herein, the containers that are used to make the various units can be other types of suitable shipping/storage containers including double-door containers, for example.

In one aspect, in accordance with the teachings herein, in at least one embodiment described herein there is provided a mobile medical unit comprising a housing incorporating at least two patient chambers, the patient chambers sealed from each other and each independently powered and provided with independent air handling.

In at least one embodiment, the housing is a shipping container.

In at least one embodiment, there are two patient chambers.

In at least one embodiment, the independent air handling comprises independent air filtration and conditioning.

In another aspect, in accordance with the teachings herein, in at least one embodiment there is provided an airflow system for a chamber, the airflow system comprising: an air inlet subsystem for drawing air into the chamber at an inlet rate; an air outlet subsystem for drawing air out of the chamber at an outlet rate; an air pressure control system associated with the air inlet subsystem and the air outlet subsystem, the air pressure control system controlling the inlet rate and the outlet rate thereby to enable the chamber to be operated with respect to the ambient air pressure outside of the chamber as any of: a positive pressure chamber, a negative pressure chamber, and a neutral pressure chamber.

In at least one embodiment, each of the male portions is a tab, and each of the female portions is a slot, the tab extending away from the panel body from an end of the slot at an angle that is offset from the plane of its respective right or left side, wherein each slot is dimensioned to receive the tab of another like wall panel.

In at least one embodiment, while each slot is receiving the tab of another like wall panel, the tab associated with the slot is in contact with the tab of the like wall panel.

In at least one embodiment, the air inlet subsystem comprises a damper for modifying the rate of airflow entering the chamber; and the air outlet subsystem comprises a damper for modifying the rate of airflow exiting the chamber.

In at least one embodiment, the air inlet subsystem is associated with an HVAC subsystem for providing at least one of: air-cooling, air heating, and humidity control.

In another aspect, in accordance with the teachings herein, in at least one embodiment this is provided an airflow system for a chamber, the airflow system comprising: an air inlet subsystem for drawing air into the chamber at an inlet rate; an air outlet subsystem for drawing air out of the chamber at an outlet rate; an air pressure control system associated with the air inlet subsystem and the air outlet subsystem, the air pressure control system controlling the inlet rate and the outlet rate thereby to enable the chamber to be operated with respect to the ambient air pressure outside of the chamber as any of: a positive pressure chamber, a negative pressure chamber, and a neutral pressure chamber.

In at least one embodiment, the airflow system further comprises a user interface associated with the air pressure control system for receiving instructions from a user and for, in response, instructing the air pressure control system to control the inlet rate and the outlet rate to at least one of: transition the chamber from a positive pressure chamber to a negative pressure chamber; transition the chamber from a negative pressure chamber to a positive pressure chamber; transition the chamber from a negative pressure chamber to a neutral pressure; transition the chamber from a positive pressure chamber to a neutral pressure; transition the chamber from a positive pressure chamber having a first positive pressure to a positive pressure chamber having a second positive pressure; transition the chamber from a negative pressure chamber having a first negative pressure to a negative pressure chamber having a second negative pressure; increase a rate of air exchange through the chamber; decrease a rate of air exchange through the chamber.

In at least one embodiment, the air inlet subsystem comprises a HEPA filter; and the air outlet subsystem comprises a HEPA filter.

In at least one embodiment, the air inlet subsystem comprises a damper for modifying the rate of airflow entering the chamber; and the air outlet subsystem comprises a damper for modifying the rate of airflow entering the chamber.

In at least one embodiment, the air inlet subsystem is associated with an HVAC subsystem for providing at least one of: air-cooling, air heating, humidity control.

In another aspect, in accordance with the teachings herein, in at least one embodiment there is provided a compound structure comprising at least: a first mobile unit comprising a first doorway; and a second mobile unit comprising a second doorway, the first and second mobile units being held adjacent to each other with the first and second doorways in alignment; a first compressible gasket compressed between the first and second doorways thereby to seal the interface between the first and second mobile units about the first and second doorways.

In at least one embodiment, the compressible gasket maintains the seal under positive, negative and neutral pressures within the first and second mobile units.

In at least one embodiment, the compressible gasket is formed of neoprene rubber foam.

In at least one embodiment, the compressible gasket is shaped to frame the first and second doorways, and preferably has a frame width of about three inches, and more preferably has a thickness of about three inches.

In at least one embodiment, the first mobile unit comprises a third doorway and the second mobile unit comprises a fourth doorway, the compound structure further comprising a second compressible gasket compressed between the third and fourth doorways thereby to also seal the interface between the first and second mobile units about the third and fourth doorways.

In another aspect, in accordance with the teachings herein, in at least one embodiment there is provided a compound structure comprising a plurality of mobile modules adjacent to and connected to each other, wherein the plurality of mobile modules comprises at least one mobile module of a first kind and at least one mobile module of a second kind that is different from the first kind.

In at least one embodiment, the first kind and the second kind are selected from the group consisting of: a medical module, a hallway module, a connection module, a nurse station module, an anteroom module, and a pharmacy module.

In at least one embodiment, the processor unit is configured to control the HVAC system that is adapted to process the incoming air by providing air-cooling, air heating, and/or humidity control.

In at least one embodiment, the airflow system comprises: an air inlet subsystem disposed at an upper portion of the maintenance room and configured for drawing inlet air into the room at an inlet rate; an HVAC system that is located exterior to the maintenance room and is fluidically coupled to the air inlet subsystem for receiving the inlet air and conditioning the inlet air and sending the conditioned air into the room; and an air outlet subsystem disposed at a lower portion of the maintenance room and configured for receiving outlet air and sending the outlet air out of the room at an outlet rate.

In at least one embodiment, the air outlet subsystem comprises an inlet and an outlet, the inlet of the air outlet subsystem being adapted to receive air from the room and provide the air to the HEPA filter of the air outlet subsystem for filtering the air and providing the filtered air to the output of the air outlet subsystem for venting to the outside of the room.

In at least one embodiment, the air inlet subsystem and the air outlet subsystem each comprise a HEPA filter unit and a damper unit coupled to the HEPA filter unit, wherein the processing unit is configured to control the inlet rate and the outlet rate of the airflow system by adjusting a valve position of each damper unit.

In at least one embodiment, the air inlet subsystem and the air outlet subsystem each comprise a HEPA filter unit, wherein each HEPA filter unit comprises a variable speed drive, wherein the processor unit is configured to adjust the inlet rate and outlet rate by adjusting the speed of the variable speed drive of each HEPA filter unit.

In at least one embodiment, the processor unit is configured to control the HVAC system is adapted to process the incoming air by providing air-cooling, air heating, and/or humidity control.

In at least one embodiment, the air inlet subsystem includes an inlet and an outlet, the inlet being adapted to receive incoming air from outside the room and provide the incoming air to the HEPA filter unit of the air inlet subsystem for filtering the incoming air and the outlet is adapted to provide the filtered air to an input of the HVAC unit, and the HVAC unit has an output to provide the processed air to the room.

In at least one embodiment, the processor unit is configured to control the air pressure control system to control the inlet rate and the outlet rate to transition the room from a positive pressure configuration to a negative pressure configuration by controlling the inlet rate to be less than the outlet rate.

In at least one embodiment, the processing unit is configured to enable up to about 30 air changes per hour.

In at least one embodiment, a return air vent to the HVAC system can be closed so that no air will re-circulate back through the HVAC system. In such embodiments, the HEPA system that receives fresh air may be sized to feed sufficient airflow into the return duct, thus allowing for a 100% air exchange.

In at least one embodiment, the enclosure further comprises a pressure indicator that is communicatively coupled to the processor unit to receive a control signal therefrom for indicating to individuals outside the room as to whether the room is being maintained at a positive pressure configuration, a negative pressure configuration or a neutral pressure configuration.

In at least one embodiment, the airflow system further comprises an input interface that is associated with the air pressure control system and is communicatively coupled to the processor unit, the input interface being adapted for receiving instructions for a selected air pressure configuration and providing the instructions to the processor unit and in response the processor unit is configured to control the air pressure control system to control the inlet rate and the outlet rate of the room to achieve the selected air pressure configuration for the room.

In at least one embodiment, the airflow system of any one of claim 12, wherein the processor unit is configured to control the air pressure control system to control the inlet rate and the outlet rate to transition the room from a positive pressure configuration to a negative pressure configuration by controlling the inlet rate to be less than the outlet rate.

In at least one embodiment, the processor unit is configured to control the air pressure control system to control the inlet rate and the outlet rate to transition the room from a negative pressure configuration to a positive pressure configuration by controlling the inlet rate to be more than the outlet rate.

In at least one embodiment, the processor unit is configured to control the air pressure control system to control the inlet rate and the outlet rate to transition the room from a negative pressure configuration to a neutral pressure configuration by controlling the inlet rate to be the same as the outlet rate.

In at least one embodiment, the processor unit is configured to control the air pressure control system to control the inlet rate and the outlet rate to transition the room from a positive pressure configuration to a neutral pressure configuration by controlling the inlet rate to be the same as the outlet rate.

In at least one embodiment, the housing is constructed from a shipping container.

In at least one embodiment, the processor unit is configured to control the air pressure control system to control the inlet rate and the outlet rate to or transition the room from a negative pressure configuration having a first negative pressure to a negative pressure configuration having a second negative pressure by controlling the inlet rate from a first value to a second value that is less than the first value and the inlet rate is lower than the outlet rate.

In at least one embodiment, the room comprises a ceiling cavity above a ceiling of the room and the ceiling cavity is pressurized.

In at least one embodiment, the ceiling cavity is pressurized to be at the ambient pressure that is external to the room.

In at least one embodiment, the structure is a mobile medical unit and the room is a patient chamber.

In at least one embodiment, the air pressure control system further comprises a pressure indicator, and the method further comprises setting the pressure indicator to indicate the air pressure configuration of the room of the portable enclosure.

In another aspect, in accordance with the teachings herein, in at least one embodiment there is provided a method of configuring an air pressure of a room of a portable, semi-permanent or permanent enclosure having an airflow system, the airflow system comprising: an air inlet subsystem for drawing air into the room of the enclosure at an inlet rate, and an air outlet subsystem for drawing air out of the room of the enclosure at an outlet rate, wherein the method comprises: receiving an input via an input interface to select an air pressure configuration for the room of the enclosure and sending the input to a processor unit that is adapted to control the airflow system, the air pressure configuration being a positive pressure, a negative pressure, or a neutral pressure with respect to ambient air pressure outside of the room; varying the inlet rate of the air inlet subsystem, via the processor unit, based on the selected air pressure configuration; and varying the outlet rate of the air inlet subsystem, via the processor unit, based on the selected air pressure configuration.

In at least one embodiment, when the input indicates that the selected air pressure configuration is positive pressure, the method comprises setting the inlet rate to be greater than the outlet rate.

In at least one embodiment, when the input indicates that the selected air pressure configuration is negative pressure, the method comprises setting the inlet rate to be less than the outlet rate.

In at least one embodiment, when the input indicates that the selected air pressure configuration is neutral pressure, the method comprises setting the inlet rate to be equal to the outlet rate.

In at least one embodiment, when the air pressure control system further comprises a pressure indicator, and the method further comprises setting the pressure indicator to indicate the air pressure configuration of the room of the portable enclosure.

In at least one embodiment, the air inlet subsystem and the air outlet subsystem each comprise a damper unit, and varying the inlet rate comprises adjusting a valve position of the damper unit of the air inlet subsystem and varying the outlet rate comprises adjusting a valve position of the damper unit of the air outlet subsystem.

In at least one embodiment, the air inlet subsystem and the air outlet subsystem each comprise a HEPA filter unit with a variable drive system, and varying the inlet rate comprises adjusting the speed of the variable drive system of the HEPA filter unit of the air inlet subsystem and varying the outlet rate comprises adjusting the speed of the variable drive system of the HEPA filter unit of the air outlet subsystem.

In at least one embodiment, based on the input, the method comprises transitioning the room from a positive pressure configuration to a negative pressure configuration by controlling the inlet rate to be less than the outlet rate.

In at least one embodiment, based on the input, the method comprises transitioning the room from a negative pressure configuration to a positive pressure configuration by controlling the inlet rate to be more than the outlet rate.

In at least one embodiment, based on the input, the method comprises transitioning the room from a negative pressure configuration to a neutral pressure configuration by controlling the inlet rate to be the same as the outlet rate.

In at least one embodiment, based on the input, the method comprises transitioning the room from a positive pressure configuration to a neutral pressure configuration by controlling the inlet rate to be the same as the outlet rate.

In at least one embodiment, based on the input, the method comprises transitioning the room from a positive pressure configuration having a first positive pressure to a positive pressure configuration having a second positive pressure by controlling the inlet rate from a first value to a second value that is higher than the first value and the inlet rate is higher than the outlet rate.

In at least one embodiment, based on the input, the method comprises transitioning the room from a negative pressure having a first negative pressure configuration to a negative pressure configuration having a second negative pressure by controlling the inlet rate from a first value to a second value that is less than the first value and the inlet rate is lower than the outlet rate.

In at least one embodiment, the method comprises controlling the air pressure configuration of at least two rooms independently of one another.

In another aspect, in accordance with the teachings herein, there is provided a structure comprising: an enclosure having a room; and an airflow control system that is operated to control an air pressure configuration of the room, the airflow control system being defined according to the teachings herein.

In at least one embodiment, the room comprises a ceiling cavity above a ceiling of the room and the ceiling cavity is pressurized.

In at least one embodiment, the ceiling cavity is pressurized to be at the ambient pressure that is external to the room.

In at least one embodiment, the structure is a portable, semi-permanent or permanent structure.

In at least one embodiment, the structure is a mobile medical unit and the room is a patient chamber.

In at least one embodiment, the female portion is a slot, and the male portion is a tab that extends away from an end of the slot at an angle to a side surface of the panel body, wherein the slot is dimensioned to receive a corresponding tab of the adjacent wall panel.

In at least one embodiment, when the at least one wall panel is laterally engaged with the adjacent wall panel the first male tab of the at least one first lateral interface component of the first at least one wall panel slidably engages a corresponding male tab of at least one second lateral interface component of the adjacent wall panel to make a friction fit.

In at least one embodiment, the tab of each lateral interface component is oriented vertically, horizontally or at an angle with respect to the side surface of the panel body.

In at least one embodiment, each of the first and second lateral interlock interfaces comprises a plurality of lateral interface components disposed along the side surfaces of the panel body.

In at least one embodiment, the panel body further comprises a cavity bounded by the rear surface, the right side surface and the left side surface, and the cavity is adapted to receive a panel of insulation material.

In at least one embodiment, the structure comprises a wall with an inner surface having upper and lower rails and the at least one wall panel has slits at upper and lower portions of the panel body between the front surface and the left and right surfaces where the slits are dimensioned to slidably engage the upper and lower rails to mount the at least one wall panel to the inner surface of the wall of the structure.

In at least one embodiment, at least one, the structure comprises a mobile medical unit housed in a shipping container and the first room is a first patient chamber in the mobile medical unit.

In at least one embodiment, the mobile medical unit includes a second patient chamber with a second airflow system, a middle wall that divides and fluidically seals the first and second patient chambers from one another, and the airflow systems are independently operable to allow the first and second patient chambers to have different pressure configurations.

In at least one embodiment, the first patient chamber is an Intensive Care Unit (ICU) or an Operating Room (OR).

In at least one embodiment, the first patient chamber includes first and second head wall units at first and second opposing walls, and the second wall is adjacent to the maintenance room.

In at least one embodiment, the airflow system of the first patient chamber includes a first air vent at an upper portion of the room to provide a conditioned air flow from the HVAC system to enter the first patient chamber, a second vent at a mid-portion of the room to receive a first portion of the conditioned air flow and recirculate it through the HVAC system and a lower vent to receive a second portion of the conditioned air flow and remove it from the patient chamber.

In at least one embodiment, the structure comprises a first shipping container and a second shipping container that are coupled to one another with at least one opening that is common to adjacent surfaces of the of the shipping containers and a seal that is disposed about the common opening to provide a pressure seal around the at least one opening.

In at least one embodiment, each opening comprise planar surfaces around the openings, the seal is positioned at one of the planar surfaces and the planar surfaces contact one another when the a first and second shipping containers are urged together.

In at least one embodiment, the planar surface are at least about six inches wide.

In at least one embodiment, the seal has a thickness of about two to three inches, and a width of about two to three inches.

In at least one embodiment, the at least one opening comprises opposing doorways.

In at least one embodiment, the seal is compressible.

In at least one embodiment, the seal comprises a neoprene rubber foam.

In at least one embodiment, the seal comprises closed cell foam.

In at least one embodiment, the first and second shipping containers are coupled together by mounting and tightening a clamp at corner castings of the shipping containers that are adjacent to one another.

In at least one embodiment, the structure is a compound structure comprising a plurality of mobile units formed from shipping containers or portions of shipping containers wherein adjacent units are coupled together with at least one seal therebetween to provide an airtight seal.

In at least one embodiment, the plurality of mobile units comprises at least one medical mobile unit, at least one hallway unit, at least one connection unit, at least one nurse station unit, at least one anteroom unit, and/or at least one pharmacy unit.

In at least one embodiment, a first portion of the compound structure comprises a first pair of mobile medical units with a first hallway unit disposed in between the first pair of mobile medical units.

In at least one embodiment, a second portion of the compound structure comprises a second pair of mobile medical units with a second hallway unit disposed in between the second pair or mobile medical units and the first and second hallway units are coupled to a connection unit to allow personnel to travel between the first and second portions of the compound structure.

In at least one embodiment, a first portion of the compound structure comprises a pair of mobile medical units, a pair of anteroom units, and a hallway unit where the anteroom units are disposed on either side of the hallway unit and the mobile medical units are disposed on either side of the anteroom units.

In at least one embodiment, the compound structure further comprises a nurse station unit that is coupled to the hallway unit.

In at least one embodiment, the nurse station unit is coupled to the hallway unit via a connector unit.

In at least one embodiment, the compound structure comprises second, third and fourth portions that are identical to the first portion and the nurse station unit is coupled to hallway units of the second, third and fourth portion.

In another aspect, in accordance with the teachings herein, in at least one embodiment there is provided a wall panel system for a structure, wherein the wall panel system comprises: at least one wall panel having a panel comprising: a front surface and a rear surface opposite the front surface; a right side surface and a left side surface opposite the front surface; and a lateral interlock system comprising a first lateral interlock interface that is disposed at the right side surface and a second lateral interlock interface that is disposed at the left side surface, each of the first and second lateral interlock interfaces comprising at least one lateral interface component; wherein the at least one lateral interface component of the first or second lateral interlock interface of the at least one wall panel is oriented to slidably engage at least one lateral interface component of a corresponding interlock interface of an adjacent wall panel to connect the at least one wall panel and the adjacent wall panel in a co-planar fashion to form a larger wall section.

In such cases, the wall panel system is further defined according to any of the embodiments described herein.

In at least one embodiment, the wall panel system is used in a structure which is a shipping container.

In another aspect, in accordance with the teachings herein, in at least one embodiment, there is provided a mobile medical unit comprising: a housing provided by a shipping container or portion thereof; a first room in the housing, the first room being a patient chamber; and an air flow system that is coupled to the room for providing conditioned air thereto and configuring the room to transition between any one of a positive air pressure configuration, a neutral air pressure configuration or a negative air pressure configuration relative to an environment that is external to the housing.

In such cases, the mobile medical unit is further defined according to any one of the embodiments described herein.

In another aspect, in accordance with the teachings herein, in at least one embodiment there is provided a compound structure comprising: a first shipping container; and a second shipping container, at least one opening that is common to both containers; and a seal that is disposed about the at least one opening; wherein the first and second shipping containers are coupled to one another such that the at least one openings are aligned and the first and second shipping containers are urged together during coupling to provide a pressure seal around the at least one opening.

In such cases, the compound structure is further defined according to any one of the embodiments described herein.

In such cases, the structure may be used as an educational structure including a classroom and/or a portable, a military structure, a correctional facility, a penitentiary structure, a testing and vaccination centre, a quarantine facility, a modular laboratory structure, a cleanroom, a long-term care facility, a natural disaster safe shelter, an indigenous community housing structure, a vertical farming structure, a grow room, a clean room, a mobile restaurant, a mobile bar, a cottage, a retail structure, a mining structure, a modular housing structure, a social housing structure or a remote community structure.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

While embodiments of mobile medical unit 100 described and depicted herein are formed by dividing a shipping container 102 into independent halves, in alternative embodiments, a mobile medical unit, or other portable unit, may have a single, larger patient chamber or room, which may be stand-alone or may be connected to or be part of a larger portable, semi-permanent or permanent structure.

Furthermore, while various examples of mobile modules have been described and depicted above, other kinds of mobile modules may be incorporated into a compound structure or used in isolation on a site, including washroom module(s), pharmacy module(s), laboratory module(s), morgue module(s), step down or simple isolation module(s), clean room module(s), utility room module(s), module(s) to house medical gas(es) along with suction and power, and other kinds of modules.

In addition, while particular lengths and formats of shipping containers have been described and depicted herein, it will be understood that the principles described herein are applicable to modules having different dimensions, whether using a shipping container as a base, or whether being custom fabricated and also whether such modules are portable or stationary. Furthermore, there may be embodiments in which different structures may be used rather than shipping containers.

In at least one embodiment described herein, the portable unit 100 or other rooms, and the other modules which may be used with the portable unit 100 for forming portable, semi-permanent, or permanent compound structures of various configurations, may be constructed using fire-resistant construction techniques and materials. For example, the exterior and interior walls and the roof panels of the units and structures described herein may be coated with a fire-retardant spray to prevent damage to the interior of the unit. Alternatively, in at least one example, materials may be used that inherently have fire retardant properties.

Furthermore, while embodiments of compound structures described and depicted herein are single-level structures, alternatives are possible. For example, a compound structure may be assembled by vertically stacking at least two modules and facilitating entry and exit, maintenance and the like, on second, third etc. levels. This may be achievable for mobile units that can support the weight of another, or multiple, mobile units and that do not feature sensitive components such as HVAC equipment extending above or below the mobile units.

In addition, while particular airflow systems have been described and depicted, alternatives are possible that include more or fewer components. For example, ultraviolet (UV) light air cleaners may be placed in the airflow systems, and in particular in the return duct airstream. The UV lights will obstruct airflow somewhat, but the obstruction will not unduly affect providing airflow at proper and safe levels.

The invention claimed is:

1. A structure that is portable, permanent or semi-permanent, wherein the structure comprises:

a housing defining a room therein;

a maintenance room adjacent to the room;

an air flow system that is coupled to the room for providing conditioned air thereto, the air flow system including components located in and exterior to the maintenance room, the air flow system being configured to controllably transition the at least one room to any one of a positive air pressure configuration, a neutral air pressure configuration and a negative air pressure configuration relative to an environment that is external to the housing; an air inlet subsystem configured for drawing inlet air into the room at an inlet rate;

an HVAC system that is located exterior to the maintenance room and is fluidically coupled to the air inlet subsystem for receiving the inlet air, conditioning the inlet air and sending the conditioned air into the room;

an air outlet subsystem configured for receiving outlet air and sending the outlet air out of the room at an outlet rate;

wherein the airflow system further comprises an air pressure control system coupled to the air inlet subsystem and the air outlet subsystem, the air pressure control system having a processor unit that is adapted to control the inlet rate and the outlet rate to enable the air pressure in the room be selectively controlled to be at the positive air pressure configuration, the negative air pressure configuration, or the neutral air pressure configuration, and wherein the air inlet subsystem and the air outlet subsystem each comprise a HEPA filter unit and a damper unit coupled to the HEPA filter unit, wherein the processor unit is configured to control the inlet rate and the outlet rate of the airflow system by adjusting a valve position of each damper unit.

2. The structure of claim 1, wherein the processor unit is configured to control the HVAC system that is adapted to process the incoming air by providing air-cooling, air heating, and/or humidity control.

3. The structure of claim 2, wherein the air inlet subsystem includes an inlet and an outlet, the inlet being adapted to receive incoming air from outside the room and provide the incoming air to the HEPA filter unit of the air inlet subsystem for filtering the incoming air and the outlet is adapted to provide the filtered air to an input of the HVAC system, and the HVAC system has an output to provide the processed air to the room.

4. The structure of claim 2, wherein the air outlet subsystem comprises an inlet and an outlet, the inlet of the air outlet subsystem being adapted to receive air from the room and provide the air to the HEPA filter of the air outlet subsystem for filtering the air and providing the filtered air to the output of the air outlet subsystem for venting to the outside of the room.

5. The structure of claim 1, wherein the processor unit is configured to control air exchanges per hour.

6. The structure of claim 1, wherein the airflow system further comprises an input interface and the structure comprises a pressure indicator, wherein the input interface is associated with the air pressure control system and is communicatively coupled to the processor unit, the input interface being adapted for receiving instructions for a selected air pressure configuration and providing the instructions to the processor unit and in response the processor unit is configured to control the air pressure control system to control the inlet rate and the outlet rate of the room to achieve the selected air pressure configuration for the room, and wherein pressure indicator is communicatively coupled to the processor unit to receive a control signal therefrom for indicating to individuals outside the room as to whether the room is being maintained at a positive pressure configuration, a negative pressure configuration or a neutral pressure configuration.

7. The structure of claim 1, wherein the housing is constructed from a shipping container, a custom enclosure or a different structure.

8. The structure of claim 1, wherein the housing is constructed from a shipping container, the maintenance room is part of the shipping container and the maintenance room comprises a maintenance room door at an exterior of the shipping container to allow access to the maintenance room without entering the room.

9. The structure of claim 8, wherein an inlet of the airflow system is located at a higher location than a top of the maintenance room door and an outlet of the airflow system is located at a level lower than a bottom of the HVAC system.

10. The structure of claim 1, wherein the structure further comprises a wall panel system comprising:

at least one wall panel having a panel body comprising:

a front surface and a rear surface opposite the front surface;

a right side surface and a left side surface opposite the right side surface;

a lateral interlock system comprising a first lateral interlock interface that is disposed on the right side surface and a second lateral interlock interface that is disposed on the left side surface, each of the first and second lateral interlock interfaces comprising at least one lateral interface component;

wherein the at least one lateral interface component of the first or second lateral interlock interface of the at least one wall panel is oriented to slidably engage at least one lateral interface component of a corresponding interlock interface of an adjacent wall panel to form a friction fit and pull the at least one wall panel and the adjacent wall panel together to directly connect the at least one wall panel and the adjacent wall panel in a co-planar fashion to form a larger wall section.

11. The structure of claim 10, wherein the at least one lateral interface component comprises a male portion and a female portion.

12. The structure of claim 11, wherein the female portion is a slot, and the male portion is a tab that extends away from an end of the slot at an angle to a side surface of the panel body, wherein the slot is dimensioned to receive a corresponding tab of the adjacent wall panel.

13. The structure of claim 12, wherein when the at least one wall panel is laterally engaged with the adjacent wall panel a first male tab of the at least one first lateral interface component of the at least one wall panel slides against a corresponding male tab of at least one second lateral interface component of the adjacent wall panel to engage a slot of the at least one second lateral interface component of the adjacent wall panel to make the friction fit.

14. The structure of claim 10, further comprising a cavity bounded by the rear surface, the right side surface and the left side surface.

15. The structure of claim 10, wherein the structure comprises a wall with an inner surface having upper and lower rails and the at least one wall panel has slits at upper and lower portions of the panel body between the front surface and the left and right surfaces where the slits are dimensioned to slidably engage the upper and lower rails to mount the at least one wall panel to the inner surface of the wall of the structure.

16. The structure of claim 1, wherein the structure comprises a mobile medical unit and the room is a first patient chamber in the mobile medical unit.

17. The structure of claim 16, wherein the mobile medical unit includes a second patient chamber with a second airflow system, a middle wall that divides and fluidically seals the first and second patient chambers from one another, and the airflow systems are independently operable to allow the first and second patient chambers to have different pressure configurations.

18. The structure of claim 16, wherein the first patient chamber is an Intensive Care Unit (ICU) or an Operating Room (OR).

19. The structure of claim 16, wherein the first patient chamber includes first and second head wall units at first and second opposing walls, and the second wall is adjacent to the maintenance room.

20. The structure of claim 16, wherein the airflow system of the first patient chamber includes a first air vent at an upper portion of the room to provide a conditioned air flow from the HVAC system to enter the first patient chamber, a second vent at a mid-portion of the first patient chamber to receive a first portion of the conditioned air flow and recirculate it through the HVAC system and a lower vent to receive a second portion of the conditioned air flow and remove it from the first patient chamber.

21. The structure of claim 1, wherein the structure comprises a first shipping container and a second shipping container that are coupled to one another having at least one first and second opening respectively that are aligned when adjacent surfaces of the shipping containers are urged together, and a seal material that is disposed at a frame of one of the at least one first and second openings is compressed to provide a pressure seal around the at least one first and second openings when the first and second shipping containers are coupled to one another.

22. The structure of claim 21, wherein each of the at least one openings comprise planar surfaces therearound, and the seal material is positioned at one of the planar surfaces and the planar surfaces contact one another when the first and second shipping containers are urged together.

23. The structure of claim 21, wherein the at least one aligned openings comprise opposing doorway frames.

24. The structure of claim 21, wherein the seal material is compressible and expands after the two shipping containers are connected together, and the seal material comprises a neoprene rubber foam or a closed cell foam.

25. The structure of claim 21, wherein the first and second shipping containers are coupled together by mounting and tightening a clamp at corner castings of the shipping containers that are adjacent to one another.

26. The structure of claim 1, wherein the structure is a compound structure comprising a plurality of mobile units formed from shipping containers, portions of shipping containers, custom enclosures or different structures wherein adjacent units are coupled together with at least one seal there between to provide an airtight seal.

27. The structure of claim 26, wherein the plurality of mobile units comprises at least one medical mobile unit, at least one hallway unit, at least one connection unit, at least one nurse station unit, at least one anteroom unit, at least one pharmacy unit or a combination thereof.

28. The structure of claim 27, wherein a first portion of the compound structure comprises a first pair of mobile medical units with a first hallway unit disposed in between the first pair of mobile medical units.

29. The structure of claim 28, wherein a second portion of the compound structure comprises a second pair of mobile medical units with a second hallway unit disposed in between the second pair or mobile medical units and the first and second hallway units are coupled to the at least one connection unit to allow personnel to travel between the first and second portions of the compound structure.

30. The structure of claim 26, wherein a first portion of the compound structure comprises a pair of mobile medical units, a pair of anteroom units, and a hallway unit where the anteroom units are disposed on either side of the hallway unit and the mobile medical units are disposed on either side of the anteroom units.

31. The structure of claim 30, wherein the compound structure further comprises a nurse station unit that is coupled to the hallway unit via a connector unit.

32. The structure of claim 31, wherein the compound structure is scalable by adding additional portions that are identical to the first portion and the nurse station unit is coupled to hallway units of the additional portions.

33. The structure of claim 1, wherein the structure is used as an educational structure including a classroom and/or a portable, a military structure, a correctional facility, a penitentiary structure, a testing and vaccination centre, a quarantine facility, a modular laboratory structure, a cleanroom, a long-term care facility, a natural disaster safe shelter, an indigenous community housing structure, a vertical farming structure, a grow room, a clean room, a mobile restaurant, a mobile bar, a cottage, a retail structure, a mining structure, a modular housing structure, a social housing structure, a remote community structure, healthcare facilities, medical clinics, or infrastructure for hospitals.

34. The structure of claim 1, wherein the HEPA filter unit and the damper unit in the air inlet and air outlet subsystems are vertically disposed with respect to one another.

35. The structure of claim 3, wherein the HVAC system includes a return vent that is below the output vent, the return vent being configured for receiving air from the room which is mixed with filtered air from the air inlet subsystem, reconditioned by the HVAC system and provided by an output vent back to the room.

36. A structure that is portable, permanent or semi-permanent, wherein the structure comprises:

a housing defining a room therein;

a maintenance room adjacent to the room;

an air flow system that is coupled to the room for providing conditioned air thereto, the air flow system including components located in and exterior to the maintenance room, the air flow system being configured to controllably transition the at least one room to any one of a positive air pressure configuration, a neutral air pressure configuration and a negative air pressure configuration relative to an environment that is external to the housing, an air inlet subsystem configured for drawing inlet air into the room at an inlet rate;

an HVAC system that is located exterior to the maintenance room and is fluidically coupled to the air inlet subsystem for receiving the inlet air, conditioning the inlet air and sending the conditioned air into the room;

an air, outlet subsystem configured for receiving outlet air and sending the outlet air out of the room at an outlet rate;

wherein the airflow system, further comprises an air pressure control system coupled to the air inlet subsystem and the air outlet subsystem, the air pressure control system having a processor unit that is adapted to control the inlet rate and the outlet rate to enable the air pressure in the room be selectively controlled to be at the positive air pressure configuration, the negative air pressure configuration, or the neutral air pressure configuration; and wherein the air inlet subsystem and the air outlet subsystem each comprise a HEPA filter unit, wherein each HEPA filter unit comprises a variable speed drive, wherein the processor unit is configured to adjust the inlet rate and outlet rate by adjusting the speed of the variable speed drive of each HEPA filter unit.

37. A structure that is portable, permanent or semi-permanent, wherein the structure comprises:

a housing defining a room therein;

a maintenance room adjacent to the room;

an air flow system that is coupled to the room for providing conditioned air thereto, the air flow system including components located in and exterior to the maintenance room, the air flow system being configured to controllably transition the at least one room to any one of a positive air pressure configuration, a neutral air pressure configuration and a negative air pressure configuration relative to an environment that is external to the housing: an air inlet subsystem configured for drawing inlet air into the room at an inlet rate;

an HVAC system that is located exterior to the maintenance room and is fluidically coupled to the air inlet subsystem for receiving the inlet air conditioning the inlet air and sending the conditioned air into the room;

an air outlet subsystem configured for receiving outlet air and sending the outlet air out of the room at an outlet rate;

wherein the structure further comprises a wall panel system comprising:

at least one wall panel having a panel body comprising:

a front surface and a rear surface opposite the front surface;

a right side surface and a left side surface opposite the right side surface;

a lateral interlock system comprising a first lateral interlock interface that is disposed on the right side surface and a second lateral interlock interface that is disposed on the left side surface, each of the first and second lateral interlock interfaces comprising at least one lateral interface component;

wherein the at least one lateral interface component of the first or second lateral interlock interface of the at least one wall panel is oriented to slidably engage at least one lateral interface component of a corresponding interlock interface of an adjacent wall panel to form a friction fit and pull the at least one wall panel and the adjacent wall panel together to directly connect the at least one wall panel and the adjacent wall panel in a co-planar fashion to form a larger wall section;

wherein the at least one lateral interface component comprises a male portion and a female portion; and wherein the female portion is a slot, and the male portion is a tab that extends away from an end of the slot at an angle to a side surface of the panel body, wherein the slot is dimensioned to receive a corresponding tab of the adjacent wall panel.

* * * * *